US011596198B2

(12) United States Patent
Youngs et al.

(10) Patent No.: US 11,596,198 B2
(45) **Date of Patent: *Mar. 7, 2023**

(54) ARTICLES OF FOOTWEAR AND SOLE STRUCTURES FOR ARTICLES OF FOOTWEAR

(71) Applicant: NIKE, Inc., Beaverton, OR (US)

(72) Inventors: Bryan K. Youngs, Beaverton, OR (US); Olivier Henrichot, Lake Oswego, OR (US); Nikita Troufanov, Portland, OR (US); Robert Mervar, Portland, OR (US); Robert M. Bruce, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/187,028

(22) Filed: Feb. 26, 2021

(65) Prior Publication Data

US 2021/0177092 A1 Jun. 17, 2021

Related U.S. Application Data

(62) Division of application No. 16/247,257, filed on Jan. 14, 2019, now Pat. No. 10,959,488, which is a (Continued)

(51) Int. Cl.
*A43B 13/18* (2006.01)
*A43B 13/22* (2006.01)
(Continued)

(52) U.S. Cl.
CPC ..... *A43B 13/186* (2013.01); *A43B 7/20* (2013.01); *A43B 13/04* (2013.01); *A43B 13/125* (2013.01);
(Continued)

(58) Field of Classification Search
CPC ..... A43B 13/186; A43B 13/04; A43B 13/125; A43B 13/141; A43B 13/188; A43B 13/223
See application file for complete search history.

(56) References Cited

U.S. PATENT DOCUMENTS

D201,952 S 8/1965 Johns
D259,595 S 6/1981 Famolare, Jr.
(Continued)

FOREIGN PATENT DOCUMENTS

CN 1065583 A 10/1992
CN 101489428 A 7/2009
(Continued)

OTHER PUBLICATIONS

Mar. 10, 2017—(WO) International Search Report and Written Opinion—PCT/US2016/064344.
(Continued)

*Primary Examiner* — Ted Kavanaugh
(74) *Attorney, Agent, or Firm* — Banner & Witcoff, Ltd.

(57) ABSTRACT

Sole structures (e.g., midsoles and/or outsoles) and articles of footwear include heel-supporting areas and/or forefoot-supporting areas that include a central area (e.g., a central recessed area) and a plurality of surrounding rings. Additionally or alternatively, the sole structures (e.g., midsoles and/or outsoles) may include bands of material defined by recessed grooves to provide a bumpstop type impact-force attenuating structure.

20 Claims, 35 Drawing Sheets

Related U.S. Application Data division of application No. 15/364,320, filed on Nov. 30, 2016, now Pat. No. 10,212,988.

(60) Provisional application No. 62/261,691, filed on Dec. 1, 2015, provisional application No. 62/261,670, filed on Dec. 1, 2015.

(51) Int. Cl.

| | |
|---|---|
| ***A43B 7/20*** | (2006.01) |
| ***A43B 13/04*** | (2006.01) |
| ***A43B 13/12*** | (2006.01) |
| ***A43B 13/14*** | (2006.01) |
| *A43B 3/00* | (2022.01) |

(52) U.S. Cl.

CPC ..... *A43B 13/141* (2013.01); *A43B 13/188* (2013.01); *A43B 13/223* (2013.01); *A43B 3/0042* (2013.01)

(56) References Cited

U.S. PATENT DOCUMENTS

| | | | |
|---|---|---|---|
| 4,571,852 | A | 2/1986 | Lamarche et al. |
| 4,653,206 | A | 3/1987 | Tanel |
| 4,655,465 | A | 4/1987 | Schaeffer |
| 4,897,936 | A | 2/1990 | Fuerst |
| 5,131,173 | A | 7/1992 | Anderie |
| 5,396,675 | A | 3/1995 | Vincent et al. |
| D400,344 | S | 11/1998 | Avar |
| D401,744 | S | 12/1998 | Greenberg |
| 6,038,790 | A | 3/2000 | Pyle et al. |
| 6,108,943 | A | 8/2000 | Hudson et al. |
| D432,762 | S | 10/2000 | Weege |
| D461,040 | S | 8/2002 | Urie et al. |
| D504,555 | S | 5/2005 | Urie |
| 7,347,011 | B2 | 3/2008 | Dua et al. |
| D572,888 | S | 7/2008 | Cai |
| 8,429,835 | B2 | 4/2013 | Dojan et al. |
| 8,516,723 | B2 | 8/2013 | Ferrigan et al. |
| D689,578 | S | 9/2013 | Leishman et al. |
| D689,677 | S | 9/2013 | Bathum et al. |
| D703,928 | S | 5/2014 | Avar et al. |
| D707,931 | S | 7/2014 | VanHook |
| D719,331 | S | 12/2014 | Christensen et al. |
| D734,010 | S | 7/2015 | Fischer et al. |
| 9,462,846 | B2 | 10/2016 | Litchfield et al. |
| D779,179 | S | 2/2017 | Christensen et al. |
| D782,794 | S | 4/2017 | Lee |
| D811,061 | S | 2/2018 | Jury et al. |
| 10,212,988 | B2 * | 2/2019 | Youngs ..... A43B 13/223 |
| 10,959,488 | B2 * | 3/2021 | Youngs ..... A43B 13/04 |
| 2005/0144811 | A1 | 7/2005 | Harb |
| 2006/0265905 | A1 | 11/2006 | Chandler et al. |
| 2010/0293815 | A1 | 11/2010 | Ferrigan et al. |
| 2012/0005921 | A1 | 1/2012 | Diepenbrock |
| 2012/0174433 | A1 | 7/2012 | Mahoney |
| 2013/0008059 | A1 | 1/2013 | Sum |
| 2013/0104423 | A1 | 5/2013 | Hatfield et al. |
| 2013/0291409 | A1 | 11/2013 | Reinhardt et al. |
| 2014/0259789 | A1 | 9/2014 | Dojan et al. |
| 2015/0082668 | A1 | 3/2015 | Nonogawa et al. |
| 2015/0150339 | A1 | 6/2015 | Van Hook |
| 2017/0150777 | A1 | 6/2017 | Youngs et al. |
| 2019/0142108 | A1 | 5/2019 | Youngs et al. |

FOREIGN PATENT DOCUMENTS

| | | | |
|---|---|---|---|
| CN | 105050440 | A | 11/2015 |
| DE | 7924740 | U1 | 5/1980 |
| DE | 8516715 | U1 | 9/1985 |
| EP | 2848144 | A1 | 3/2015 |
| GB | 2497103 | A | 6/2013 |
| WO | 9421150 | A1 | 9/1994 |
| WO | 2013168256 | A1 | 11/2013 |

OTHER PUBLICATIONS

Mar. 9, 2017—(WO) International Search Report and Written Opinion—PCT/US2016/064365.

May 28, 2020—(EP) ESR—App. No. 20153108.4.

* cited by examiner

ARTICLES OF FOOTWEAR AND SOLE STRUCTURES FOR ARTICLES OF FOOTWEAR

RELATED APPLICATION DATA

This application is a divisional of U.S. patent application Ser. No. 16/247,257 filed on Jan. 14, 2019 and entitled "Articles of Footwear and Sole Structures for Articles of Footwear," which is a divisional of U.S. patent application Ser. No. 15/364,320 filed Nov. 30, 2016, now U.S. Pat. No. 10,212,988, and entitled "Articles of Footwear and Sole Structures for Articles of Footwear," which application claims priority benefits to: (a) U.S. Provisional Patent Appln. No. 62/261,670 filed Dec. 1, 2015 and entitled "Articles of Footwear and Sole Structures for Articles of Footwear" and (b) U.S. Provisional Patent Appln. No. 62/261,691 filed Dec. 1, 2015 and entitled "Articles of Footwear and Sole Structures for Articles of Footwear." Each of these priority applications is entirely incorporated herein by reference.

FIELD OF THE INVENTION

The present invention relates to the field of footwear. More specifically, aspects of the present invention pertain to articles of footwear, uppers for articles of footwear, and/or sole structures for articles of footwear, e.g., footwear used in basketball, cross training, and/or other athletic events or activities.

Terminology/General Information

First, some general terminology and information is provided that may assist in understanding various portions of this specification and the invention(s) as described herein. As noted above, the present invention relates to the field of footwear. "Footwear" means any type of wearing apparel for the feet, and this term includes, but is not limited to: all types of shoes, boots, sneakers, sandals, thongs, flip-flops, mules, scuffs, slippers, sport-specific shoes (such as track shoes, golf shoes, tennis shoes, baseball cleats, cricket shoes, soccer or football cleats, ski boots, basketball shoes, cross training shoes, etc.), and the like.

FIG. 6 also provides information that may be useful for explaining and understanding this specification and/or aspects of this invention. More specifically, FIG. 6 provides a representation of a footwear component 100, which in this illustrated example constitutes a portion of a sole structure for an article of footwear. The same general definitions and terminology described below may apply to footwear in general and/or to other footwear components or portions thereof, such as an upper, a midsole component, an outsole component, a ground-engaging component, etc.

First, as illustrated in FIG. 6, the terms "forward" or "forward direction" as used herein, unless otherwise noted or clear from the context, mean toward or in a direction toward a forward-most toe ("FT") area of the footwear structure or component 100. The terms "rearward" or "rearward direction" as used herein, unless otherwise noted or clear from the context, mean toward or in a direction toward a rear-most heel area ("RH") of the footwear structure or component 100. The terms "lateral" or "lateral side" as used herein, unless otherwise noted or clear from the context, mean the outside or "little toe" side of the footwear structure or component 100. The terms "medial" or "medial side" as used herein, unless otherwise noted or clear from the context, mean the inside or "big toe" side of the footwear structure or component 100.

Also, various example features and aspects of this invention may be disclosed or explained herein with reference to a "longitudinal direction" and/or with respect to a "longitudinal length" of a footwear component 100 (such as a footwear sole structure). As shown in FIG. 6, the "longitudinal direction" is determined as the direction of a line extending from a rear-most heel location (RH in FIG. 6) to the forward-most toe location (FT in FIG. 6) of the footwear component 100 in question (a sole structure or foot-supporting member in this illustrated example). The "longitudinal length" L is the length dimension measured from the rear-most heel location RH to the forward-most toe location FT. The rear-most heel location RH and the forward-most toe location FT may be located by determining the rear heel and forward toe tangent points with respect to front and back parallel vertical planes VP when the component 100 (e.g., sole structure or foot-supporting member in this illustrated example, optionally as part of an article of footwear or foot-receiving device) is oriented on a horizontal support surface S in an unloaded condition (e.g., with no weight applied to the component 100 other than potentially the weight of the shoe components with which it is engaged). If the forward-most and/or rear-most locations of a specific footwear component 100 constitute a line segment (rather than a tangent point), then the forward-most toe location and/or the rear-most heel location constitute the mid-point of the corresponding line segment. If the forward-most and/or rear-most locations of a specific footwear component 100 constitute two or more separated points or line segments, then the forward-most toe location and/or the rear-most heel location constitute the mid-point of a line segment connecting the furthest spaced and separated points and/or furthest spaced and separated end points of the line segments (irrespective of whether the midpoint itself lies on the component 100 structure). If the forward-most and/or rear-most locations constitute one or more areas, then the forward-most toe location and/or the rear-most heel location constitute the geographic center of the area or combined areas (irrespective of whether the geographic center itself lies on the component 100 structure).

Once the longitudinal direction of a component or structure 100 has been determined with the component 100 oriented on a horizontal support surface S, planes may be oriented perpendicular to this longitudinal direction (e.g., planes running into and out of the page of FIG. 6). The locations of these perpendicular planes may be specified based on their positions along the longitudinal length L where the perpendicular plane intersects the longitudinal direction between the rear-most heel location RH and the forward-most toe location FT. In this illustrated example of FIG. 6, the rear-most heel location RH is considered as the origin for measurements (or the "0 L position") and the forward-most toe location FT is considered the end of the longitudinal length of this component 100 (or the "1.0 L position"). Plane position may be specified based on the plane's location along the longitudinal length L (between 0 L and 1.0 L), measured forward from the rear-most heel RH location in this example. FIG. 6 further shows locations of various planes perpendicular to the longitudinal direction (and oriented in the transverse direction) and located along the longitudinal length L at positions 0.25 L, 0.4 L, 0.5 L, 0.55 L, 0.6 L, and 0.8 L (measured in a forward direction from the rear-most heel location RH). These planes may extend into and out of the page of the paper from the view shown in FIG. 6, and similar perpendicular planes may be oriented at any other desired positions along the longitudinal length L. While these planes may be parallel to the parallel vertical planes VP used to determine the rear-most heel RH and forward-most toe FT locations, this is not a requirement. Rather, the orientations of the perpendicular planes along the longitudinal length L will depend on the orientation of the longitudinal direction, which may or may not be parallel to the horizontal surface S in the arrangement/orientation shown in FIG. 6.

BRIEF DESCRIPTION OF THE DRAWINGS

The following Detailed Description will be better understood when read in conjunction with the accompanying drawings in which like reference numerals refer to the same or similar elements in all of the various views in which that reference number appears.

Figure 1A:
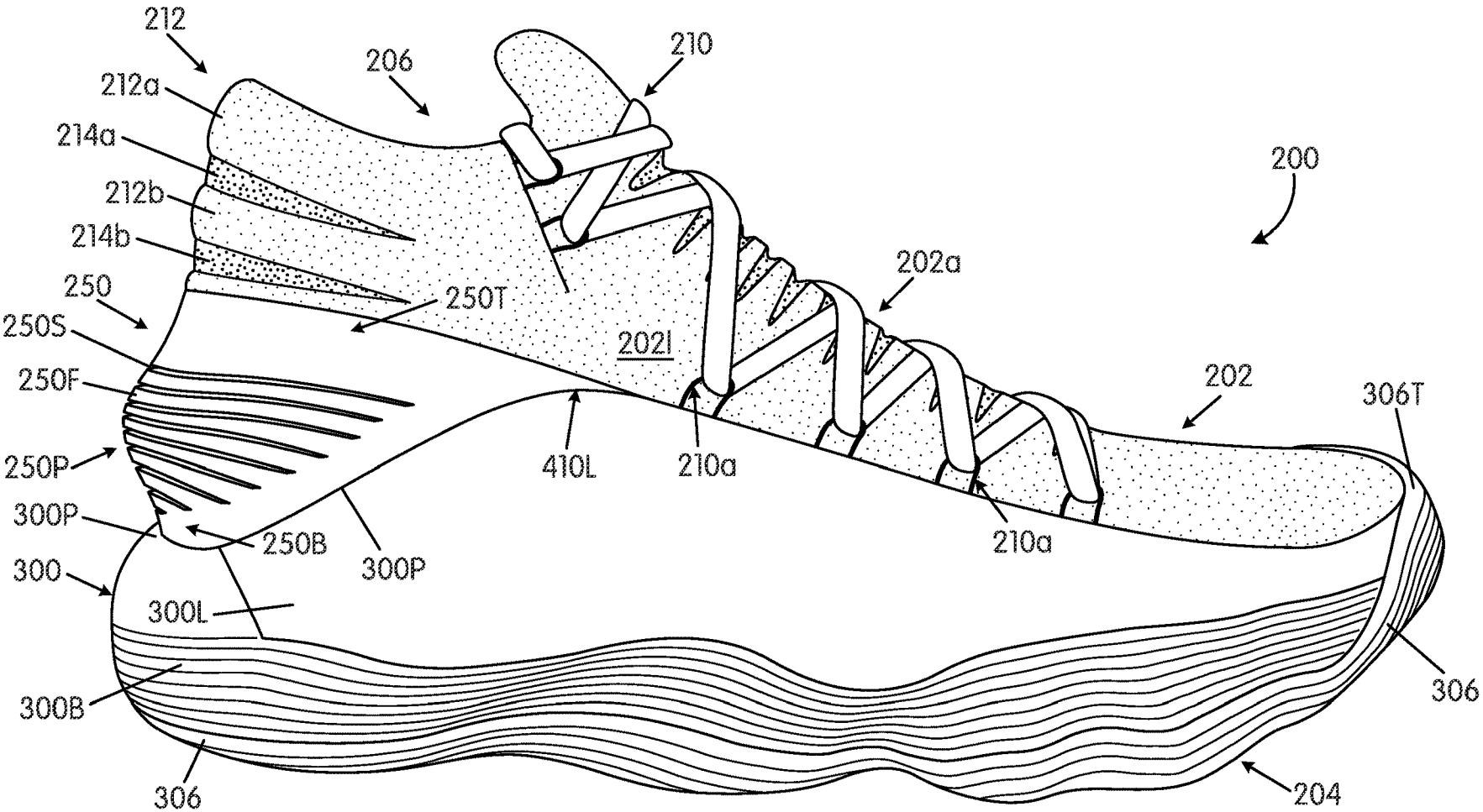
FIGS. 1A-1D provide various views of an article of footwear in accordance with at least some examples and aspects of this invention.

The reader should understand that the attached drawings are not necessarily drawn to scale.

DETAILED DESCRIPTION

In the following description of various examples of footwear structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and functions without departing from the scope of the present invention.

I. GENERAL DESCRIPTION OF ASPECTS OF THIS INVENTION

A. Sole Structure Features

Some aspects of this invention relate to sole structures for articles of footwear. Such sole structures may include an upper-facing surface and a ground-facing surface opposite the upper-facing surface. The sole structures further may include: (a) a heel-supporting region including a central area (e.g., a recessed central area) surrounded by a first plurality of rings defined in the ground-facing surface; and (b) a forefoot-supporting region including a central area (e.g., a recessed central area) surrounded by a second plurality of rings defined in the ground-facing surface. In such structures, each of the first plurality of rings and the second plurality of rings may include: (i) a first ring (an innermost ring) that surrounds (and may at least partially define) the central area (e.g., the recessed central area) and (ii) at least a second ring that surrounds the first ring. Either or both of the first plurality of rings and the second plurality of rings may further include: (iii) a third ring that surrounds the second ring, (iv) a fourth ring that surrounds the third ring, and (v) optionally one or more additional rings. Any desired number of rings may be provided. The rings may be separated by (and/or at least partially defined by) depressions in the material from with the rings and/or supporting regions are formed. Furthermore, the first ring and/or the second ring (and optionally other rings) in the first plurality of rings and/or the second plurality of rings may include a base and an apex (wherein the base is located closer to the upper-facing surface than is the apex), wherein each of the first ring and the second ring may be wider in cross section at its base than at its apex (e.g., triangular, truncated triangular, rounded triangular, trapezoidal, gum-drop shaped, etc. in cross section). If desired, some or all of the ground-facing surfaces or apices of the first and/or second plurality of rings may be co-planar. The heel-supporting region and/or the forefoot-supporting region may constitute parts of a single midsole element made from a polymeric foam material, may constitute parts of two midsole elements made from a polymeric foam material, and/or may constitute parts of one or more outsole elements, etc.

As noted above, in sole structures in accordance with at least some examples of this invention, the heel-supporting region and/or the forefoot-supporting region may constitute parts of one or more midsole elements. Such sole structures additionally may include an outsole component, e.g., as one or more outsole elements. The outsole component may partially cover the midsole element(s) and may include an opening through which at least some of the first plurality of rings are exposed and/or an opening through which at least some of the second plurality of rings are exposed. Alternatively, if desired, the outsole component may cover at least some (and optionally all) of the first plurality of rings and/or the second plurality of rings. When covered, at least some portion of the outsole component that covers the central area (e.g., the recessed central area) and/or the plurality of rings in the heel-supporting region and/or the forefoot-supporting region may be at least partially transparent or translucent (e.g., so that the central area (e.g., the recessed central area) and/or at least some of the plurality of rings are visible at the exterior surface of the sole structure).

While sole structures in accordance some with examples of this invention may be made in variety of different shapes and manners, in at least some examples of this invention, the central area (e.g., the recessed central area) of the heel-supporting region and at least some of the first plurality of rings may have a curved shape (e.g., non-linear and/or non-planar, and optionally a circular shape, an elliptical shape, an oval shape, an elongated shape, etc., around their perimeters or circumferences) and/or the central area (e.g., the recessed central area) of the forefoot-supporting region and at least some of the second plurality of rings may have a curved shape (e.g., non-linear and/or non-planar, and optionally a circular shape, an elliptical shape, an oval shape, an elongated shape, etc., around their perimeters or circumferences). Individual features (e.g., central recess and/or rings) of the forefoot-supporting region may have the same size, shape, spacing, orientation, and/or other features as corresponding individual features of the heel-supporting region (if any), or the corresponding individual features in these regions (if any) may differ in one or more of size, shape, spacing, orientation, and/or other features.

Additional foot-supporting structures may be provided in sole structures in accordance with at least some examples of this invention. As some more specific examples, the sole structure may include a midfoot-supporting region that includes a midfoot central area (e.g., a recessed midfoot central area) surrounded by a plurality of rings defined in the ground-facing surface (e.g., in a midsole component and/or in an outsole component), wherein this plurality of rings includes an innermost ring that surrounds (and may at least partially define) the midfoot central area (e.g., the recessed midfoot central area) and at least three additional rings of increasingly larger circumference surrounding this innermost ring. This midfoot-supporting region may be located closer to a lateral side edge of the sole structure than to a medial side edge of the sole structure (e.g., measured from a center of the midfoot central area). If desired, the central area (e.g., the recessed central area) of the heel-supporting region may be elongated (e.g., in a fore-to-aft direction), the central area (e.g., the recessed central area) of the forefoot-supporting region may be elongated (e.g., in a lateral side-to-medial side direction), and/or the midfoot central areas (e.g., the recessed midfoot central area) of the midfoot-supporting region may be elongated (e.g., in the fore-to-aft direction). As a further option, if desired, a plurality of additional rings may extend around a combined area of two or more of the forefoot-supporting region, the heel-supporting region, and the midfoot-supporting region.

Additionally or alternatively, sole structures in accordance with some examples of this invention may include a medial midfoot-supporting region including a medial midfoot central area (e.g., a recessed medial midfoot central area) surrounded by a plurality of rings defined in the ground-facing surface (e.g., in a midsole component and/or in an outsole component), wherein this plurality of rings includes an innermost ring that surrounds (and may at least partially define) the medial midfoot central area and at least two additional rings of increasingly larger circumference surrounding the innermost ring.

As still additional potential features, sole structures in accordance with at least some examples of this invention may include one or more forward toe-supporting regions, each of which may include a toe central area (e.g., a recessed toe central area) surrounded by (and optionally at least partially defined by) one or more toe rings defined in the ground-facing surface. Two, three, four, or even more forward toe-supporting regions may be provided in an individual sole structure, if desired (e.g., spaced apart in a medial side-to-lateral side direction along a forward toe area of the sole structure). When two or more forward toe-supporting regions are provided in a sole structure, if desired, a plurality of rings may extend around a combined area of any two or more of the forward toe-supporting regions. In fact, if desired, a plurality of rings may extend around combined areas of the two or more forward toe-supporting regions and one or more of the forefoot-supporting region, the midfoot-supporting regions (if any), and/or the heel-supporting region of the sole structure.

As further potential options, sole structures in accordance with at least some examples of this invention may include one or more lateral side-supporting regions, each of which may include a lateral-side central area (e.g., a recessed lateral-side central area) surrounded by (and optionally at least partially defined by) at least one lateral side ring defined in the ground-facing surface. Two, three, four, or even more lateral side-supporting regions may be provided in an individual sole structure, if desired (e.g., spaced apart in a fore-to-aft direction along a lateral midfoot and/or lateral forefoot side edge of the sole structure, optionally closer to a lateral side edge of the sole structure than is the forefoot-supporting region (as measured from a center of the central areas) and/or optionally located along or toward the lateral side of the forefoot-supporting region). When two or more lateral side-supporting regions are provided in a sole structure, if desired, a plurality of rings may extend around a combined area of the two or more lateral side-supporting regions. In fact, if desired, a plurality of rings may extend around combined areas of the two or more lateral side-supporting regions and one or more of the forefoot-supporting region, the midfoot-supporting region(s) (if any), the forward toe-supporting region(s) (if any), and/or the heel-supporting region of the sole structure.

As described above, in addition to the first plurality of rings around the heel-supporting region and the second plurality of rings around the forefoot-supporting region, additional rings may be present in (e.g., defined in) sole structures in accordance with aspects of this invention. Such rings may extend continuously around a combined area of the forefoot-supporting region and the heel-supporting region (and optionally around any of the other foot-supporting regions described above, when they are present). If desired, at least one ring of the additional plurality of rings may extend along one or more side surfaces of the sole structure (e.g., along at least a portion of a medial side surface of the sole structure, along at least a portion of a lateral side surface of the sole structure, along at least a portion of a rear or heel side surface of the sole structure, and/or along at least a portion of a forward toe front surface of the sole structure). Additionally or alternatively, one or more of the plurality of rings may extend along a perimeter edge of the sole structure (e.g., midsole component or outsole component) in which it/they are formed.

Another aspect of this invention relates to sole structures for articles of footwear that include a sole member having an upper-facing surface and a ground-facing surface opposite the upper-facing surface, wherein the ground-facing surface of the sole member includes:

- a heel-based impact-force attenuating structure including a first central area (e.g., a first recessed central area), a first band (e.g., or ring) of sole structure material surrounding the first central area, a second band (e.g., or ring) of sole structure material surrounding the first band, and a first recessed groove separating the first band and the second band (and defined in the sole structure material); and
- a forefoot-based impact-force attenuating structure including a second central area (e.g., a second recessed central area), a third band (e.g., or ring) of sole structure material surrounding the second central area, a fourth band (e.g., or ring) of sole structure material surrounding the third band, and a second recessed groove separating the third band and the fourth band (and defined in the sole structure material).

The sole member of this example sole structure may include the heel-based impact-force attenuating structure and/or the forefoot-based impact-force attenuating structure formed from a polymer foam material (e.g., as part of a midsole element, optionally both formed in a single midsole component and/or in a single piece of sole structure material). Alternatively, if desired, one or both of these impact-force attenuating structure may be formed in one or more outsole elements. Either or both of these impact-force attenuating structures may be completely formed in a single piece of material, if desired.

As another option or alternative, if desired, the sole member (in which one or both of the heel-based impact-force attenuating structure and/or the forefoot-based impact-force attenuating structure are formed) may constitute a midsole element (e.g., formed of a polymeric foam material) that is at least partially covered (e.g., at least at its bottom surface) with an outsole component formed from one or more outsole elements. The outsole component: (a) may cover (and conceal) one or both of the heel-based impact-force attenuating structure and/or the forefoot-based impact-force attenuating structure, (b) may include one or more openings through which one or both of the heel-based impact-force attenuating structure and/or the forefoot-based impact-force attenuating structure are exposed at a bottom surface of the sole structure, and/or (c) may cover one or both of the heel-based impact-force attenuating structure and/or the forefoot-based impact-force attenuating structure using an at least partially transparent or at least partially translucent window area (and thus leave at least some portion of these impact-force attenuating structures at least partially visible but not directly exposed at a bottom surface of the sole structure). The exterior surface(s) of any window regions also may include central areas and/or one or more surrounding rings, e.g., of the various types described above, if desired.

As noted above, in accordance with this aspect of the invention, the sole structure includes a first central area (e.g., a first recessed central area), a first band, a second band, a first recessed groove, a second central area (e.g., a second recessed central area), a third band, a fourth band, and a second recessed groove. While various constructions are possible, if desired, one or more of the first band, the second band, the third band, and/or the fourth band each may include at least two rings separated by a depression defined in an outer surface of the respective band. When they are present, the depressions defining the rings in the first band and/or the second band may have a depth of 20% or less of a depth of the first recessed groove and/or the depressions defining the rings in the third band and/or the fourth band may have a depth of 20% or less of a depth of the second recessed groove. Additionally or alternatively, if desired, an outer edge of the second band may be defined by a third recessed groove and/or an outer edge of the fourth band may be defined by a fourth recessed groove. Likewise, when they are present, the depressions defining the rings in the first band and/or the second band may have a depth of 20% or less (or even 10% or less) of a depth of the third recessed groove and/or the depressions defining the rings in the third band and/or the fourth band may have a depth of 20% or less (or even 10% or less) of a depth of the fourth recessed groove. In other words, the recessed grooves separating two bands and/or defining an edge of a band may be substantially deeper (e.g., at least 5 times deeper, and in some examples, at least 10 times deeper) than depressions in the band surface forming and/or defining the rings on the band surface.

As some other potential features in accordance with some aspects of this invention, if desired, when the first central area is a first recessed central area: (a) a deepest depth of the first recessed central area may be deeper than a deepest depth of the first recessed groove; and (b) the deepest depth of the first recessed groove may be deeper than a deepest depth of the third recessed groove (when present). Additionally or alternatively, when the second central area is a second recessed central area: (a) a deepest depth of the second recessed central area may be deeper than a deepest depth of the second recessed groove; and (b) the deepest depth of the second recessed groove may be deeper than a deepest depth of the fourth recessed groove (when present). As still other potential or alternative features, any one or more of the first recessed central area, the second recessed central area, the first band, the second band, the third band, the fourth band, the first recessed groove, the second recessed groove, the third recessed groove (when present), and the fourth recessed groove (when present) may have a curved shape (e.g., non-linear and/or non-planar, and optionally a circular shape, an elliptical shape, an oval shape, an elongated shape, etc.). All "depths" and/or "deepest depths" may be measured from a common base surface, such as a horizontal surface on which the sole structure is placed in an unloaded condition.

Sole structures in accordance with this aspect of the invention (with the central areas (e.g., recessed central areas), bands, and recessed grooves) further may include any one or more of the midfoot-supporting regions, medial side midfoot-supporting regions, forward toe-supporting regions, and/or lateral side-supporting regions of the types described above. Additionally or alternatively, if desired, sole structures in accordance with this aspect of the invention may further include any one or more of the ring sets and/or ring features described above (e.g., rings surrounding various combined areas in the sole structures, extending to side walls, etc.).

Sole structures for articles of footwear in accordance with at least some still further aspects of this invention include: (a) a first midsole component formed at least in part from a first polymeric foam material, wherein the first midsole component forms at least a majority of a plantar support surface and/or at least a majority of a medial sidewall surface of the sole structure, and wherein the first midsole component includes a lateral side edge; and (b) a second midsole component formed at least in part from a second polymeric foam material, wherein the second midsole component forms at least a majority of a lateral sidewall surface of the sole structure, wherein the second midsole component includes a medial side edge that extends adjacent the lateral side edge of the first midsole component, and wherein the second polymeric foam material has a higher durometer hardness than the first polymeric foam material. Optionally, the medial sidewall surface formed by the first midsole component may include a first plurality of bellow structures and/or ring structures and/or the lateral sidewall surface formed by the second midsole component may include a second plurality of bellow structures and/or ring structures. The sole structure may constitute a midsole component that optionally may include one or more outsole elements engaged with it.

The first midsole component may extend continuously from a heel area (e.g., rear heel area) to a forefoot area (e.g., toe area) of the sole structure and/or the second midsole component may extend continuously from the heel area (e.g., rear heel area) to the forefoot area (e.g., toe area) of the sole structure. For example, if desired, a rear junction area between the first midsole component and the second midsole component may be located at a rear-most heel area and/or may define a rear-most point RH of the sole structure and/or a forward junction area of the first midsole component and the second midsole component may be located at a forward toe area of the sole structure. In this manner, the first midsole component may form at least a portion of a rear heel medial sidewall of the sole structure and the second midsole component may form at least a portion of a rear heel lateral sidewall of the sole structure.

In at least some sole structures in accordance with this aspect of the invention, at least the first midsole component (and optionally the second midsole component as well) may form a portion of a bottom surface of the midsole component. In some specific example structures, the first midsole component may form at least 70% of an overall volume of the midsole component (and in some examples, at least 75% or even at least 80% of the overall volume) and the second midsole component may form 30% or less of the overall volume of the midsole component (and in some examples, 25% or less or even 20% or less of the overall volume). As yet additional or alternative potential features, the first midsole component may form at least 75% of a plantar support surface area of the sole structure (and in some examples, at least 80% or even at least 85% of the plantar support surface area) and the second midsole component may form 25% or less of the plantar support surface area of the sole structure (and in some examples, 20% or less or even 15% or less of the plantar support surface area).

Figure 6:
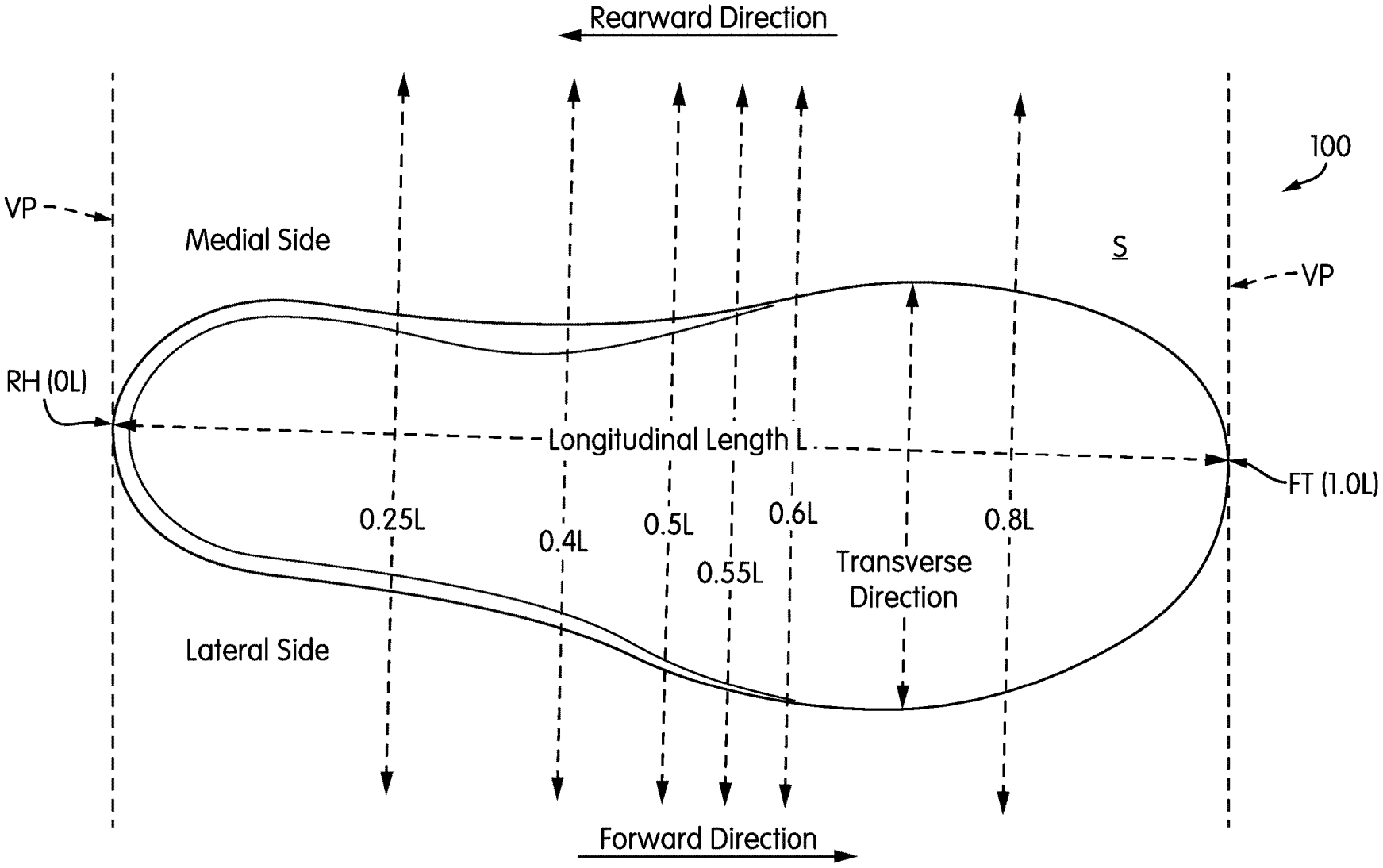
FIG. 6 is provided to help illustrate and explain background and definitional information useful for understanding certain terminology and aspects of this invention.

Sole structures in accordance with at least some aspects of this invention may have substantial height located somewhat forward in the overall sole structure. As some more specific examples, if the sole structure is considered to define a rear-most heel location, a forward-most toe location, and a longitudinal length from the rear-most heel location to the forward-most toe location (e.g., as described above in conjunction with FIG. 6), a highest point of the medial sidewall surface formed by the first midsole component and/or a highest point of the lateral sidewall surface formed by the second midsole component may be located forward of a plane perpendicular to the longitudinal length of the sole structure and oriented to intersect the longitudinal length at least 20% of the longitudinal length forward from the rear-most heel location (e.g., forward of a perpendicular plane at 0.2 L). Additionally or alternatively, the highest point of the medial sidewall surface formed by the first midsole component and/or the highest point of the lateral sidewall surface formed by the second midsole component may be located rearward of a plane perpendicular to the longitudinal length of the sole structure and oriented to intersect the longitudinal length at least 40% of the longitudinal length forward from the rear-most heel location (e.g., rearward of a perpendicular plane at 0.4 L). In other words, the highest point of the medial sidewall surface and/or the highest point of the lateral sidewall surface may be located between planes perpendicular to the longitudinal direction of the sole structure and oriented at 0.2 L and 0.4 L as described above with reference to FIG. 6 (and in some examples, between perpendicular planes located at 0.25 L and 0.35 L).

Other potential characteristics of the "highest point" dimensions may be as follows. In at least some examples of this invention, with the sole structure standing on a horizontal base surface in an unloaded condition, the first midsole component will define: (a) a rear heel height dimension from the horizontal base surface and (b) a highest sidewall height dimension of the medial sidewall surface from the horizontal base surface. In this orientation, in at least some examples of this invention, the highest sidewall height dimension of the medial sidewall surface may be at least 1.25 times the rear heel height dimension (and in some examples, at least 1.4 times or even 1.6 times the rear heel height dimension). Additionally or alternatively, if desired, this highest sidewall height dimension of the medial sidewall surface will be at least 0.5 inch greater than the rear heel height dimension (and in some examples, at least 0.75 inch, at least 1 inch, or even at least 1.25 inch higher).

Similarly, in at least some examples of this invention, with the sole structure standing on a horizontal base surface in an unloaded condition, the second midsole component will define: (a) a rear heel height dimension from the horizontal base surface and (b) a highest sidewall height dimension of the lateral sidewall surface from the horizontal base surface. In this orientation, in at least some examples of this invention, the highest sidewall height dimension of the lateral sidewall surface may be at least 1.25 times the rear heel height dimension (and in some examples, at least 1.4 times or even 1.6 times the rear heel height dimension). Additionally or alternatively, if desired, this highest sidewall height dimension of the lateral sidewall surface will be at least 0.5 inch greater than the rear heel height dimension (and in some examples, at least 0.75 inch, at least 1 inch, or even at least 1.25 inch higher).

As yet some additional or alternative potential dimensional features, with the sole structure oriented on a horizontal base surface in an unloaded condition, the sole structure will define: (1) a first width dimension between: (a) a highest point of the medial sidewall surface formed by the first midsole component and (b) a highest point of the lateral sidewall surface formed by the second midsole component, and (2) a second width dimension corresponding to a maximum width dimension between (a) an outer surface of the medial sidewall and (b) an outer surface of the lateral sidewall in a vertical plane that passes through the highest point of the medial sidewall surface and the highest point of the lateral sidewall surface. In this orientation, the first width dimension may be less than 85% of the second width dimension (and in some examples, less than 80% or even less than 75% of the second width dimension).

As noted above, sole structures in accordance with this aspect of the invention may include an outsole component. This outsole component may have a top surface engaged with a bottom surface of the first midsole component and/or with a bottom surface of the second midsole component. This top surface of the outsole component may completely cover at least 85% of combined areas of the bottom surfaces of the first midsole component and the second midsole component (and in some examples, at least 90% or even at least 95% of this combined bottom surface area). The outsole component further may include a forward toe portion that extends upward and covers a forward-most toe edge of the first midsole component and/or a forward-most toe edge of the second midsole component.

Additionally or alternatively, the outsole component may include at least a first opening defined through it, and at least a portion of the bottom surface of the first midsole component may be exposed through the first opening but the bottom surface of the second midsole component is not exposed through the first opening. Similarly, the outsole component may include a second opening defined through it, and at least a portion of the bottom surface of the first midsole component may be exposed through this second opening, but the bottom surface of the second midsole component is not exposed through the second opening. As another option, rather than openings, the outsole component may include one or more window regions (e.g., at least partially transparent or translucent window regions), and the bottom surface of the first midsole component may be visible through the one or more window regions but the bottom surface of the second midsole component need not be visible through any of the window regions.

Sole structures in accordance with this aspect of the invention also may include any one or more of the midfoot-supporting regions, medial side midfoot-supporting regions, forward toe-supporting regions, and/or lateral side-supporting regions of the types described above. Additionally or alternatively, if desired, sole structures in accordance with this aspect of the invention may further include any one or more of the ring sets and/or ring features described above. Additionally or alternatively, the more specific features of this aspect of the invention may be included in sole structures in accordance with the other aspects of this invention as described above (e.g., rings surrounding various combined areas in the sole structure, extending to side walls, etc.).

This specification describes that various components or features of a sole structure may "surround" another feature (e.g., rings or bands may "surround" central areas (e.g., recessed central areas), other bands, other rings, etc.). The term "surround," as used herein, does not require that the "surrounding component" have a perimeter or circumference that extends around 100% of the "surrounded component." Rather, if desired, a "surrounding component" may have one or more breaks or interruptions in its overall structure while still providing a structure that may be seen as "surrounding" the "surrounded component." More specifically, a component "surrounds" another component if (a) the surrounding component (e.g., the band or ring) includes actual physical structure extending around at least 80% of its perimeter and (b) the "surrounded component" lies completely within an area defined by the surrounding component, wherein the area defined by the surrounding component includes the area defined within the actual physical structure of the perimeter of the surrounding component and straight line segments that join adjacent ends of any breaks in the actual physical structure of the perimeter of the surrounding component.

B. Uppers, Articles of Footwear, and Other Features

Additional aspects of this invention relate to articles of footwear that include any of the various sole structures and/or any one or more of the various features of the sole structures described above. The sole structure may be engaged with an upper for an article of footwear. The upper may have any desired construction, including conventional footwear upper constructions as are known and used in the art.

As other examples, however, uppers included in footwear structures in accordance with at least some examples of this invention may include a rear heel portion having: (a) a first band of elastic or stretchable material, (b) a second band of elastic or stretchable material vertically displaced from the first band, and (c) a first band of exposed mesh material extending between the first and second bands of elastic or stretchable material. If desired, a second band of exposed mesh material may extend downward from the second band of elastic or stretchable material. The mesh material(s) may be less elastic or stretchable than the materials of the bands of elastic or stretchable materials. This construction, particularly when used in conjunction with a "tongueless" instep construction, helps provide sufficient stretchability to enable easy foot insertion and removal.

Additionally or alternatively, if desired, the instep area of the upper may include a continuous structure (without a conventional footwear "tongue" member) that includes a similar construction, namely: (a) a first band of elastic or stretchable material, (b) a second band of elastic or stretchable material displaced forward from the first band, and (c) a first band of exposed mesh material extending between the first band of elastic or stretchable material and the second band of elastic or stretchable material. In fact, if desired, the instep area may include a plurality of bands of elastic or stretchable material, wherein adjacent band pairs of the plurality of bands are separated by a band of exposed mesh material. As some more specific examples, the plurality of bands of elastic or stretchable material may include at least four bands that extend across the instep area, and in some examples, at least six bands or even at least eight bands. This construction helps provide sufficient stretchability to enable easy foot insertion and removal while still providing a secure fit.

Articles of footwear in accordance with at least some examples of this invention may include a heel support engaged with a rear heel portion of the upper and at a rear heel area of the sole structure (as well as along the lateral heel side and the medial heel side of the footwear structure). At the rear heel area and along the lateral and medial heel sides, the heel support may extend above an upper perimeter of the sole structure. The heel support may include a rearward extending projection in the rear heel portion. If desired, the heel support may include a top edge and a bottom edge (e.g., an exposed bottom edge portion), and a plurality of vertically spaced slits may extend through the heel support between the top edge and the bottom edge (and optionally through the rearward extending protrusion). The vertically spaced slits may define at least three vertically spaced bands of heel support material, and in some examples, at least six or even at least eight vertically spaced bands of heel support material. The slits help provide more flexibility and breathability in the heel area while still overall providing support for the heel.

C. Detailed Description of Specific Examples of this Invention

Figure 1B:
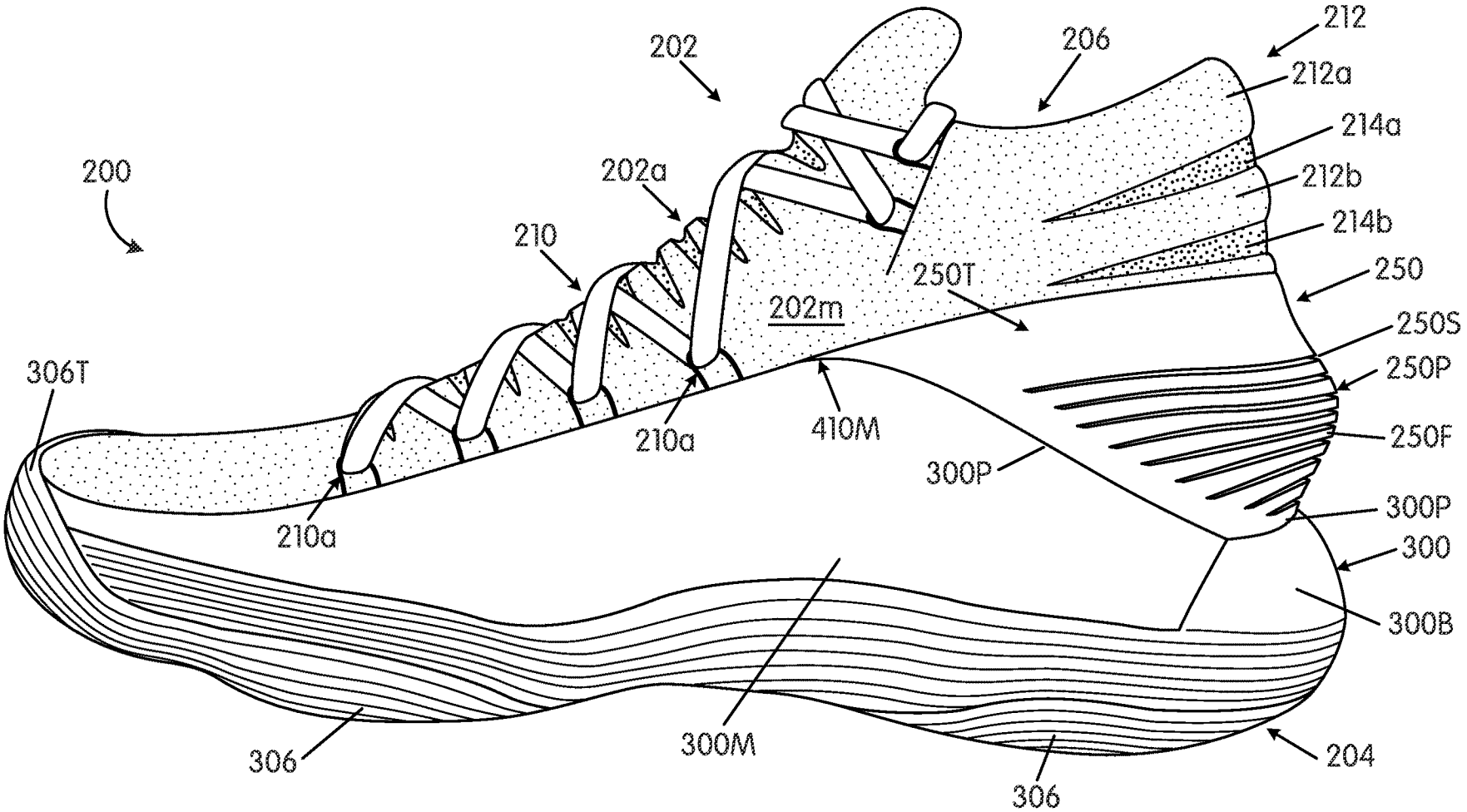
Figure 1C:
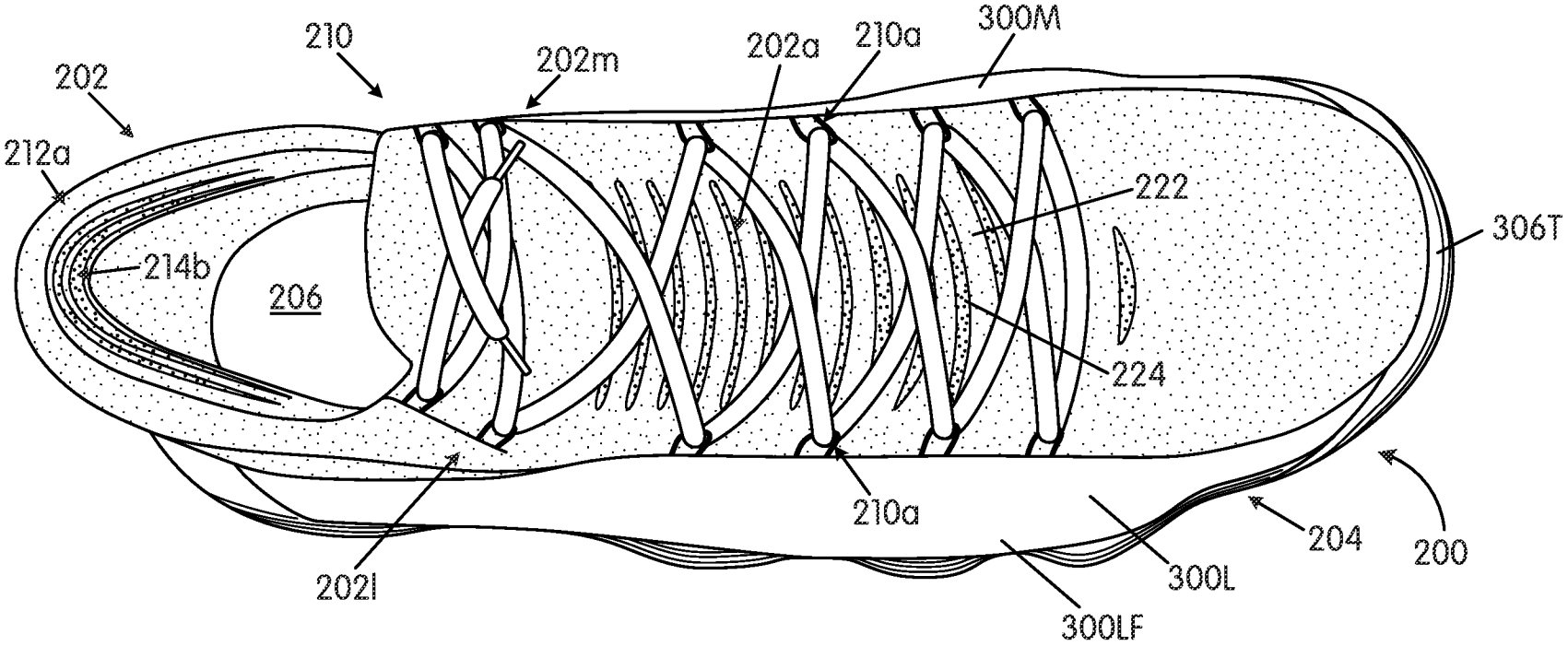
Figure 1D:
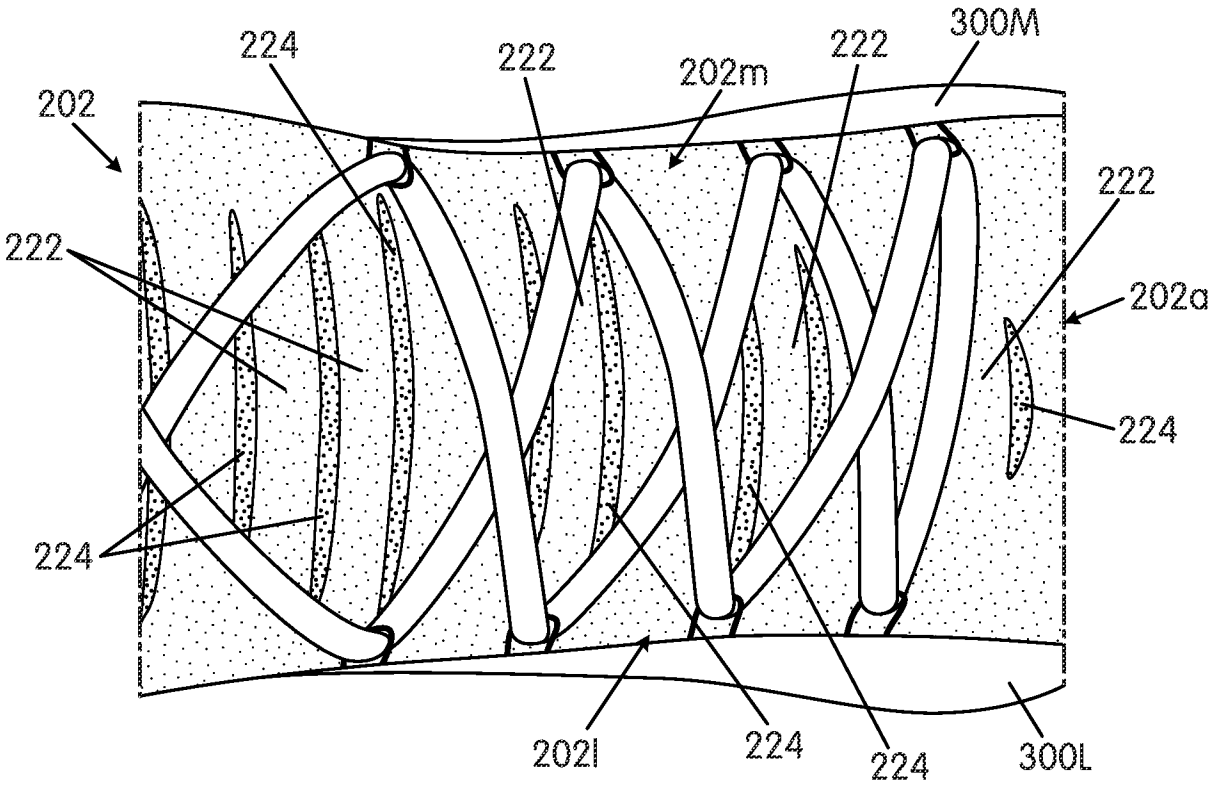

FIGS. 1A-1D provide various views of an article of footwear 200 in accordance with at least some examples of this invention. More specifically, FIG. 1A provides a lateral side view of this example article of footwear 200, FIG. 1B provides a medial side view, FIG. 1C provides a top view, and FIG. 1D provides a close up view of the instep area. This example article of footwear 200 is a hightop basketball shoe. Aspects of this invention, however, also may be used in shoes for other types of uses and/or other athletic activities. The article of footwear 200 includes an upper 202 and a sole structure 204 engaged with the upper 202. The upper 202 and sole structure 204 may be engaged together in any desired manner, including in manners conventionally known and used in the footwear arts (such as by adhesives or cements, by stitching or sewing, by mechanical connectors, etc.).

The upper 202 of this example includes a foot-receiving opening 206 that provides access to an interior chamber into which the wearer's foot is inserted. The upper 202 further may include a tongue member located across the foot instep area (or other structure, as will be described in more detail below) and positioned so as to moderate the feel of the closure system 210 on the wearer's foot (the closure system 210 in this illustrated example constitutes a lace type closure system). As shown in the specific example of FIGS. 1A-1D, however, rather than including a separate tongue component, this example upper 202 is formed as a unitary construction with an instep covering component 202*a* integrally formed with and joining the medial side area 202*m* and the lateral side area 202*l* of the upper 202. In this manner, as shown in the figures, the upper 202 has somewhat of a sock-like foot-receiving opening 206 and/or a sock-like overall appearance.

The upper 202 may be made from any desired materials and/or in any desired constructions and/or manners without departing from this invention. As some more specific examples, at least a portion of the upper 202 (and optionally a majority, substantially all, or even all of the upper 202) may be formed as a woven textile component and/or as a knitted textile component. The textile components for upper 202 may have structures and/or constructions like those used in FLYKNIT® brand footwear and/or via FLYWEAVE™ technology available in products from NIKE, Inc. of Beaverton, Oreg.

Additionally or alternatively, if desired, the upper 202 construction may include uppers having foot securing and engaging structures (e.g., "dynamic" and/or "adaptive fit" structures), e.g., of the types described in U.S. Patent Appln. Publn. No. 2013/0104423, which publication is entirely incorporated herein by reference. As some additional examples, if desired, uppers and articles of footwear in accordance with this invention may include foot securing and engaging structures of the types used in FLYWIRE® Brand footwear available from NIKE, Inc. of Beaverton, Oreg. These types of wrap-around and/or adaptive or dynamic fit structures are shown as part of the lace engaging elements 210*a* in example upper 202 of FIGS. 1A-1D. The lace engaging elements 210*a* may form portions of relatively unstretchable components engaged with or integrally formed in the upper structure 202, e.g., that at least partially wrap around and securely hold the wearer's foot.

As yet another option or alternative, if desired, uppers 202 and articles of footwear 200 in accordance with at least some examples of this invention may include fused layers of upper materials, e.g., uppers of the types included in NIKE's "FUSE" line of footwear products and/or upper materials bonded by hot melt or other adhesive materials. As still additional examples, uppers of the types described in U.S. Pat. Nos. 7,347,011 and/or 8,429,835 may be used without departing from this invention (each of U.S. Pat. Nos. 7,347,011 and 8,429,835 is entirely incorporated herein by reference).

In the specific example upper 202 shown in FIGS. 1A-1D, a rear heel portion 212 of the upper 202 includes various stretch enabling features including: (a) a first band of elastic or stretchable material 212*a* (e.g., 0.25 to 1.25 inch wide), (b) a second band of elastic or stretchable material 212*b* (e.g., 0.25 to 1.25 inch wide) vertically displaced from the first band 212*a*, (c) a first band of exposed mesh material 214*a* (e.g., 0.125 to 1 inch wide) extending between the first band of elastic or stretchable material 212*a* and the second band of elastic or stretchable material 212*b*, and (d) a second band of exposed mesh material 214*b* (e.g., 0.125 to 1 inch wide) extending downward from the second band of elastic or stretchable material 212*b*. The upper-most band of elastic or stretchable material (element 212*a* in this illustrated example) forms and defines the top of the foot-receiving opening 206 for the article of footwear 200 (and may include comfort-enhancing soft material). In this rear heel portion 212 structure, the bands 214*a* and/or 214*b* of exposed mesh material are less elastic or stretchable than the bands 212*a* and/or 212*b* of elastic or stretchable material (e.g., which may be made from an elastic containing material). As another option, however, the stretchability of the materials could be reversed (e.g., and bands 214*a* and/or 214*b* could be made of relatively elastic or stretchable materials and bands 212*a* and/or 212*b* could be made of less elastic or stretchable materials). Other types of materials and/or material structures also could be used without departing from the invention. The elastic or stretchable materials 212*a* and/or 212*b* provide sufficient flexibility to help enable insertion and removal of a wearer's foot while the overall structure still provides a stable, secure, and breathable fit (e.g., from the mesh structure and/or from return of the elastic/stretchable materials to/toward their initial/unstretched side and/or shape). The bands 212*a*, 212*b*, 214*a*, and/or 214*b* may be engaged together, e.g., by stitching or sewing, by adhesives or cements, etc.

Some articles of footwear in accordance with examples of this invention (including this specifically illustrated example 200) may include a similar arrangement of a plurality of elastic or stretchable bands 222 separated by a plurality of less elastic or stretchable (e.g., mesh) bands 224 in the instep area 202*a* (e.g., substituting for a more conventional footwear "tongue" in this footwear structure 200). Notably, as shown in FIGS. 1C and 1D, the instep area 202*a* includes a plurality of bands of elastic or stretchable material 222, and adjacent/neighboring band pairs of the plurality of bands of elastic or stretchable material 222 are separated by a band of exposed mesh material 224. In this manner, the bands 222 and 224 are arranged generally in parallel and in an alternating manner across the instep area 202*a* and extend from the medial side area 202*m* to the lateral side area 202*l* of the footwear 200. In this instep area 202*a* structure, the bands 224 of exposed mesh material are less elastic or stretchable than the bands 222 of elastic or stretchable material (e.g., made from an elastic containing material). As another option, however, the stretchability of the materials could be reversed (e.g., and bands 224 could be made of relatively elastic or stretchable materials and bands 222 could be made of less elastic or stretchable materials). Other types of materials and/or material structures also could be used without departing from the invention. The elastic or stretchable materials 222 provide sufficient flexibility to help enable insertion and removal of a wearer's foot while the overall structure still provides a stable, secure, and breathable fit (e.g., from the mesh structure and/or from return of the elastic/stretchable materials to/toward their initial/unstretched side and/or shape).

Any number of bands of relatively elastic or stretchable material 212/222 and/or less elastic or stretchable material 214/224 may be provided in the rear heel area 212 and/or instep area 202*a* without departing from the invention. In this illustrated example, the rear heel area 212 includes two bands of each, although as additional examples, from 2-6 bands of each could be provided, if desired. Also, in this illustrated example, the instep area 202*a* includes 12 bands of each, although as additional examples, from 3-18 bands, 4-16 bands, 6-15 bands, or 8-12 bands of each could be used, if desired.

FIGS. 1A, 1B, 2B-2F, 2M, 2R, and 2S illustrate a heel support 250 that may be included with footwear uppers 202 and/or sole structures 204 in accordance with at least some examples of this invention (e.g., engaged with the rear heel portion 212 of the upper 202 and/or with one or more sole structure components (e.g., midsole components), as will be described in more detail below). The heel support 250 may take on the structure and/or function of a conventional heel counter type structure, including heel counter structures as are generally known and used in the footwear art.

This specifically illustrated heel support 250, however, does not have a conventional heel counter structure and will be described in more detail below. As shown in the above-noted figures, the heel support 250 of this example extends above an upper perimeter 300P of the footwear midsole component 300 (e.g., above upper perimeters 300P of a lateral side midsole component 300L, a medial side midsole component 300M, and a base midsole component 300B in the example midsole structure 300 shown in FIGS. 1A-1D and above upper perimeters 400P of a lateral side midsole component 400L and a medial side midsole component 400M in the example midsole structure 400 shown in FIGS. 2A-2V). As further shown in the noted figures, the heel support 250 includes an exposed top edge 250T and an exposed bottom edge 250B (when the sole structure 204 is oriented on a horizontal base surface as shown), and a plurality of vertically spaced slits 250S extending through the heel support 250 between the top edge 250T and the bottom edge 250B. These slits 250S define a plurality of flaps 250F (or bands) of the heel support 250 material (e.g., rubber, thermoplastic polyurethane, polymeric foam, or other polymeric material) between adjacent slits 250S. This slitted structure helps improve/control the flexibility of the heel region while still providing support and improved breathability. As shown in FIGS. 1A, 1B, 2C, and 2D, the slits 250S do not extend to the forward edges of the heel support 250 to thereby allow the heel support 250 to be produced as a unitary, one-piece construction with a plurality of flexible flaps 250F around the rear heel area 212.

Figure 2A:
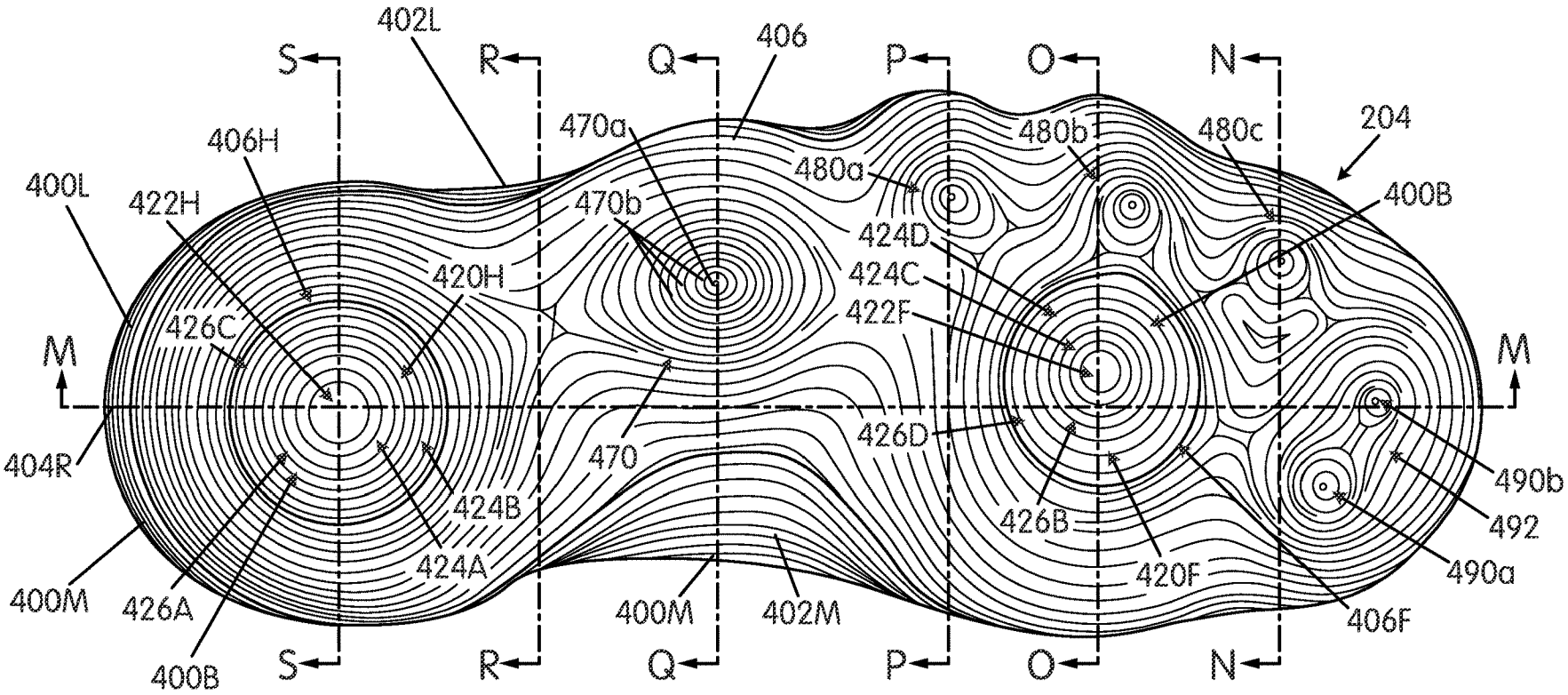
FIGS. 2A-2V provide various views of a sole structure for an article of footwear in accordance with some examples and aspects of this invention.
Figure 2B:
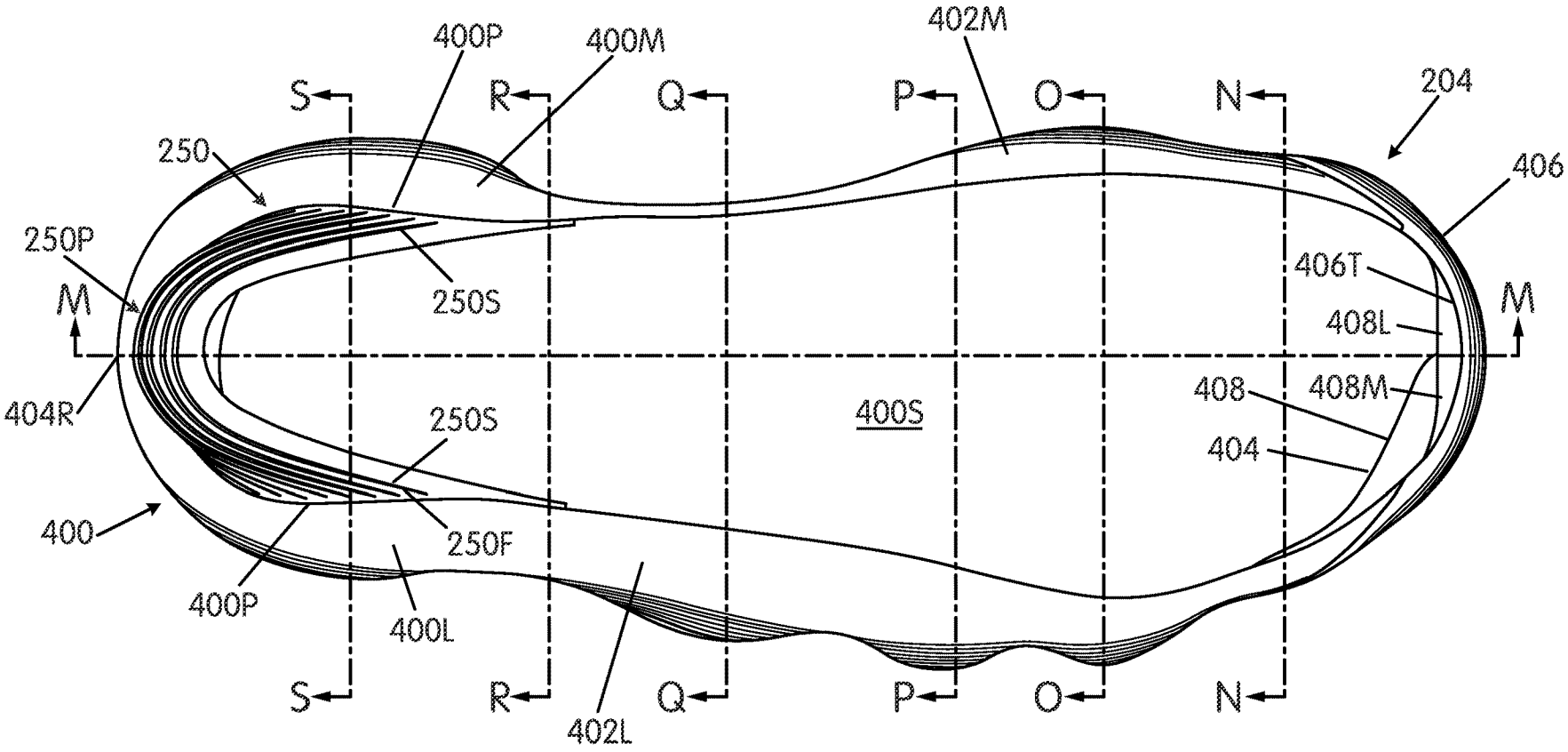
Figure 2C:
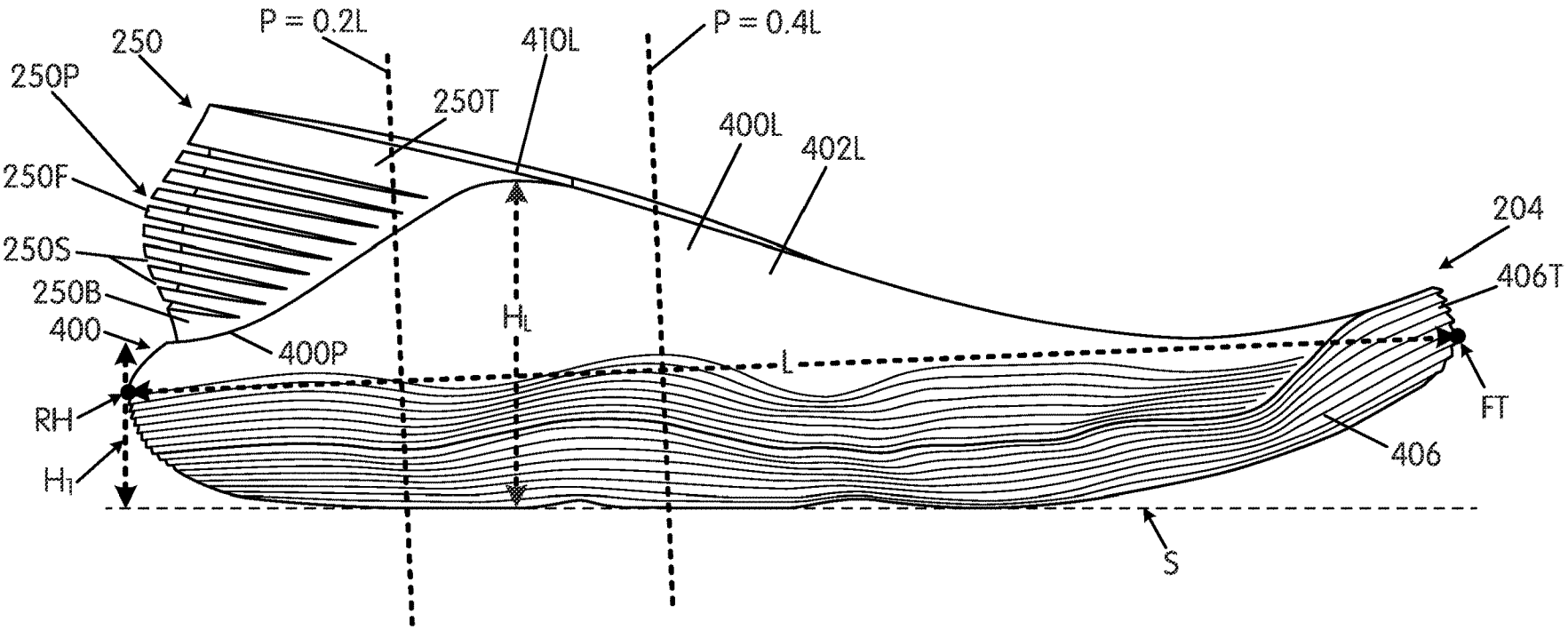
Figure 2D:
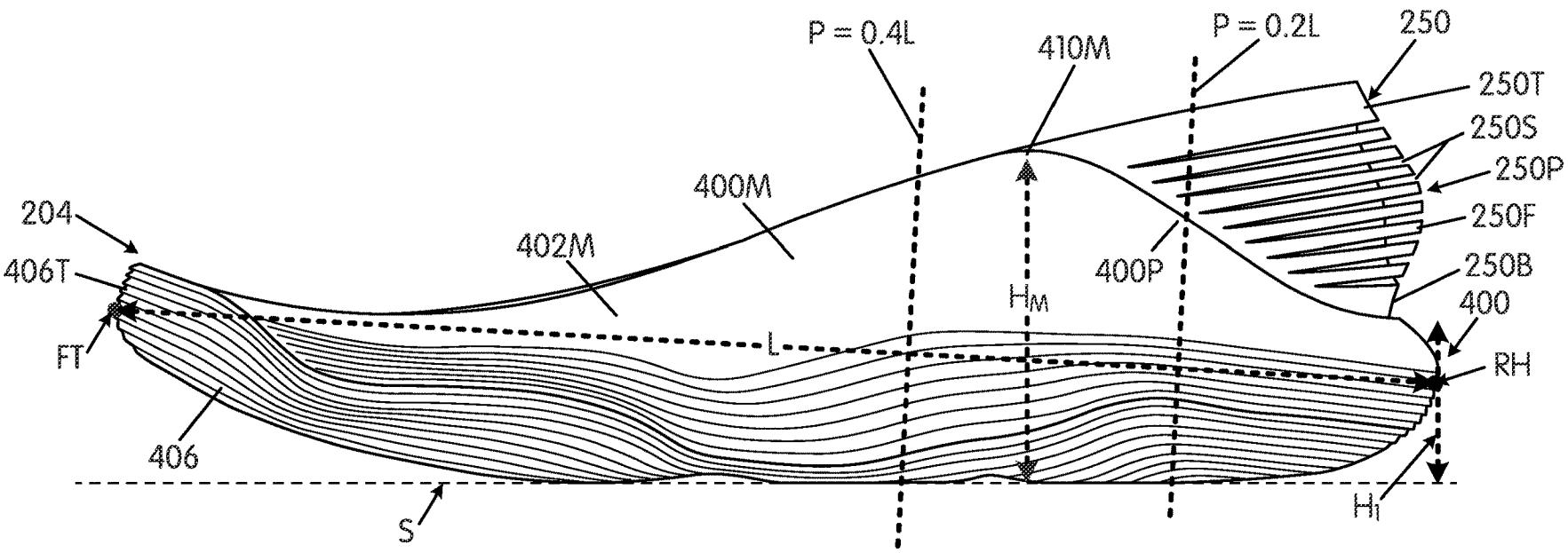
Figure 2F:
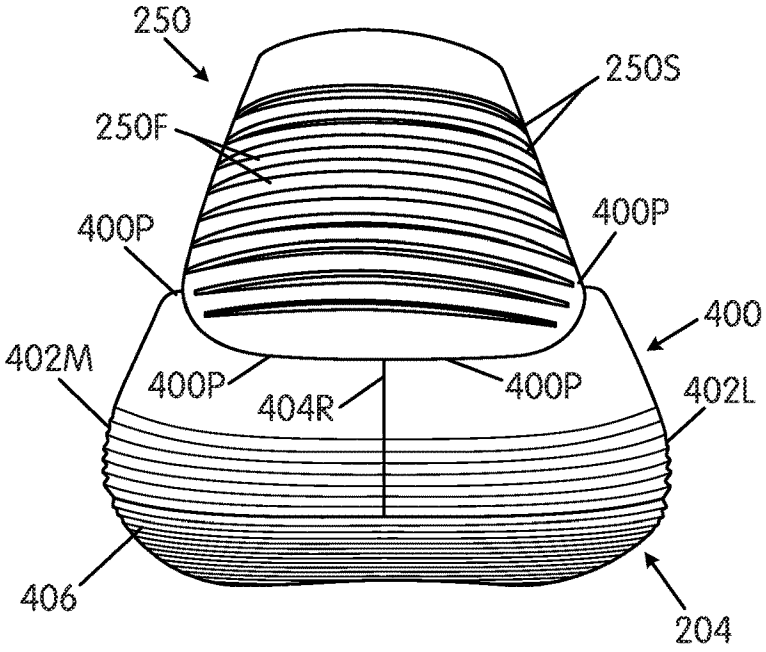
Figure 2E:
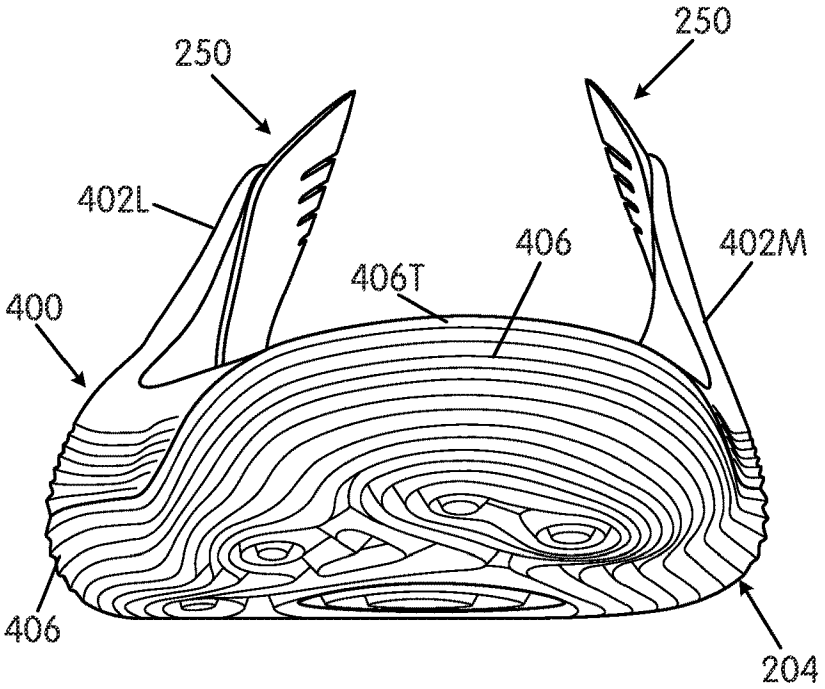
Figure 2G:
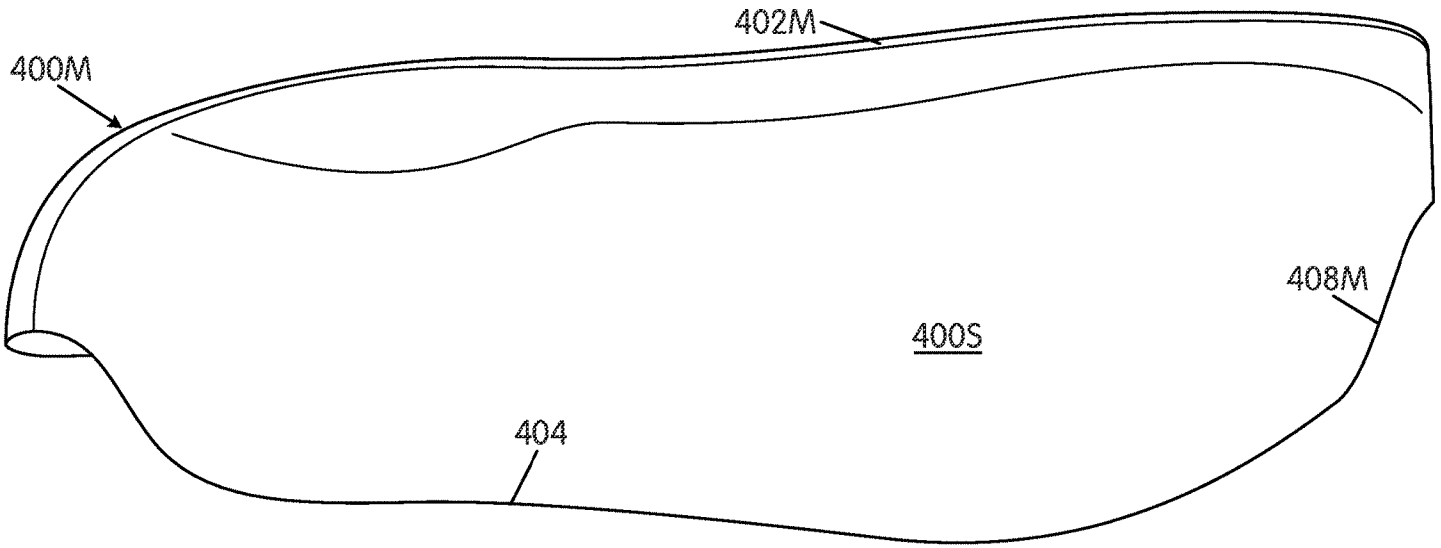
Figure 2H:
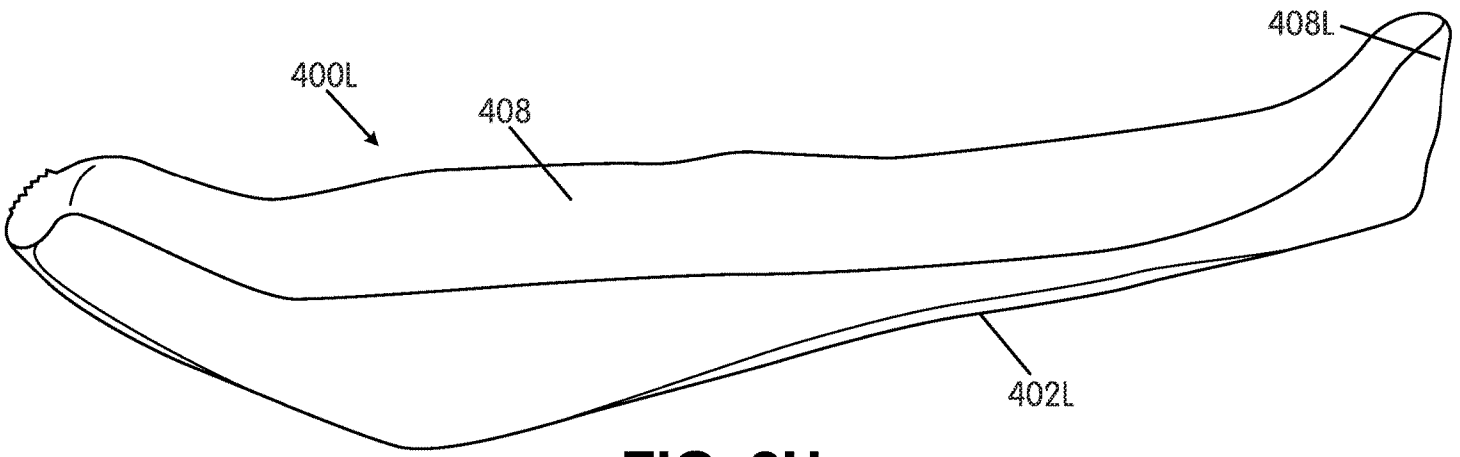
Figure 2I:
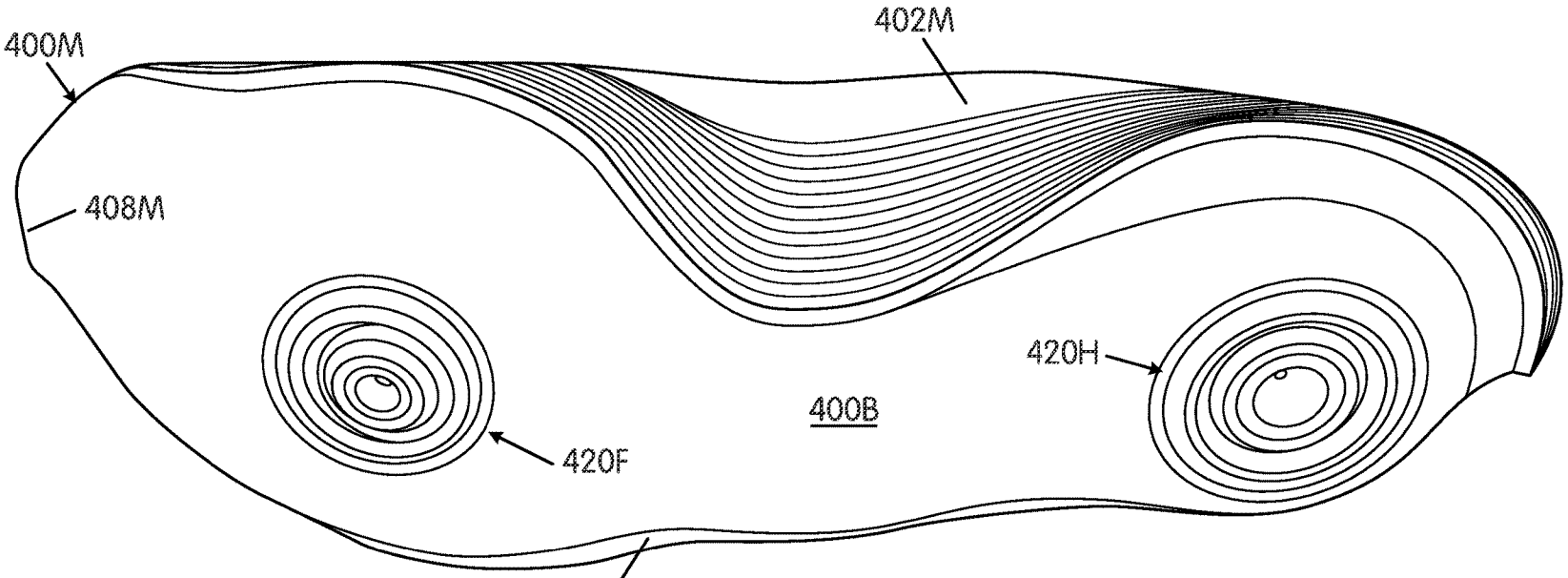
Figure 2J:
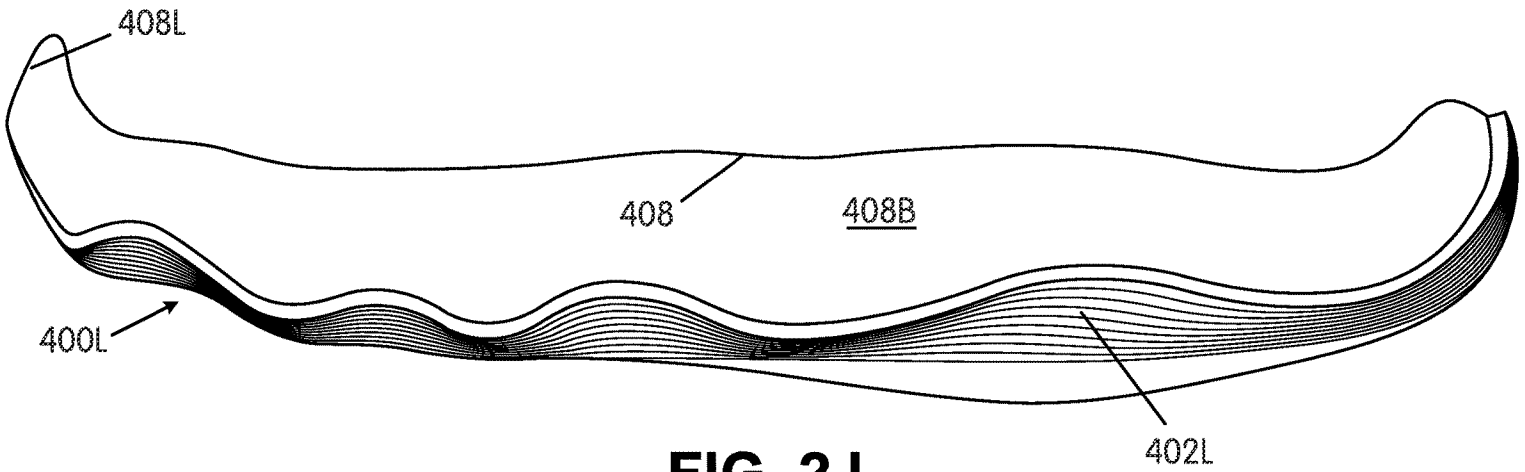
Figure 2K:
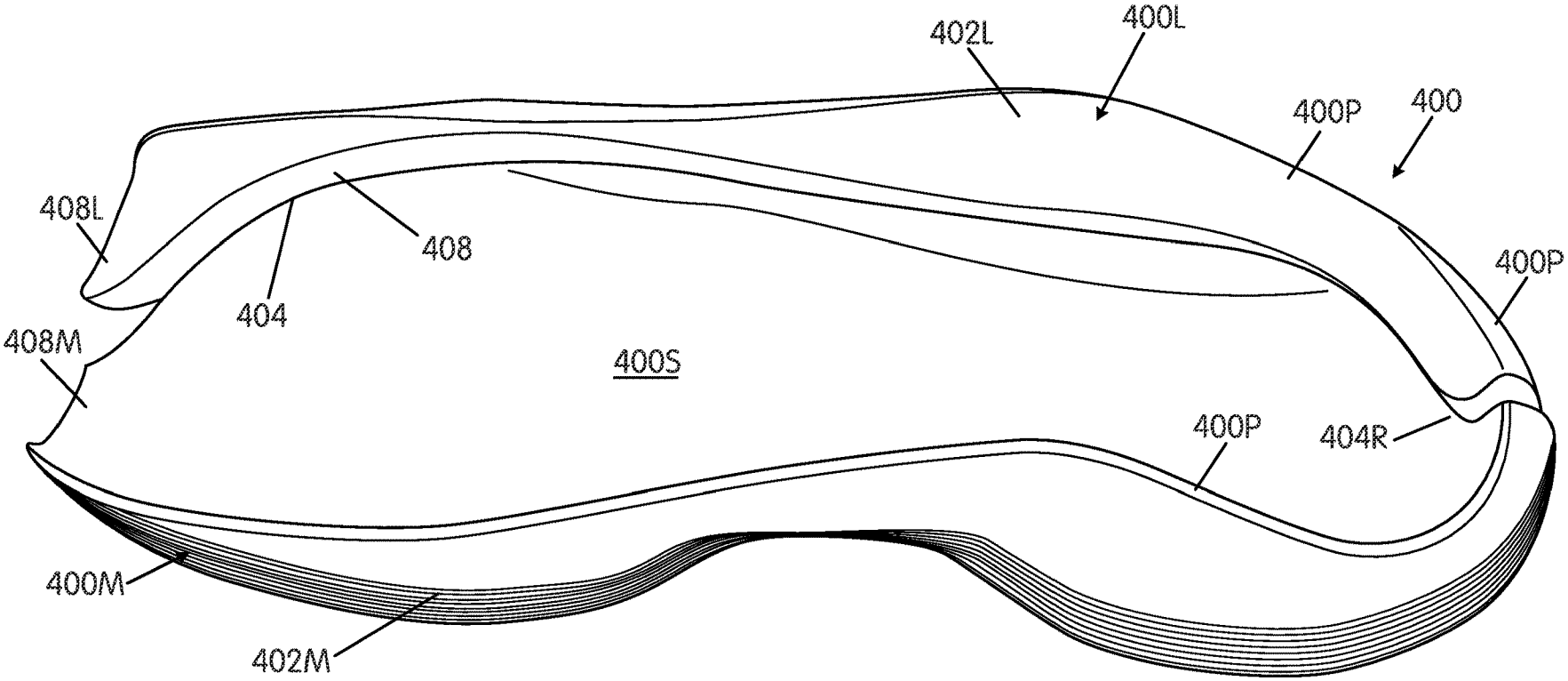
Figure 2L:
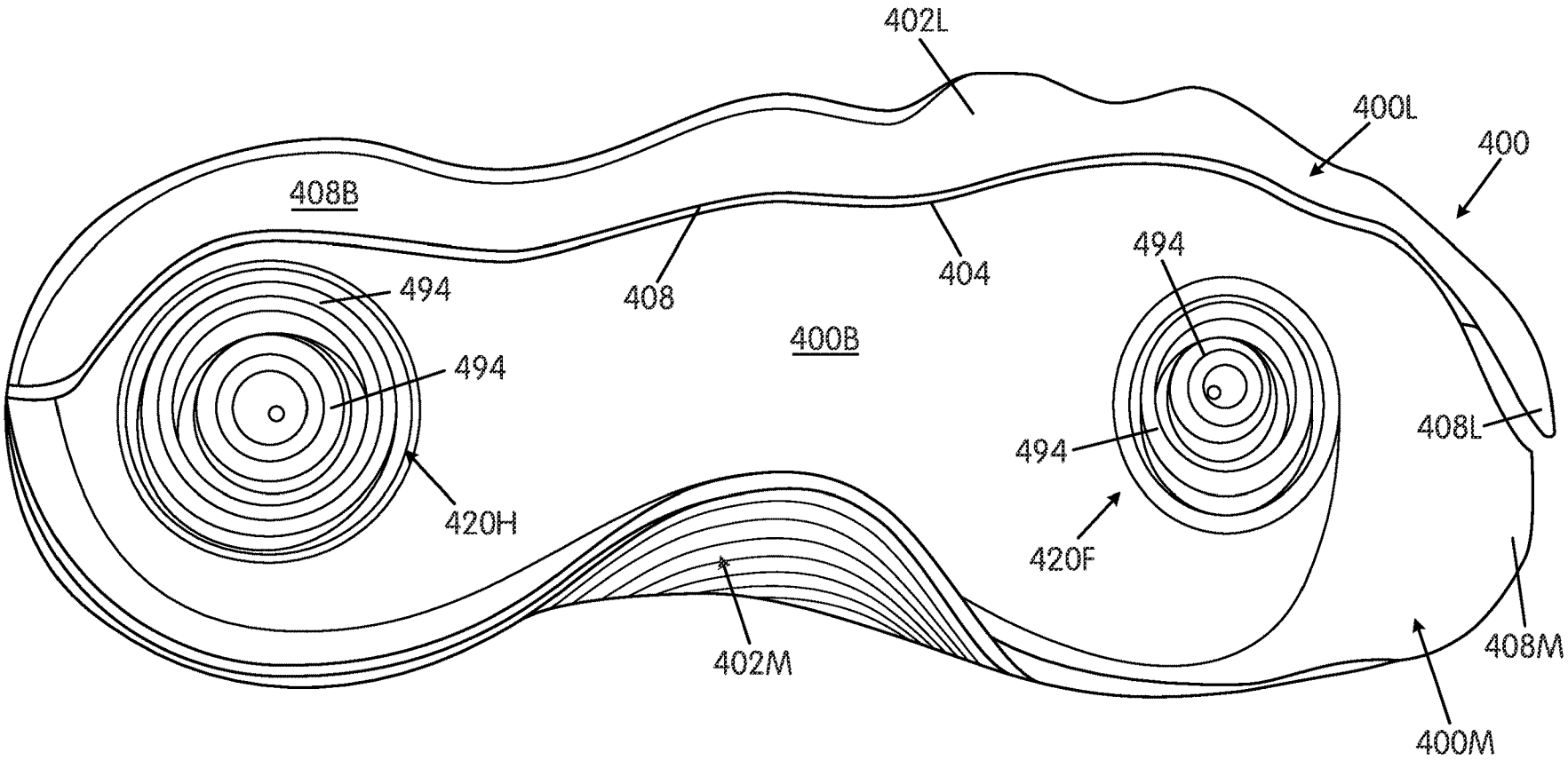
Figure 2M:
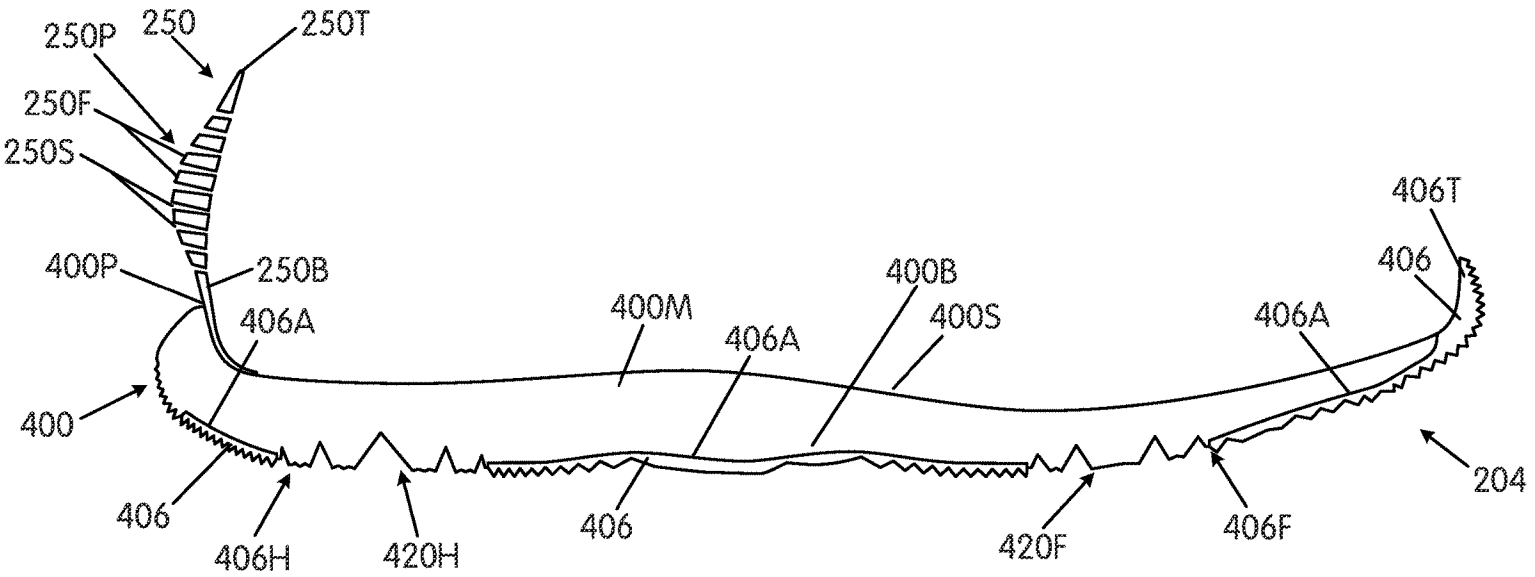

As further shown in FIGS. 1A, 1B, 2C, 2D, and 2M in this illustrated example, the heel support 250 includes a rearward extending protrusion 250P, which in this illustrated example constitutes a somewhat thicker, bulbous area in the immediate rear heel vicinity. When shaped in this manner and when at least some of the plurality of vertically spaced slits 250S extend through the rearward extending protrusion 250P, as best shown in FIG. 2M, the central area flaps 250F may be formed to have a somewhat greater width (in the heel-to-toe direction) than the flaps 250F nearer to the top edge 250T and/or nearer to the bottom edge 250B. While the example structures of FIGS. 1A-2V show eight vertically spaced flaps 250F or bands of heel support 250 material, any desired number of flaps 250F could be provided, including, for example, at least three flaps 250F, at least six flaps 250F, from 0 to 16 flaps 250F, and in some examples, from 1 to 15 flaps 250F, from 2 to 12 flaps 250F, or even from 3 to 10 flaps, etc. The flaps 250F may have a thickness (top to bottom dimension) of less than 5 mm, and in some examples, in a range from 0.5 mm to 4 mm, or even 1 mm to 3.5 mm.

The sole structure 204 of the specific example article of footwear 200 shown in FIGS. 1A-1D now will be described in more detail. As shown in FIGS. 1A and 1B, this example sole structure 204 includes a midsole component 300 (made from multiple parts) and an outsole component 306. As briefly mentioned above, the midsole component 300 of this example is a multipart structure that includes a lateral side midsole component 300L, a medial side midsole component 300M, and a base midsole component 300B. The base midsole component 300B forms the main plantar support surface of the sole structure 204, and it extends from the rear heel area of the sole structure 204 to a forward toe area of the sole structure 204 and from the lateral side midsole component 300L to the medial side midsole component 300M. Additionally or alternatively, if desired, the lateral side midsole component 300L and/or the medial side midsole component 300M may form some, a majority, or even all of the plantar support surface. The midsole component parts 300B, 300L, and 300M may be fit together in any desired manner without departing from this invention, including through the use of cements or adhesives, mechanical connectors, friction fits, etc. Also, the midsole component parts 300B, 300L, and 300M may be made from any desired materials without departing from this invention, including the same or different materials, if desired, such as one or more of polymer foam materials (e.g., polyurethane foams, ethylvinylacetate foams, etc.), thermoplastic polyurethane materials, thermoset polyurethanes, etc. Additionally or alternatively, the various midsole component parts 300B, 300L, and 300M may be made in any desired manners without departing from this invention, including in conventional manners as are known and used in the art (e.g., injection molding, compression molding, other molding techniques, etc.).

The lateral side midsole component 300L of this example sole structure 204 provides support for the outside lateral edge of the foot during various movements, such as turning or cutting actions when playing basketball. Therefore, in some examples of this invention, the lateral side midsole component 300L may be made from a material that is harder, firmer, and/or stiffer than the material of the medial side midsole component 300M. The added hardness, firmness, and/or stiffness may help provide enhanced support for those types of actions. Also, as shown in the view of FIG. 1C, the sole structure 204 may widen out somewhat at the lateral forefoot and/or midfoot area 300LF to provide a wider base for better support, e.g., during turning or cutting actions, e.g., when playing basketball.

Additionally, as shown in FIGS. 1A and 1B, this example sole structure 204 includes an outsole component 306 engaged with one or more of the midsole component parts 300B, 300L, and/or 300M. While the outsole component 306 could be made from multiple independent parts or elements, in this illustrated example, outsole component 306 is a one-piece construction that extends from the rear heel area to the forward toe area of the sole structure 204 and covers at least a majority of the bottom surface of the midsole base component 300B (and/or other midsole components). Also, as shown, the outsole component 306 of this example extends upward in a forward toe area of the sole structure 204 to provide a reinforced toe region 306T, e.g., that at least partially covers the forward end surfaces of one or more of the midsole base component 300B, the lateral side midsole component 300L and/or the medial side midsole component 300M. The forward toe region 306T also may engage the footwear upper 202, if desired. The outsole component 306 may be formed of any desired materials, such as rubbers, thermoplastic polyurethanes, thermosetting polyurethanes, other polymer materials, etc., including materials as are conventionally known and used in the footwear arts.

Various potential aspects, characteristics, and/or features of the sole structure 204 shown in FIGS. 1A-1D will be described in more detail below with reference to the sole structures shown in FIGS. 2A-5. The sole structure 204 of FIGS. 1A-1D may have any one or more of the features described in more detail below, including but not limited to: features of the foot-supporting areas (e.g., support area locations, sizes, shapes, etc.); features of the impact force-attenuating regions (e.g., locations of the bands, sizes, shapes, etc.); features of the rings (e.g., locations, numbers, sizes, shapes, etc.); midsole side wall heights and/or other dimension features; etc.

Figure 2O:
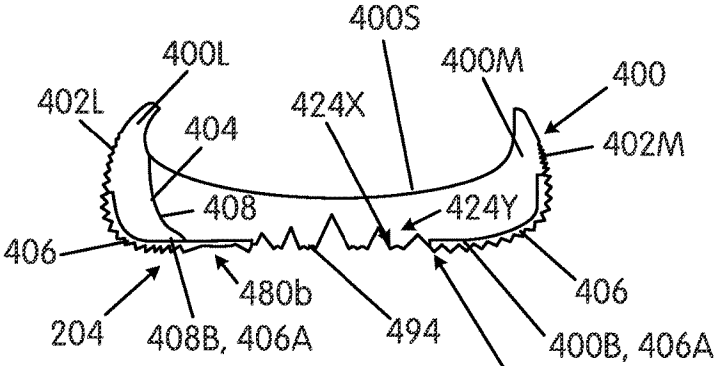
Figure 2N:
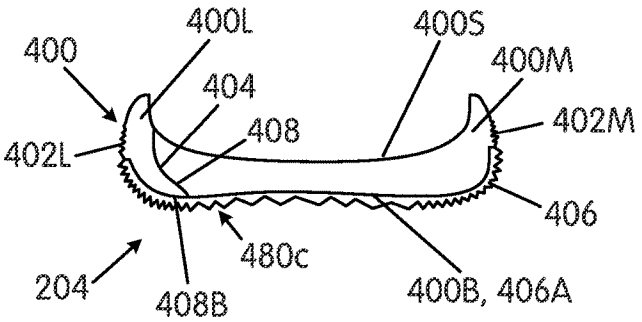
Figure 2Q:
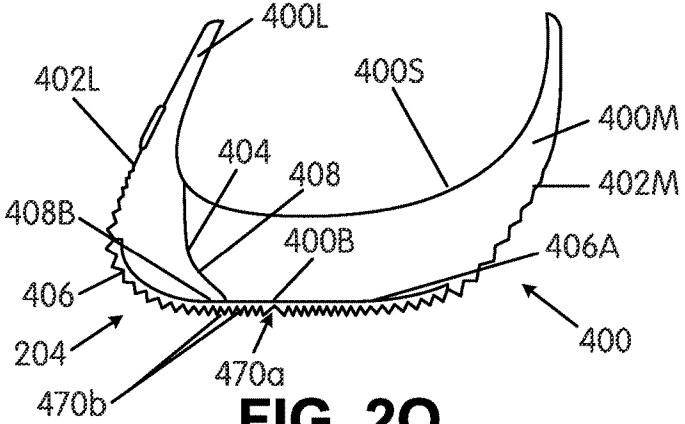

The sole structure 204 of FIGS. 2A-2S now will be described in more detail. FIG. 2A provides a bottom view of this example sole structure 204; FIG. 2B provides a top view; FIG. 2C provides a lateral side view; FIG. 2D provides a medial side view; FIG. 2E provides a toe view; FIG. 2F provides a heel view; FIG. 2G provides a top view of one midsole component 400M; FIG. 2H provides a top view of another midsole component 400L; FIG. 2I provides a bottom view of midsole component 400M; FIG. 2J provides a bottom view of midsole component 400L; FIG. 2K provides a top partially assembled view of the midsole component 400; FIG. 2L provides a bottom partially assembled view of the midsole component 400; FIG. 2M provides a longitudinal sectional view along line M-M in FIGS. 2A and 2B; FIG. 2N provides a sectional view along line N-N in FIGS. 2A and 2B; FIG. 2O provides a sectional view along line O-O in FIGS. 2A and 2B; FIG. 2P provides a sectional view along line P-P in FIGS. 2A and 2B; FIG. 2Q provides a sectional view along line Q-Q in FIGS. 2A and 2B; FIG. 2R provides a sectional view along line R-R in FIGS. 2A and 2B; and FIG. 2S provides a sectional view along line S-S in FIGS. 2A and 2B.

Figure 2S:
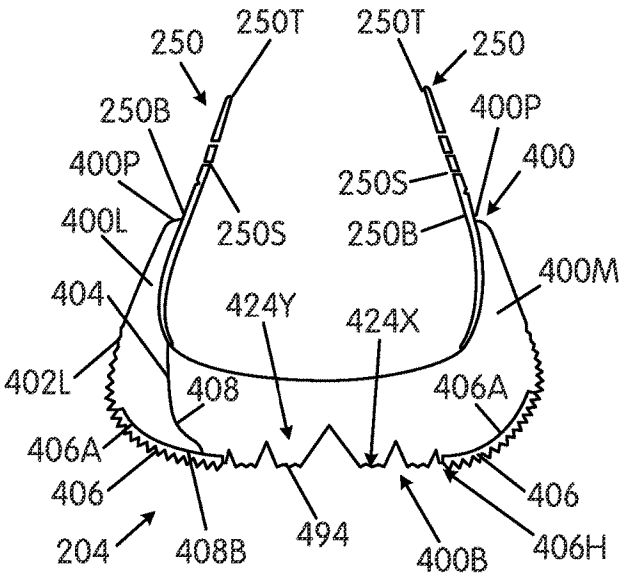
Figure 2P:
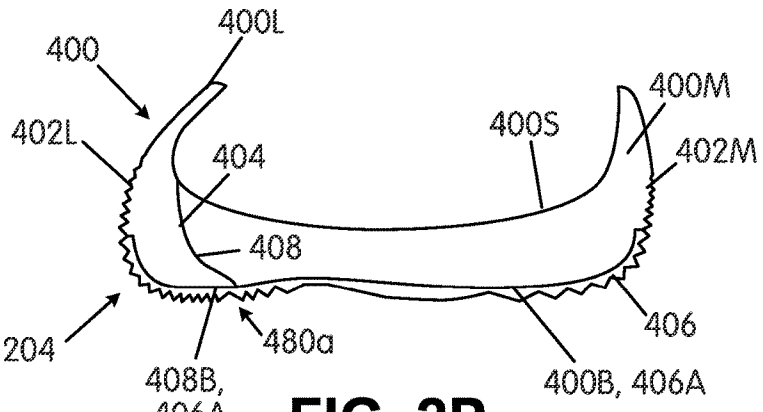
Figure 2R:
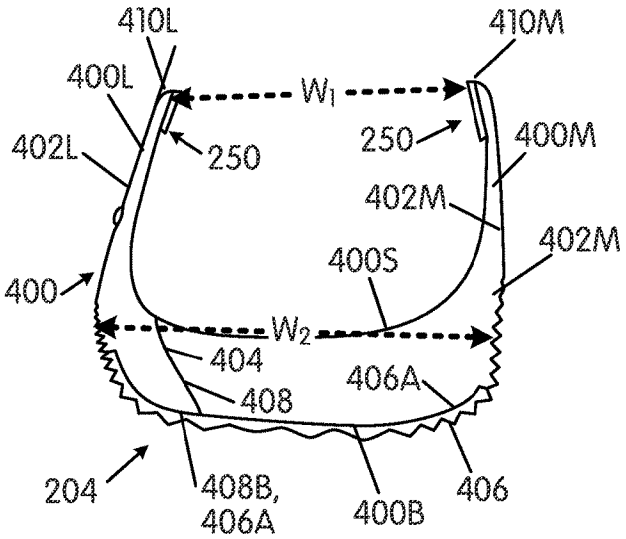

Rather than the four piece sole structure 204 shown in FIGS. 1A-1D, this example sole structure 204 of FIGS. 2A-2S has three main parts, namely: a medial side midsole component 400M; a lateral side midsole component 400L; and an outsole component 406. If desired, however, the sole structure 204 of FIGS. 2A-2S could be used with the upper of FIGS. 1A-1D and/or in place of the specific sole structure 204 shown in FIGS. 1A-1D. The heel support structure 250 shown in FIGS. 2A-2S may be considered to constitute another part of the sole structure 204, a part of the upper structure (e.g., 202), and/or generally a part of the footwear structure (e.g., 200).

The medial midsole component 400M of this example sole structure 204 may be formed at least in part from a polymeric foam material (e.g., polyurethane foam, ethylvinylacetate foam, etc., formed by compression molding, injection molding, etc.), and it may form at least a majority of a plantar support surface 400S and at least a majority of a medial sidewall surface 402M of the sole structure 204. This example medial midsole component 400M further includes a lateral side edge 404 and a bottom surface 400B opposite the plantar support surface 400S. The midsole component 400 further includes a lateral midsole component 400L formed at least in part from a second polymeric foam material (e.g., polyurethane foam, ethylvinylacetate foam, etc., formed by compression molding, injection molding, etc.), wherein the lateral midsole component 400L forms at least a majority of a lateral sidewall surface 402L of the sole structure 204. This lateral midsole component 400L includes a medial side edge 408 that extends adjacent (and optionally engages and/or is fixed to) the lateral side edge 404 of the medial midsole component 400M. The junction between side edges 404 and 408 may be located along the plantar support surface of the midsole component 400, e.g., optionally closer to the lateral sidewall surface 402L than to the medial sidewall surface 402M. This junction between side edges 404 and 408 may extend continuously from a rear heel area to a forward toe area of the midsole component 400 and/or sole structure 204. The lateral midsole component 400L also may form at least a portion of the bottom surface of the overall midsole structure (e.g., see area 408B).

As also shown in various figures, at least some portion(s) of the exterior medial sidewall surface 402M formed by the medial midsole component 400M may include a plurality of bellow or ring structures, and/or at least some portion(s) of the exterior lateral sidewall surface 402L formed by the lateral midsole component 400L also may include a second plurality of bellow or ring structures.

In at least some examples of this invention, the polymeric foam material of at least some portion of the lateral midsole component 400L (and optionally all of the lateral midsole component 400L) will have a higher durometer/hardness than the polymeric foam material of at least a portion of the medial midsole component 400M (and optionally all of the medial midsole component 400M). As some more specific examples: (a) the medial foam midsole component 400M may have a hardness within the range of 30-60 Asker C, and in some examples, from 35-55 Asker C, from 40-50 Asker C, or even from 43-47 Asker C, (b) the lateral foam midsole component 400L may have a hardness within the range of 45 to 75 Asker C, and in some examples, from 50 to 70 Asker C, from 55 to 65 Asker C, or even from 57-61 Asker C, and/or (c) the lateral foam midsole component 400L may have at least a 10% higher hardness than the medial foam midsole component 400M, and in some examples, at least 15% higher hardness or even at least 20% higher hardness (e.g., based on measurements on the Asker C scale). Alternatively, if desired, the lateral midsole component 400L could form at least a majority of the plantar support surface 400S and/or plantar support surface area or the medial midsole component 400M and the lateral midsole component 400L could each make up half of the plantar support surface 400S and/or plantar support surface area. The medial midsole component 400M and the lateral midsole component 400L may be engaged with each other (e.g., along edges 404 and 408, respectively), e.g., by cements or adhesives, by mechanical connectors, by a fusing technique, by a co-molding technique, etc.

As further shown in the figures, in this illustrated example, each of the medial midsole component 400M and the lateral midsole component 400L extends continuously from a heel area to a forefoot area of the sole structure 204 and/or midsole structure 400. For example, as shown in various figures, a rear junction area 404R between the medial midsole component 400M and the lateral midsole component 400L in this example structure 400 is located in a rear heel area (e.g., at a rearmost heel location RH) of the sole structure 204 and/or midsole structure 400. In this manner, (a) the medial midsole component 400M forms at least a portion of a rear heel medial sidewall of the sole structure 204 and/or the midsole structure 400 and/or (b) the lateral midsole component 400L forms at least a portion of a rear heel lateral sidewall and/or lateral heel sidewall of the sole structure 204 and/or the midsole structure 400. Also, a forward junction area 404F between the medial midsole component 400M and the lateral midsole component 400L in this example sole structure 204 and/or midsole structure 400 is located at a forward toe area of the sole structure 204 and/or midsole structure 400. As other potential options or features, either or both of the medial midsole component 400M and/or the lateral midsole component 400L may be made from two or more separate parts (e.g., engaged together by cements or adhesives, mechanical connectors, fusing techniques, co-molding techniques, etc.).

The medial midsole component 400M and the lateral midsole component 400L may have various different relative sizes with respect to one another and/or with respect to the overall midsole structure 400 without departing from this invention. As some more specific examples, the medial midsole component 400M may form at least 70% of an overall volume of the midsole component 400, and in some examples, at least 75%, at least 80%, or even at least 85% of this overall volume. In such structures 400, the lateral midsole component 400L may form 30% or less of the overall volume of the midsole component, and in some examples, 25% or less, 20% or less, or even 15% or less of this overall volume. As another potential feature, the medial midsole component 400M may form at least 75% of a plantar support surface area of the sole structure 204 and/or midsole structure 400, and in some examples, at least 80% or even at least 85% of the plantar support surface area. In such structures 400, the lateral midsole component 400L may form 25% or less of the plantar support surface area of the sole structure 204 and/or midsole structure 400, and in some examples, 20% or less or even 15% or less of this plantar support surface area.

FIGS. 2C and 2D illustrate additional features of the midsole 400 (e.g., relating to the midsole height) that may be included in sole structures 204 and/or articles of footwear 200 in accordance with at least some examples of this invention. As described above with reference to FIG. 6, a sole structure 204 and/or midsole structure 400 may define a rear-most heel location RH, a forward-most toe location FT, and a longitudinal length L from the rear-most heel location RH to the forward-most toe location FT. Returning to FIGS. 2C and 2D, in at least some examples of this invention, a highest point 410M of the medial sidewall surface 402M formed by the medial midsole component 400M and/or a highest point 410L of the lateral sidewall surface 402L formed by the lateral midsole component 400L may be: (a) located forward of a plane perpendicular to the longitudinal length L of the sole structure 204 and/or midsole component 400 and oriented to intersect the longitudinal length L at least 20% of the longitudinal length L forward from the rear-most heel location RH (i.e., forward of the plane at 0.2 L) and/or (b) located rearward of a plane perpendicular to the longitudinal length L of the sole structure 204 and/or midsole component 400 and oriented to intersect the longitudinal length L at least 40% of the longitudinal length L forward from the rear-most heel location RH (i.e., rearward of the plane at 0.4 L). In some examples, these highest points 410M and/or 410L may be located forward of a parallel plane at 0.25 L and/or rearward of a parallel plane at 0.35 L. In this manner, e.g., as shown in FIGS. 1A and 1B, the highest points 410M and/or 410L may be located toward a front of the foot-insertion opening 206 of the upper structure 202, and the sidewalls 402M and 402L provide significant side support for the heel and/or midfoot areas of the wearer's foot. If the highest points 410M and/or 410L constitute one or more line segments, the "highest point" is determined as the midpoint of a line segment joining the outermost points of the line segment(s). The top edge of medial sidewall surface 402M and/or lateral sidewall surface 402L may smoothly curve upward to their respective highest points 410M and/or 410L, as shown in the figures.

The structures and orientations shown in FIGS. 2C and 2D illustrate additional potential features of the midsole structure 400. More specifically, as shown in these figures, the medial midsole component 400M and the lateral midsole component 400L define a rear heel height dimension Hi from a horizontal base surface S to the top of the midsole components 400M and 400L at the rear-most heel location RH. Also, these midsole components 400M and 400L define a highest sidewall height dimension $H_M$ and $H_L$, respectively, from the horizontal base surface S to the highest points 410M, 410L, respectively. In at least some example sole structures 204 and/or midsole structures 400 in accordance with this invention, one or more of the following dimensional properties may be provided:

| | |
|---|---|
| $H_L \geq 1.25\ H_1$ | $H_M \geq 1.25\ H_1$ |
| $H_L \geq 1.4\ H_1$ | $H_M \geq 1.4\ H_1$ |
| $H_L \geq 1.6\ H_1$ | $H_M \geq 1.6\ H_1$ |
| $H_L \geq 1.8\ H_1$ | $H_M \geq 1.8\ H_1$ |

As some additional or alternative potential options, from a more absolute dimension point of view, $H_L$ and/or $H_M$ may be at least 0.5 inch greater than Hi, and in some examples, at least 0.75 inch greater, at least 1 inch greater, or even at least 1.25 inches greater.

Other potential features of this example sole structure 204 and/or midsole structure 400 are illustrated in FIG. 2R. As shown, this example sole structure 204 and/or midsole structure 400 defines a first width dimension $W_1$ between: (a) the highest point 410M of the medial sidewall surface 402M formed by the medial midsole component 400M and (b) the highest point 410L of the lateral sidewall surface 402L formed by the lateral midsole component 400L. This sole structure 204 and/or midsole structure 400 further defines a second width dimension $W_2$ corresponding to a widest or maximum width dimension between (a) an outer surface of the medial sidewall 402M (or other sole structure 204 component) and (b) an outer surface of the lateral sidewall 402L (or other sole structure 204 component) in a vertical plane that passes through the highest point 410M of the medial sidewall surface 402M and the highest point 410L of the lateral sidewall surface 402L (e.g., the plane of the page of FIG. 2R). In at least some example sole structures 204/midsole components 400 in accordance with this invention, one or more of the following properties may be provided:

$$W_1 \geq 0.85\ W_2 \quad W_1 \geq 0.8\ W_2 \quad W_1 \geq 0.75\ W_2$$

As noted above, the sole structure 204 shown in FIGS. 2A-2S includes an outsole component 406. This example outsole component 406 includes a top surface 406A engaged with the bottom surface 400B of the medial midsole component 400M and/or with the bottom surface 408B of the lateral midsole component 400L. If desired, the top surface 406A of the outsole component 406 may completely cover at least 75%, at least 80%, at least 85%, at least 90%, at least 95%, or even 100% of combined areas of the bottom surfaces 400B, 408B of the medial midsole component 400M and the lateral midsole component 400L. This example outsole component 406 further includes a forward toe portion 406T that extends upward and covers a forward-most toe edge 408M of the medial midsole component 400M and/or a forward-most toe edge 408L of the lateral midsole component 400L.

In the example sole structure 204 shown in FIGS. 2A-2S, however, the outsole component 406 includes at least one opening defined through it such that portions of the bottom surfaces 400B, 408B of at least one of the midsole components 400M and/or 400L may be exposed through the opening. In this specifically illustrated example, a portion of the bottom surface 400B of the medial midsole component 400M is exposed through two outsole component 406 openings, but the bottom surface 408B of the lateral midsole component 400L is not exposed through either of those openings. The example sole structure 406 of FIGS. 2A-2S includes one opening 406H in the heel-supporting area (see FIGS. 2A and 2S) and one opening 406F in the forefoot-supporting area (see FIGS. 2A and 2O). More or fewer openings of this type may be provided through the outsole structure 406, if desired, without departing from this invention. These openings 406H and 406F are provided at major heel and forefoot impact-force attenuating locations of the sole structure 204 (e.g., areas where force pressure maps indicate that higher impact forces are experienced when playing basketball) to allow the foam midsole component 400M to directly contact the ground and provide its impact force attenuation properties at these high impact force locations.

Figure 2T:
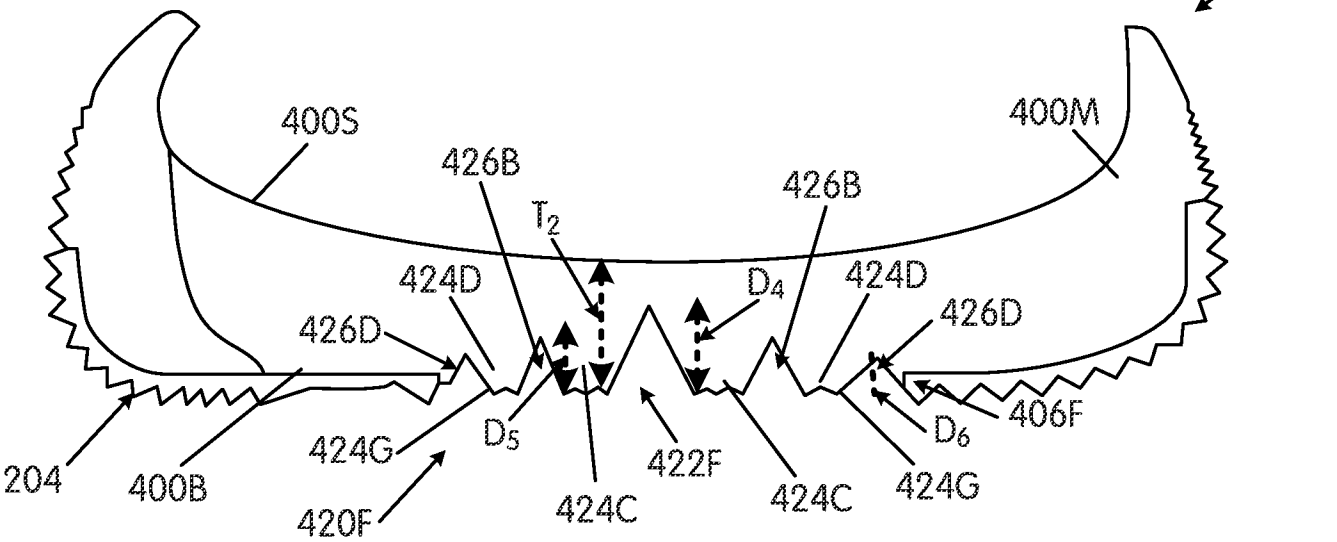
Figure 2U:
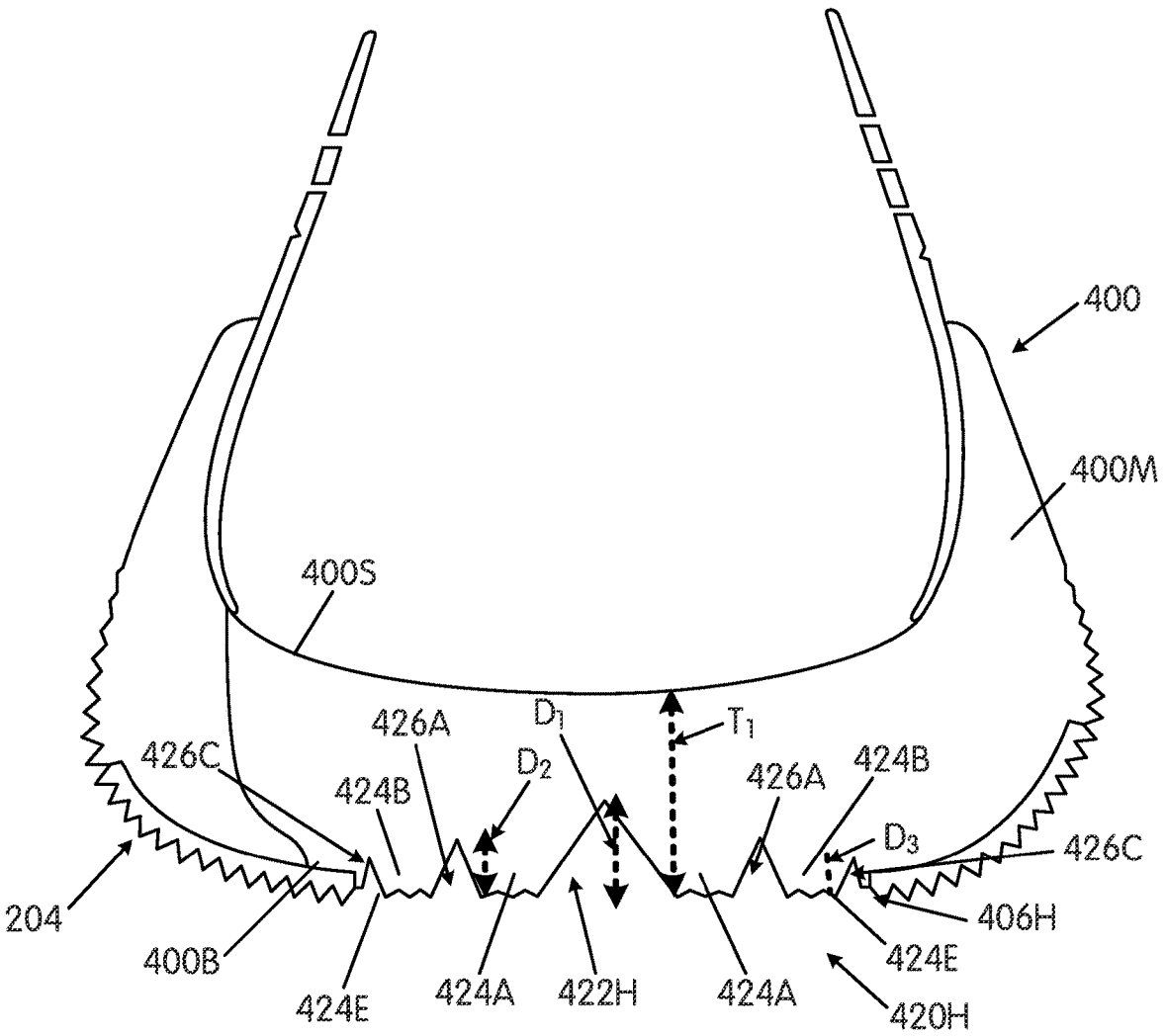

FIGS. 2T and 2U are provided (enlarged versions of FIGS. 2O and 2S, respectively) to illustrate additional potential features of impact-force attenuating structures in accordance with at least some examples of this invention. As shown in these figures, this example sole structure 204 includes a sole member (e.g., midsole component 400, medial midsole component 400M, and/or lateral midsole component 400L) having an upper-facing surface 400S and a ground-facing surface 400B, wherein the ground-facing surface 400B includes:

(a) a heel-based impact-force attenuating structure 420H (FIG. 2U) including a first central area (e.g., a first recessed central area) 422H, a first band 424A (e.g., or ring) of sole structure 204 material (e.g., midsole material) surrounding (and optionally at least partially defining) the first central area 422H, a second band 424B (e.g., or ring) of sole structure 204 material (e.g., midsole material) surrounding the first band 424A, and a first recessed groove 426A separating the first band 424A and the second band 424B (and optionally at least partially defining one or both bands 424A and/or 424B); and (b) a forefoot-based impact-force attenuating structure 420F (FIG. 2T) including a second central area (e.g., a second recessed central area) 422F, a third band 424C (e.g., or ring) of sole structure 204 material (e.g., midsole material) surrounding (and optionally at least partially defining) the second central area 422F, a fourth band 424D (e.g., or ring) of sole structure 204 material (e.g., midsole material) surrounding the third band 424C, and a second recessed groove 426B separating the third band 424C and the fourth band 424D (and optionally at least partially defining one or both bands 424C and/or 424D).

As further shown in the example of FIGS. 2T and 2U, either one or both of the heel-based impact-force attenuating structure 422H and/or the forefoot-based impact-force attenuating structure 422F may be formed from a polymer foam material (e.g., the polymer foam material of one of the elements 400M and/or 400L of midsole component 400). As further shown, the heel-based impact-force attenuating structure 422H is exposed at an exterior of the sole structure 204 through the heel opening 406H in the outsole component 406 and/or the forefoot-based impact-force attenuating structure 406F is exposed at the exterior of the sole structure 204 through the forefoot opening 406F in the outsole component 406. FIGS. 2T and 2U further illustrate that an outer edge 424E of the second band 424B is surrounded by (and optionally at least partially defined by) a third recessed groove 426C and/or an outer edge 424G of the fourth band 424D is surrounded by (and optionally at least partially defined by) a fourth recessed groove 426D. Optionally, if desired, additional bands and/or recessed grooves may be provided (e.g., of progressively larger sizes around the central recesses 422H and/or 422F).

Additional potential features and/or characteristics of the recessed areas 422H, 422F, the bands 424A-424D, and/or grooves 426A-426D are described below. For example, a deepest depth (e.g., in the medial midsole component 400M in the plantar support surface 400S to bottom surface 400B direction, e.g., dimension $D_1$) of the central area (e.g., the recessed central area) 422H may be deeper than a deepest depth (e.g., dimension $D_2$) of the first recessed groove 426A and/or the deepest depth of the first recessed groove 426A (dimension $D_2$) may be deeper than a deepest depth of the third recessed groove 426C (e.g., dimension $D_3$, if present). See FIG. 2U. Additionally or alternatively, if desired, a deepest depth (e.g., in the medial midsole component 400M in the plantar support surface 400S to bottom surface 400B direction, e.g., dimension $D_4$) of the central area (e.g., the recessed central area) 422F may be deeper than a deepest depth (e.g., dimension $D_5$) of the second recessed groove 426B and/or the deepest depth of the second recessed groove 426B (dimension $D_5$) may be deeper than a deepest depth of the fourth recessed groove 426D (e.g., dimension $D_6$, if present). See FIG. 2T.

In at least some examples of this invention, the dimension $D_1$ will be such that the recess of central area 422H extends through a depth of about 25% to 65% of an overall thickness $T_1$ of the midsole component 400M at a location immediately adjacent the recessed area 422H (e.g., the thickness of the first band 424A) (and in some examples, through about 30% to 60% of the overall thickness $T_1$). Additionally or alternatively, in some structures 400 the dimension $D_2$ will be such that the first recessed groove 426A extends through a depth of about 15% to 50% of the overall thickness $T_1$ of the midsole component 400M and/or through 15% to 50% of the thickness of first band 424A and/or second band 424B (and in some examples, through about 20% to 40% of one or more of these thicknesses) and/or the dimension $D_3$ will be such that the third recessed groove 426C will extend through a depth of about 10% to 30% of the overall thickness $T_1$ of the midsole component 400M and/or through 10% to 30% of the thickness of first band 424A and/or second band 424B (and in some examples, through about 12% to 25% of one or more of these thicknesses). Additionally or alternatively, in some structures, the dimension $D_4$ will be such that the recess of central area 422F extends through a depth of about 55% to 85% of an overall thickness $T_2$ of the midsole component 400M at a location immediately adjacent the recessed area 422F (e.g., the thickness of the third band 424C) (and in some examples, through about 60% to 80% of the overall thickness $T_4$). Additionally or alternatively, in some structures 400, the dimension $D_5$ will be such that the second recessed groove 426B extends through a depth of about 25% to 60% of the overall thickness $T_2$ of the midsole component 400M and/or through 25% to 60% of the thickness of the third band 424C and/or fourth band 424D (and in some examples, through about 30% to 50% of one or more of these thicknesses) and/or the dimension $D_6$ will be such that the fourth recessed groove 426D will extend through a depth of about 18% to 45% of the overall thickness $T_2$ of the midsole component 400M and/or through 18% to 45% of the thickness of the third band 424C and/or fourth band 424D (and in some examples, through about 24% to 40% of one or more of these thicknesses).

As another potential feature, as also shown in FIG. 2A, if desired, one or more of the first central area (e.g., the first recessed central area) 422H, the first band 424A, the second band 424B, the first recessed groove 426A, the third recessed groove 424C, the second central area (e.g., the second recessed central area) 422F, the third band 424C, the fourth band 424D, the second recessed groove 426B, and/or the fourth recessed groove 424D may have a curved shape. As some more specific examples, any one of the recessed central areas, bands, and/or recessed grooves may have any one of a circular shape, an elliptical shape, an oval shape, an elongated shape, etc. (or other non-linear and/or non-planar shape).

Some additional example dimensional features of these example impact-force attenuating structures 420H and/or 420F will be described in more detail below. In the example structure of FIGS. 2A-2S, the exposed area of the bottom surface 400B of medial midsole component 400M in each of the two openings 406H, 406F (see FIG. 2A) may be within a range of about 0.75 $in^2$ to 10 $in^2$, and in some examples, from 2 $in^2$ to 8 $in^2$ or even from 2.5 $in^2$ to 6 $in^2$. These area ranges also may define the areas of the impact-force attenuating structures 420F and/or 420H (e.g., the area enclosed by the outermost deep recessed groove of each structure 420F and/or 420H). When circular, the openings 406H and/or 406F may have a diameter in a range of 1 inch to 3.5 inches, and in some examples, from 1.5 inches to 3 inches. See FIG. 2V (which is an enlarged view of FIG. 2O).

Figure 2V:
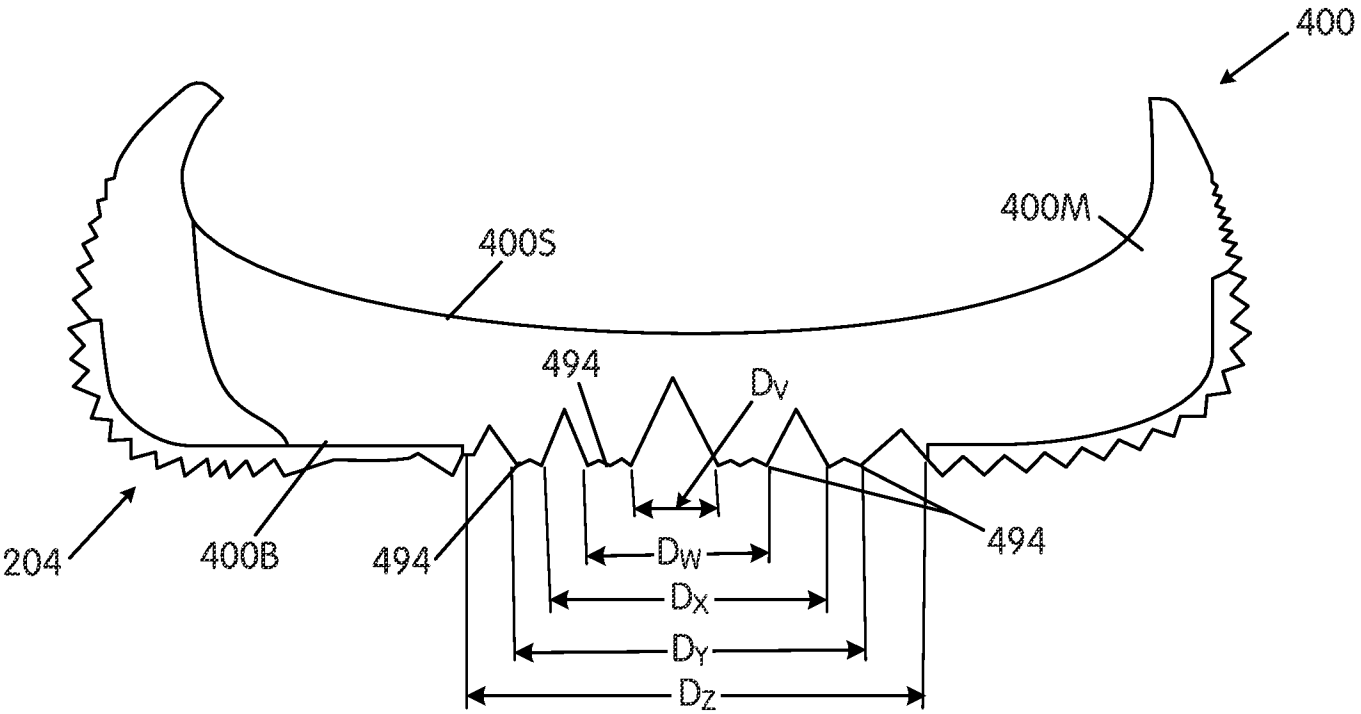

As further shown in FIG. 2V, the various central areas, bands, and recessed grooves of impact-force attenuating structures 420H and/or 420F may have one or more of the following dimensional features:

| Feature | Example Dimensional Ranges | Additional Example Dimensional Ranges |
|---|---|---|
| Inner Diameter $D_V$ of Bands 424A, 424C | 0.2 inch to 1 inch | 0.25 inch to 0.75 inch |
| Outer Diameter $D_W$ of Bands 424A, 424C | 0.5 inch to 1.5 inch | 0.6 inch to 1.25 inch |
| Inner Diameter $D_X$ of Bands 424B, 424D | 0.75 inch to 1.75 inch | 1 inch to 1.5 inch |
| Outer Diameter $D_Y$ of Bands 424B, 424D | 1 inch to 2 inch | 1.25 inch to 1.75 inch |
| Diameter $D_Z$ of Outside of Recesses 426C, 426D and/or Opening/Window Diameter | 1.25 inch to 3.5 inch | 1.5 inch to 3 inches |

The dimensional features in the above Table may apply to a heel-based impact-force attenuating structure 420H, a forefoot-based impact-force attenuating structure 420F, and/or impact-force attenuating structures provided at other desired locations in a sole structure. Also, while their structures may be the same, impact-force attenuating structures of this type on a single article of footwear 200, midsole structure 400, and/or sole structure 204 may be different from one another (e.g., dimensionally) without departing from this invention. As another option, if desired, a specific sole structure 204 and/or midsole component 400 may contain only one of this type of impact-force attenuating structure (e.g., in the heel only, in the forefoot only, etc.).

In the illustrated example structure 400, the heel-based impact-force attenuating structure 420H and the forefoot-based impact-force attenuating structure 420F are located in the midsole structure 400 at locations shown to experience high impact forces during typical use (e.g., based on two-dimensional foot force or foot pressure diagrams; based on measured foot forces or foot pressures; measured when a player is performing certain functions, such as walking, running, landing a step or jump, playing basketball or other activities, etc.; etc.). The central areas (e.g., recessed central areas) 422F, 422H; the bands 424A-424D; and the recessed grooves 426A-426D may be formed as a unitary, one-piece construction, for example, in the ground-facing surface 400B of the polymeric foam midsole component 400 (e.g., medial midsole component 400M). In this manner, the central areas 422F, 422H, the bands 424A-424D, and the recessed grooves 426A-426D are formed in or from a polymer foam material as may be used in footwear midsole constructions.

As further shown, for example, in FIGS. 2O and 2S, at least one (and optionally some or even all) of the first band 424A and the second band 424B around heel-based central area 422H and the third band 424C and the fourth band 424D around forefoot based central area 422F (and optionally other bands and/or rings around these areas 422H and/or 422F) may include a base 424Y and an apex 424X (wherein the base 424Y of each band is located closer to the upper-facing surface 400S of the midsole component 400 than is the apex 424X of that band). If desired, at least one (and optionally some or even all) of the first band 424A, the second band 424B, the third band 424C, and/or the fourth band 424D may be formed to be wider in cross section at its base 424Y than at its apex 424X (e.g., triangular, truncated triangular, rounded triangular, trapezoidal, gum-drop shaped, etc., shaped grooves in cross section). If desired, the ground-facing surfaces or apices 424X of the first band 424A and the second band 424B may be co-planar (optionally along with apices of any one or more additional bands in heel-impact force-attenuating structure 420H) and/or the ground-facing surfaces or apices 424X of the third band 424C and the fourth band 424D may be co-planar (optionally along with apices of any one or more additional bands in forefoot-impact force-attenuating structure 420F).

While not wishing to be bound by any specific theory of operation, for at least some example structures according to aspects of this invention, under a compressive force (e.g., when a foot contacts the ground after landing a step or jump), it is believed that the recessed central areas 422F, 422H and the recessed grooves 426A-426D will begin to collapse or reduce in depth and/or the bands 424A-424D decrease in depth and/or flatten out as the incident force deforms or deflects the midsole structure 400, particularly at one or more of bands 424A-424D. The shapes and/or geometries of recessed central areas 422F, 422H (and any others), bands 424A-424D (and any others), and recessed grooves 426A-426D (and any others), e.g., with bands 424A-424D wider in cross section at their bases than at their apices and/or recessed areas 422F, 422H and recessed grooves 426A-426D narrower in cross section at their upper ends than at their exposed and/or open ends, provide spaces between the bands 424A-424D and clearance for spreading of the foam material as each band 424A-424D compresses, deforms, or deflects under the incident forces. As these actions occur and/or the impact force increases, it is believed that the recessed central areas 422F, 422H and/or recessed grooves 426A-426D become substantially filled with the midsole material and/or otherwise deformed, which cause the impact-force attenuating structures 420F, 420H to begin to slow and/or resist additional deformation and/or deflection (as the deflected material filling the recessed central areas 422F, 422H and/or recessed grooves 426A-426D slows or stops further deformation/deflection). In this manner, the impact-force attenuating structures 420H, 420F provide a comfortable feel (e.g., soft initial response) and a responsive ride. Moreover, in response to relatively low foot forces or pressures, the feel is very soft (because the recessed areas 422F, 422H are open, relatively large, and can easily receive deflected midsole material), but the midsole component 400 is adequately supportive under higher foot forces or pressures (as deformation and/or deflection occur, as described above). The impact-force attenuating structures 420F, 420H may operate in somewhat of a "bumpstop" type manner to attenuate impact forces.

FIGS. 2A-2V illustrate other potential impact-force attenuating features, traction-enhancing features, and/or support-enhancing features that may be provided in sole structures 204 in accordance with at least some examples of this invention. For example, as shown in FIG. 2A, the outsole component 406 also may include central areas (e.g., recessed central areas) that are surrounded by one or a plurality of rings (e.g., two or more rings). As one specific example shown in FIG. 2A, the outsole component 406 includes a midfoot-supporting region 470 including a midfoot central area (e.g., a recessed midfoot central area) 470*a* surrounded by a plurality of rings 470*b*. In this illustrated example, the plurality of rings 470*b* includes an innermost ring that immediately surrounds (and optionally at least partially defines) the midfoot central area 470*a* and at least three additional rings of increasingly larger circumference surrounding the innermost ring. As shown in FIG. 2Q, this midfoot central area 470*a* and the depressions between (and optionally defining) the rings 470*b* are not as deep as the recessed central areas 422F, 422H and/or recessed grooves 426A-426D of the impact-force attenuating structures 420F and 420H formed in the midsole component 400 of this example. As a more specific example, if desired, the depressions that define adjacent rings 470*b* may have a maximum depth of less than 20% of a deepest depth of any one or more of the recessed central areas 422H, 422F and/or the recessed grooves 426A-426D (and in some examples, less than 15% or even less than 10%). This midfoot-supporting region (e.g., located between impact-force attenuating structures 420F and 420H in the longitudinal direction of sole structure 204) can provide additional midfoot impact force attenuation, support, and/or stability, particularly for use in basketball shoes.

FIG. 2A shows additional foot-supporting regions including central areas (e.g., recessed central areas) surrounded by one or a plurality of rings at other locations in the sole structure 204. For example, the sole structure 204 of FIG. 2A includes three lateral side foot-supporting regions 480*a*, 480*b*, 480*c* located along the lateral side edge of the sole structure 204 (and formed in the outsole component 406 in this illustrated example). Portions of these lateral side foot-supporting regions 480*a*, 480*b*, 480*c* also are shown in FIGS. 2N, 2O, and 2P, respectively. Each of these regions 480*a*, 480*b*, and 480*c* includes a central portion (e.g., a recessed central portion) surrounded by one or a plurality of rings (e.g., two or more rings) of the general types described above with respect to midfoot-supporting region 470. In this illustrated example, the lateral side foot-supporting regions 480*a*, 480*b*, 480*c* are arranged in a generally heel-to-toe direction with respect to one another and are located at a lateral side of the forefoot impact-force attenuating structure 420F (with region 480*b* located between the opening 406F for the forefoot impact-force attenuating structure 420F and the lateral side edge of the sole member 204). The lateral side foot-supporting regions 480*a*, 480*b*, 480*c* may provide additional traction, support, and/or stability, e.g., for basketball type activities, such as additional impact force attenuation, traction, stability, and/or lateral support when making a turn or cutting maneuver, when making a fast stop or direction change, when landing a step or jump, etc.

FIG. 2A further shows two forefoot or forward toe area supporting regions 490*a* and 490*b* located along the forward toe area of the sole structure 204 (and formed in the outsole component 406 in this illustrated example). Each of these regions 490*a* and 490*b* includes a central portion (e.g., a recessed central portion) surrounded by one or a plurality of rings (e.g., two or more rings) of the general types described above with respect to midfoot-supporting region 470. In this illustrated example, the forefoot or toe area-supporting regions 490*a* and 490*b* are arranged in a generally side-to-side direction with respect to one another and are located at a forward side of the forefoot impact-force attenuating structure 420F. The forefoot or toe area-supporting regions 490*a* and 490*b* may provide additional impact force attenuation, traction, support, and/or stability, e.g., during a toe-off phase of a running step cycle, during a jump, when changing directions, etc.

The ring structures shown in the outsole component 406 and described above are not limited to rings that immediately surround a single central area of a foot-supporting region 470, 480*a*-480*c*, 490*a*, and/or 490*b*. Rather, as shown in FIG. 2A, as the rings become larger, a single (e.g., continuous) ring may be provided that extends around more than one foot-supporting region 470, 480*a*-480*c*, 490*a*, and/or 490*b*. As some more concrete examples, ring 492 (and indeed a plurality of rings that encompass ring 492) surrounds a combined area of forefoot or toe-supporting regions 490*a* and 490*b*. Additionally or alternatively, some rings may be provided that surround combined areas of one or both impact-force attenuating structures 420F and 420H and/or one or more of the other foot-supporting regions 470, 480*a*-480*c*, 490*a*, and/or 490*b*. In fact, as shown in FIG. 2A, some of the outermost rings of outsole component 406 surround combined areas of all of impact-force attenuating structures 420F and 420H and foot-supporting regions 470, 480*a*-480*c*, 490*a*, and/or 490*b*. Such rings may be located at or near an outermost perimeter of the outsole component 406.

Foot-supporting rings (e.g., optionally having size, shape, and/or dimensional features like rings 470*b* and/or 492 described above) are not limited to the foot-supporting surface of an outsole component 406. Rather, as shown in FIGS. 2C-2F, rings of this type may extend along lateral side surfaces of the outsole component 406, e.g., along the lateral side (optionally along the entire lateral side as shown in FIG. 2C), along the medial heel side area (FIG. 2D), along the medial forefoot area (FIG. 2D), along the forward toe area (FIG. 2E), and/or along the rear heel area (FIG. 2F). Additionally or alternatively, as shown in these figures, similar rings of this type could be provided along at least some portions of the walls of medial midsole component 400M and/or the lateral midsole component 400L (e.g., on at least portions of the rear heel walls (FIG. 2F) and/or at least portions of the sidewall surfaces 402L and 402M (FIGS. 2C, 2D)). The ring structures along the sidewalls of the outsole component 406, the medial midsole component 400M and/or the lateral midsole component 400L can help provide a more consistent appearing sole structure 204, help conceal junctions between the outsole 406 and midsole 400, and/or help conceal wrinkling when the sole structure 204 is compressed during use.

Further, as shown in FIGS. 2A, 2I, 2L, 2M, 2O, and 2S-2V, ring structures 494 of the types described above may be formed in the ground-facing surfaces of one or more of the bands 424A-424D of the impact-force attenuating structures 420F and/or 420H. These ring structures 494 can help provide additional traction and/or impact-force attenuation to the midsole component 400. More specifically, as shown in the noted figures, one or more of the first band 424A, the second band 424B, the third band 424C, and/or the fourth band 424D may include two (or more) rings on the ground-facing surface(s) thereof, wherein each pair of adjacent rings are separated by a depression defined in the outer (ground-facing) surface of the respective band. When present, the depression(s) provided in the band(s) 424A-424D to define the rings therein may have a depth of less than 20% of a depth $D_1$-$D_6$ of any one or more of the recessed central areas 422F and/or 422H and/or the recessed grooves 426A-426D (and in some examples, less than 10% of the depth of any one or more of the depths $D_1$-$D_6$).

As another option or alternative, if desired, the outsole component 406 of the example sole structure 204 shown in FIGS. 2A-2V could be omitted, and the features of the outsole component 406 (e.g., one or more of rings 492, foot-supporting regions 470, 480*a*-480*c*, 490*a*, 490*b*, etc.) may be formed in the midsole structure 400 (e.g., in the ground-facing surface 400B and/or 408B). If desired, at least the exterior-most surfaces of the midsole structure 400 may be made from a relatively durable foam material and/or other material, to provide better wear resistance and durability properties.

Figure 3A:
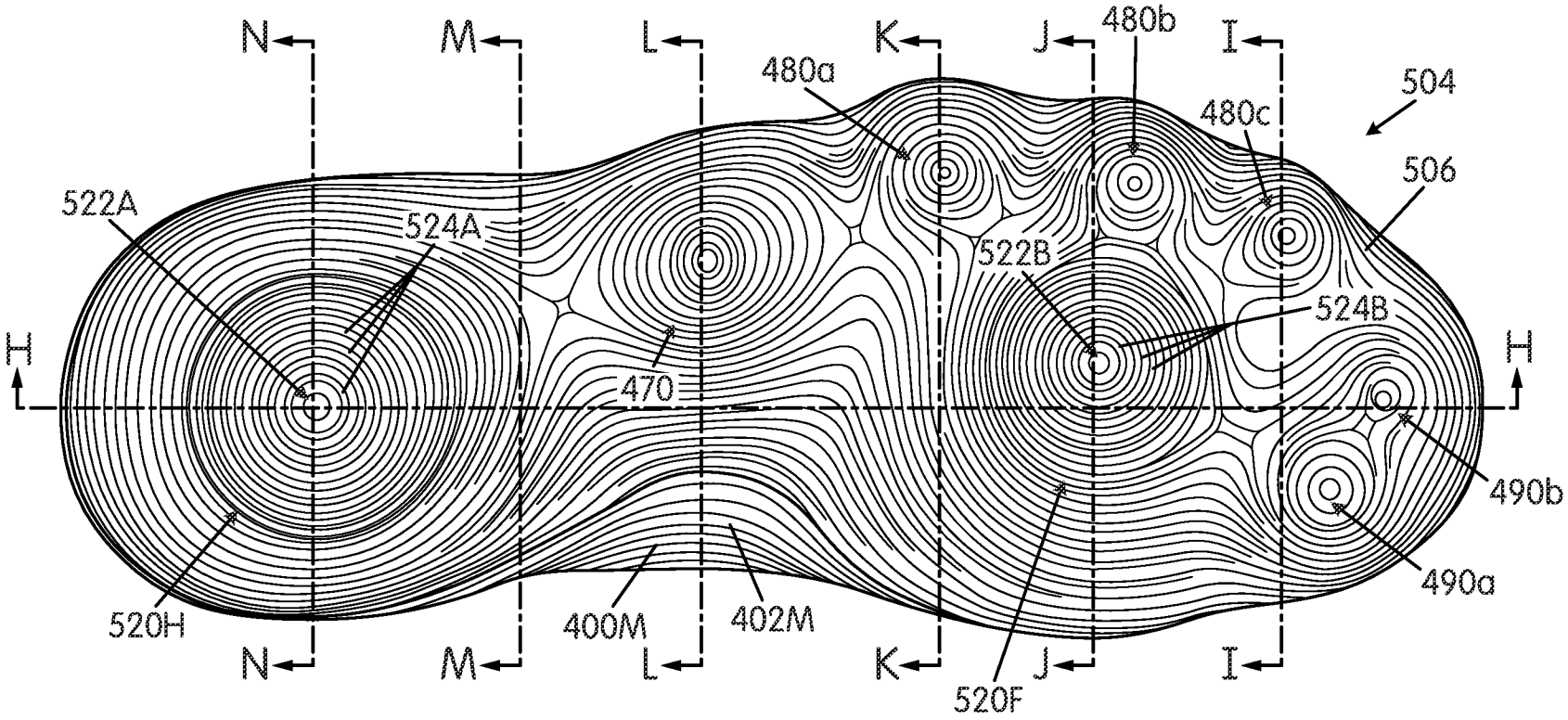
FIGS. 3A-3N provide various views of another sole structure for an article of footwear in accordance with some examples and aspects of this invention.
Figure 3B:
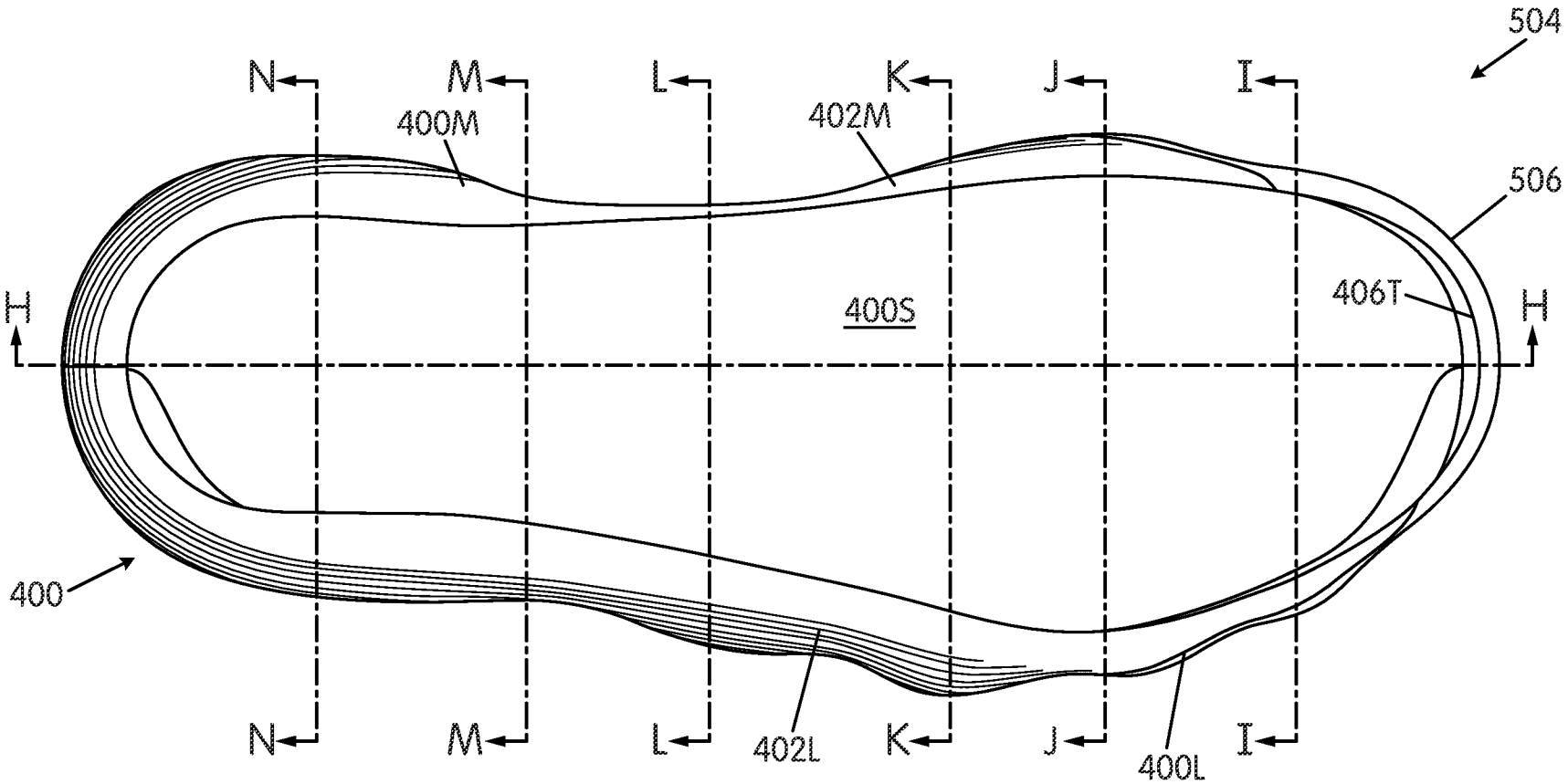
Figure 3C:
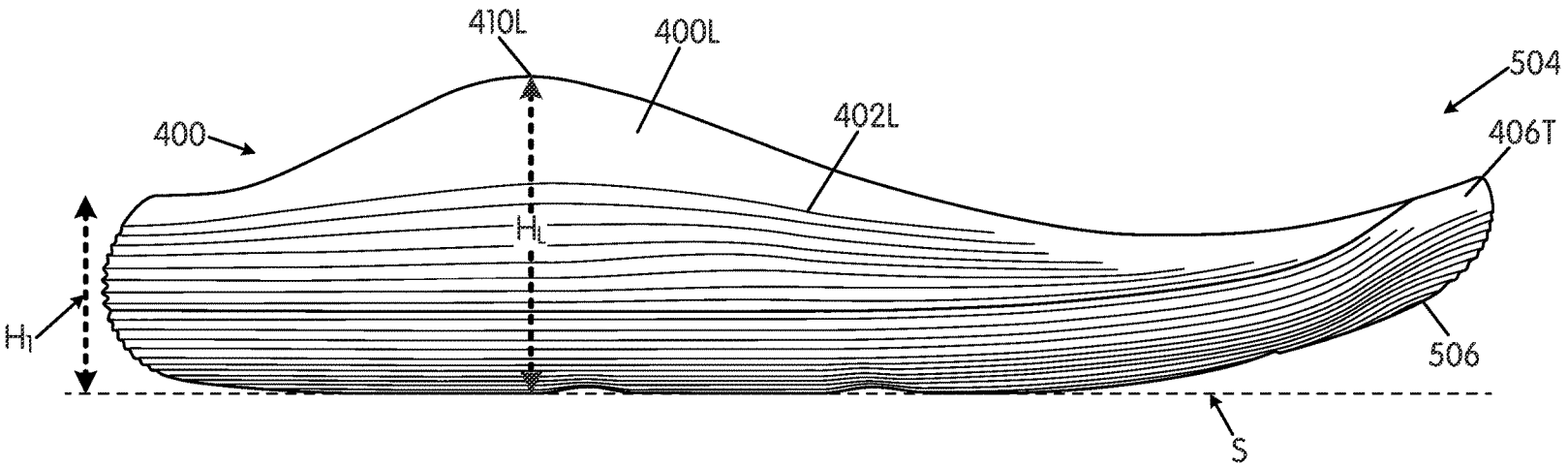
Figure 3D:
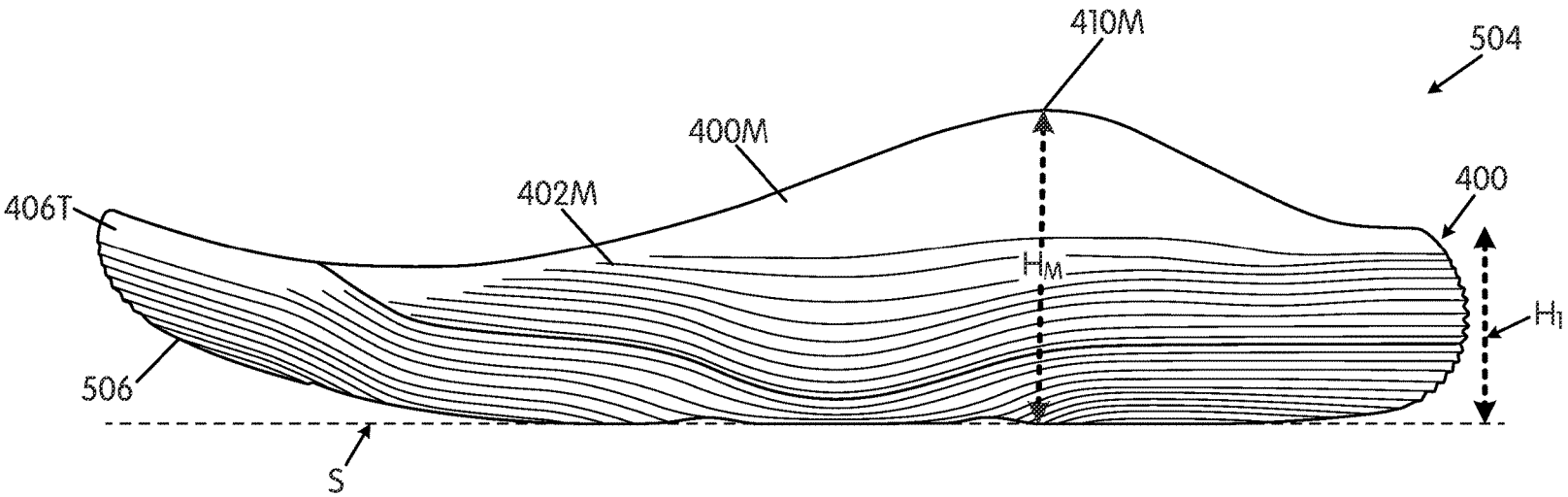
Figure 3F:
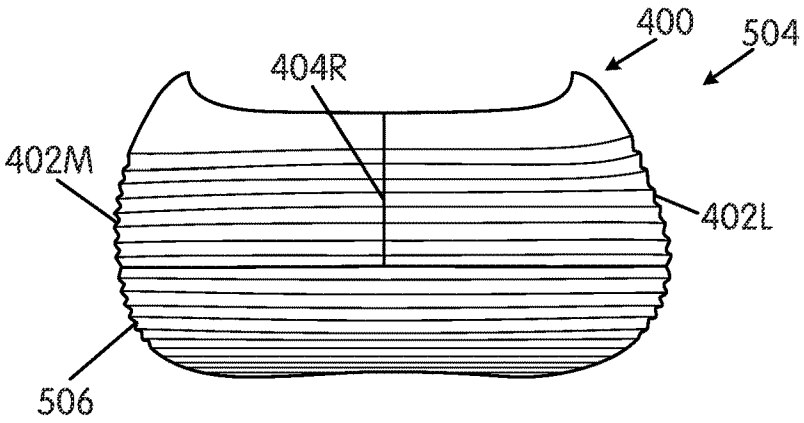
Figure 3E:
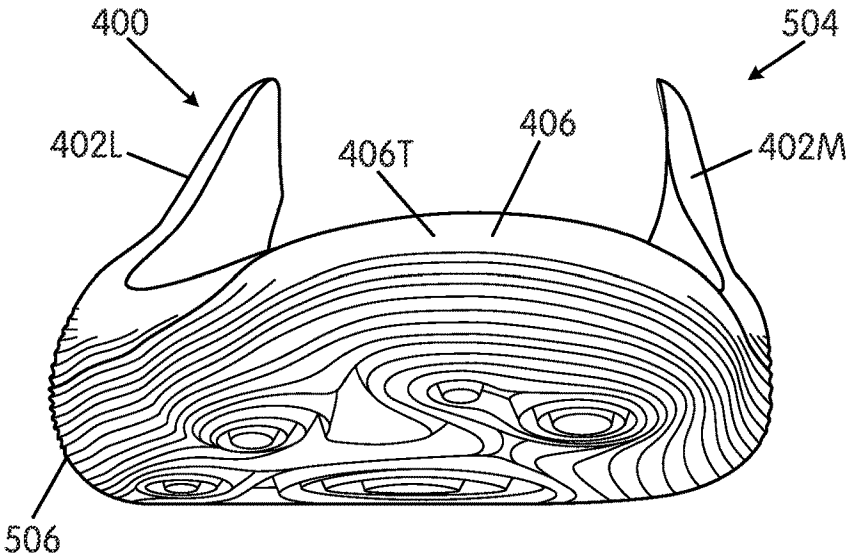
Figure 3G:
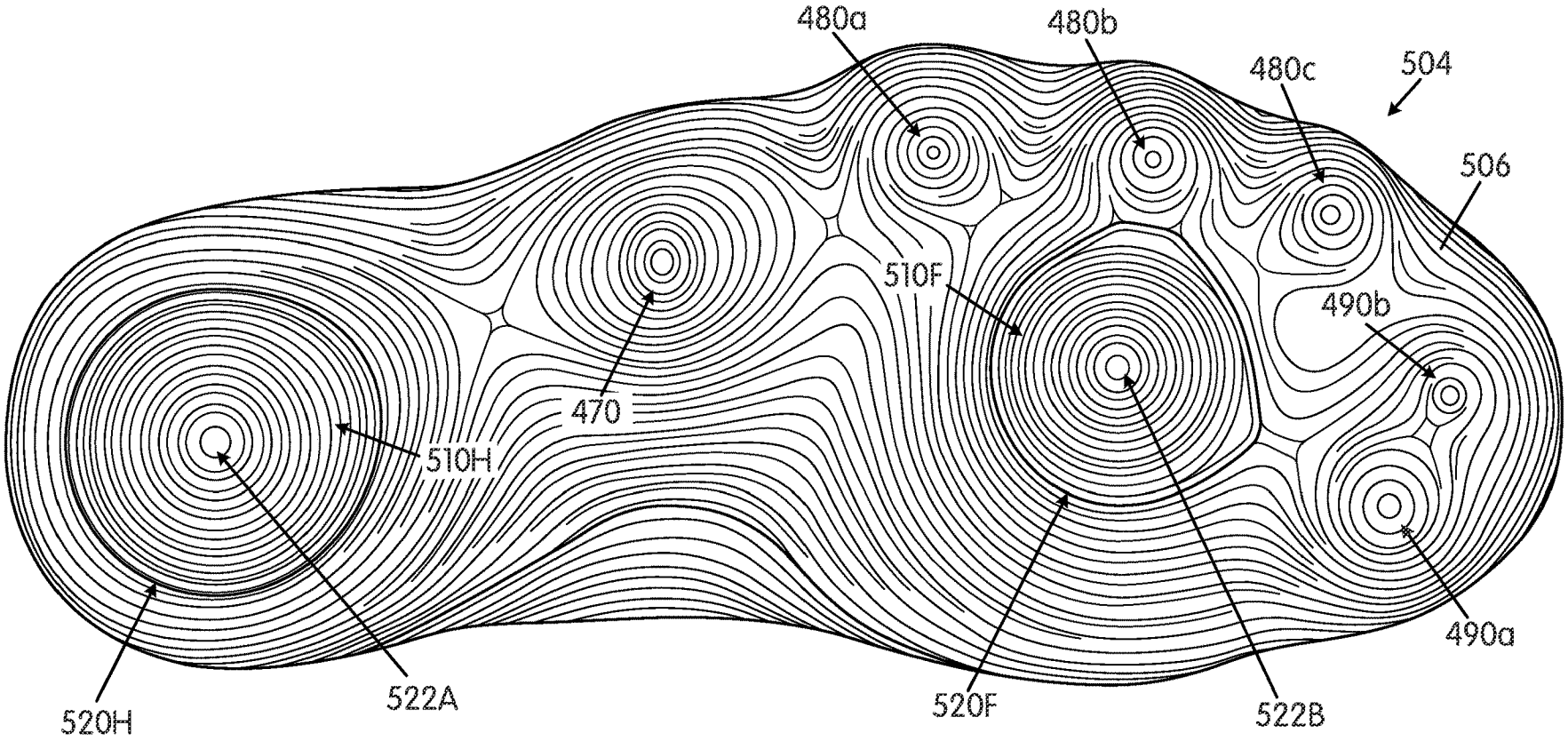
Figure 3H:
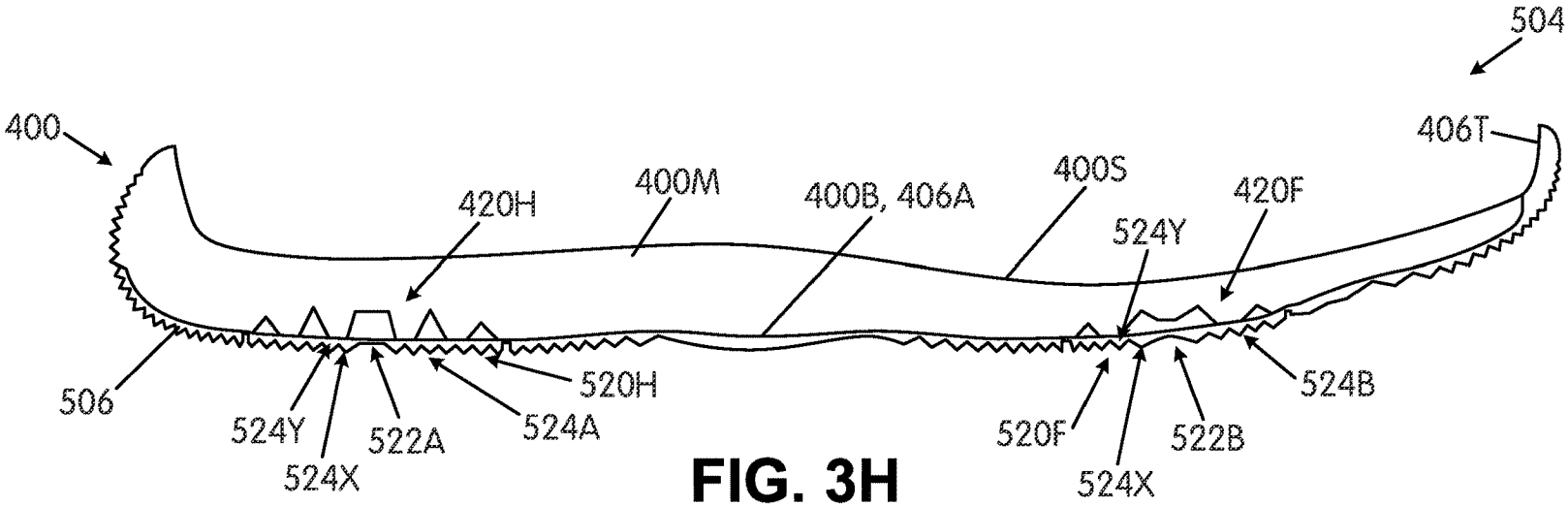
Figure 3J:
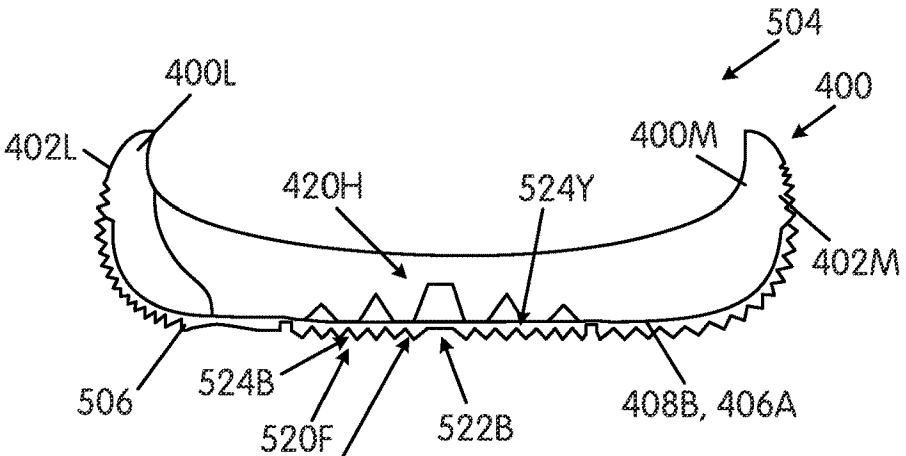
Figure 3I:
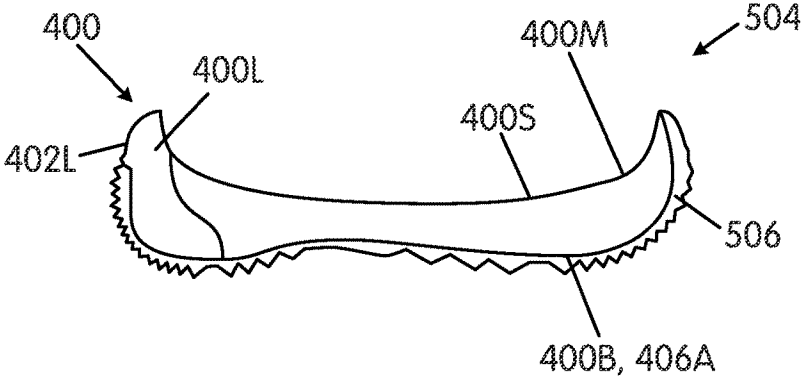
Figure 3L:
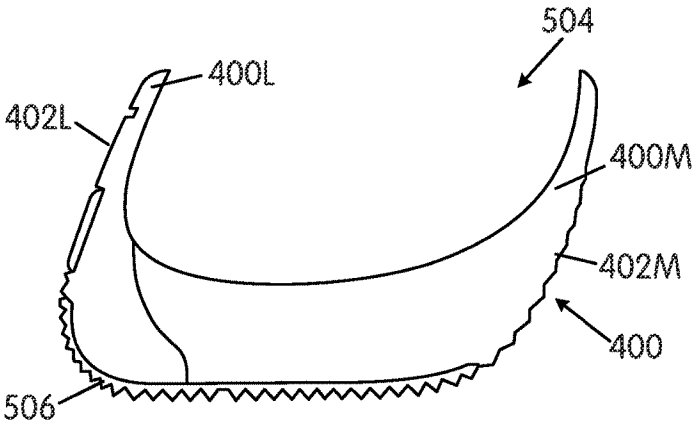
Figure 3N:
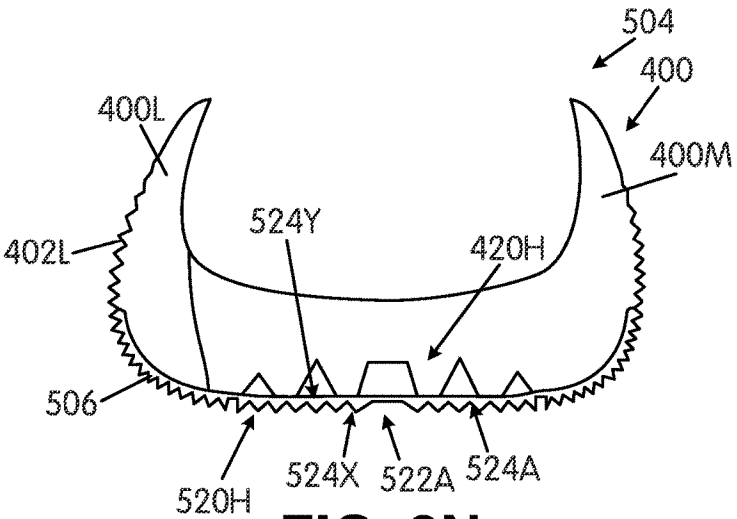
Figure 3K:
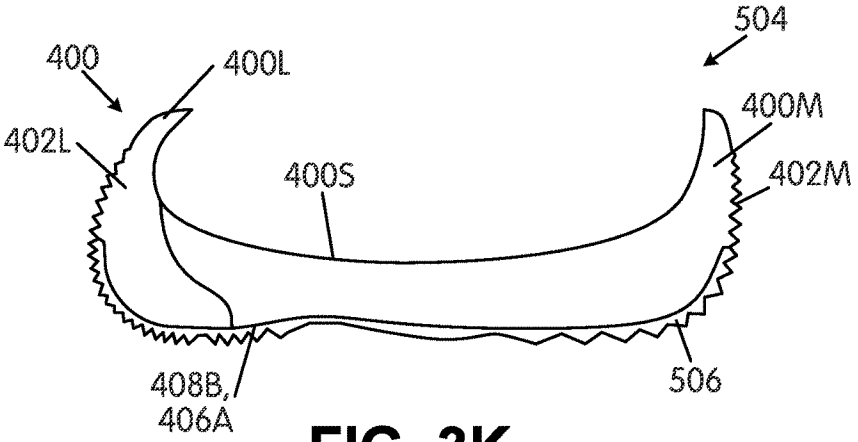
Figure 3M:
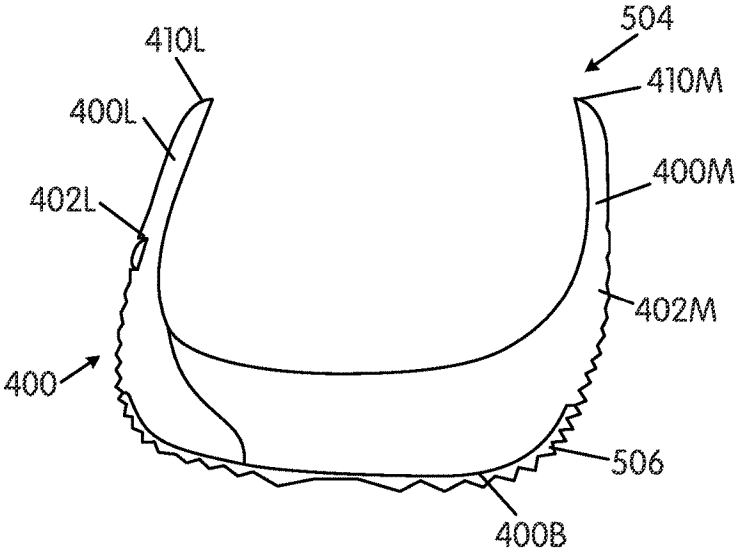

Another example sole structure 504 in accordance with at least some examples of this invention will be described below in conjunction with FIGS. 3A-3N. Specifically, FIG. 3A provides a bottom view of the sole structure 504; FIG. 3B provides a top view; FIG. 3C provides a lateral side view; FIG. 3D provides a medial side view; FIG. 3E provides a toe view; FIG. 3F provides a heel view; FIG. 3G provides a bottom view of an alternative outsole construction and/or feature; FIG. 3H provides a longitudinal sectional view along line H-H in FIGS. 3A and 3B; FIG. 3I provides a sectional view along line I-I in FIGS. 3A and 3B; FIG. 3J provides a sectional view along line J-J in FIGS. 3A and 3B; FIG. 3K provides a sectional view along line K-K in FIGS. 3A and 3B; FIG. 3L provides a sectional view along line L-L in FIGS. 3A and 3B; FIG. 3M provides a sectional view along line M-M in FIGS. 3A and 3B; and FIG. 3N provides a sectional view along line N-N in FIGS. 3A and 3B. Because the features of the midsole component 400 (including medial midsole component 400M and lateral midsole component 400L) in this example sole structure 504 are the same or similar to those described above in conjunction with FIGS. 2A-2V, much of the detailed description of midsole component 400, medial midsole component 400M, and lateral midsole component 400L will not be repeated. Notably, however, like reference numbers in the various figures refer to the same or similar parts, and the midsole component 400, medial midsole component 400M, and/or lateral midsole component 400L of FIGS. 3A-3N may have any of the various features, characteristics, and/or options to those described above in conjunction with FIGS. 2A-2V.

One difference between the sole structure 204 of FIGS. 2A-2V and the sole structure 504 of FIGS. 3A-3N relates to the absence of the heel support 250 from the sole structure 504 of FIGS. 3A-3N. Alternatively, if desired, a heel support 250 having any of the features, options, and/or characteristics described above could be used with the sole structure 504 of FIGS. 3A-3N. As another option or alternative, if desired, a conventional heel support or heel counter structure, as are known and used in the footwear art, may be provided in the sole structure 504 of FIGS. 3A-3N. Also, the sole structure 504 of FIGS. 3A-3N may be engaged with a footwear upper structure, including, if desired, footwear uppers 202 of the various types and/or having any one or more of the features described above in conjunction with FIGS. 1A-1D.

Another difference in this example sole structure 504 relates to the outsole component 506. Specifically, the outsole component 506 of this example sole structure 504 does not include bottom openings 406H and/or 406F defined through it. Rather, as shown in FIGS. 3A, 3H, 3J, and 3N, in this example sole structure 504, the outsole component 506 covers the forefoot-based impact-force attenuating structure 420F and the heel-based impact-force attenuating structure 420H (although impact-force attenuating structures 420F and 420H of these types are still provided in the ground-facing surface of the midsole component 400). Thus, in this example sole structure 504, the forefoot-based impact-force attenuating structure 420F and the heel-based impact-force attenuating structure 420H are not exposed at the bottom surface of the sole structure 504 (e.g., as shown in FIG. 3A) (and thus impact-force attenuating structures 420H and 420F may be better protected from the external environment to improve durability, wear resistance, abrasion resistance, etc.).

More specifically, as shown in FIGS. 3A-3N, this example sole structure 504 includes an upper-facing surface and a ground-facing surface opposite the upper-facing surface, wherein: (a) a heel-supporting region 520H including a central area (e.g., a recessed central area) 522A surrounded by at least one, and optionally, a first plurality of rings 524A, defined in the ground-facing surface (e.g., of an outsole component 506); and/or (b) a forefoot-supporting region 520F including a central area (e.g., a recessed central area) 522B surrounded by at least one, and optionally, a second plurality of rings 524B, defined in the ground-facing surface (e.g., of the same outsole component 506 or a different outsole component 506 part). Each of the first plurality of rings 524A and the second plurality of rings 524B may include: a first ring (e.g., an innermost ring) that surrounds (and optionally at least partially defines) the respective central area 522A, 522B and at least a second ring that surrounds the first ring. In the illustrated example, each of the first plurality of rings 524A and the second plurality of rings 524B includes at least a third ring that surrounds the second ring; and optionally a fourth ring that surrounds the third ring; and optionally more rings. The central areas 522A/522B and rings 524A/524B may help provide traction, impact-force attenuation, support, and/or stability.

As further shown, for example, in FIGS. 3H, 3J, and 3N, at least some (and optionally all) of the first ring and second ring around central areas 522A and 522B (and optionally other rings around these areas) in the first plurality of rings 524A and/or the second plurality of rings 524B may include a base 524Y and an apex 524X (wherein the base 524Y of each ring is located closer to the upper-facing surface 406A of the outsole component 406 than is the apex 524X of that ring). If desired, at least some (and optionally all) of the first ring and the second ring in the first plurality of rings 524A and/or the second plurality of rings 524B may be formed to be wider in cross section at its base 524Y than at its apex 524X (e.g., triangular, truncated triangular, rounded triangular, trapezoidal, gum-drop shaped, etc. in cross section). If desired, some or all of the ground-facing surfaces or apices of the first and/or second plurality of rings 524A, 524B may be co-planar, including at least the first ring and the second ring in either or both of the pluralities 524A and/or 524B. The shapes and/or geometries of the central areas 522A, 522B (and any others), rings 524A, 524B (and any others), and/or the depressions between the rings 524, 524B, e.g., with rings 524A, 524B wider in cross section at their bases 524Y than at their apices 524X and/or central areas 522A, 422B and depressions between the rings narrower in cross section at their upper ends than at their exposed and/or open ends, may provide space between the rings 524A, 524B and clearance for spreading of the sole material as each ring 524A, 524B compresses, deforms, or deflects under force.

If desired, as shown in FIG. 3G, the outsole component 506 may be formed to include at least a first window region defined in it, and wherein this first window region may be at least partially transparent or translucent. More specifically, in the sole structure 504 shown in FIG. 3G, the outsole component 506 includes a forefoot window 510F and a separate heel window 510H that are at least partially transparent or translucent. In this manner, if desired, the bottom surface of the midsole component 400 (e.g., the bottom of medial midsole component 406M), the bottom of impact-attenuating structures (e.g., 420F and/or 420H), etc., may be visible (but not openly exposed) through the forefoot window region 510F and/or the heel window region 510H.

Windows 510F and/or 510H of this type, when present, may be formed in the outsole component 506 in any desired manner without departing from this invention. For example, if desired, openings may be cut in an outsole component 506 and/or the outsole component 506 may be made with openings in them (e.g., in a manner akin to the outsole component 406 described above, such as by molding techniques, etc.), and then separate window components may be engaged with the outsole component 506 and/or the midsole component 400 to close the openings (e.g., engaged by adhesives or cements, mechanical connectors, fusing techniques, friction fits, etc.). As another option, if desired, the window region(s) 510F and/or 510H may be integrally formed with the remainder of the outsole component 506, e.g., by selectively locating at least partially transparent or translucent outsole material in a mold at the areas of the window(s) 510F/510H (e.g., using "dams" in the mold or in other appropriate ways), and then molding the overall outsole component 506. As yet another option, if desired, the entire bottom of the outsole component 506 (or even the entire outsole component 506) may be made from an at least partially transparent or translucent outsole material.

FIGS. 3A-3N further illustrate that the outsole component 506 may have the various ring features surrounding one or more of (including combined areas of any two or more of) foot-supporting regions 520H, 520F, 470, 480*a*, 480*b*, 480*c*, 490*a*, and/or 490*b*. The midsole component 400 further may have rings of this same type (e.g., on its sidewall surfaces, rear heel surface, forward toe surface, etc.). The surrounding rings of the sole structure 504 may have any one or more of the various features, sizes, shapes, constructions, and/or orientations as described above with respect to the example structures of FIGS. 2A-2V.

Alternatively, if desired, the outsole component 506 of the example structure shown in FIGS. 3A-3N could be omitted, and the features of the outsole component 506 (including any of the recessed central areas, rings, and depressions described above and below) may be formed in the midsole structure 400 (e.g., with or without the impact-force attenuating structures 420F and/or 420H formed in the midsole component 400). If desired, at least the exterior-most surfaces of the midsole structure 400 may be made from a relatively durable foam material, e.g., to provide better wear resistance and durability properties. As a more specific example, the heel-supporting region 520H and/or the forefoot-supporting region 520F could constitute parts of a single midsole element (e.g., midsole component 400, medial midsole component 400M, lateral midsole component 400L, etc.), which may be made from a polymeric foam material (e.g., polyurethane foam, ethylvinylacetate foam, etc.).

As further shown in the example sole structure 504 of FIGS. 3A-3N, a plurality of rings are provided that extend around a combined area of the forefoot-supporting region 520F, the heel-supporting region 520H, and the midfoot-supporting region 470. As another feature, as shown in these figures, two forward toe-supporting regions 490*a*, 490*b* (each including a recessed toe central area surrounded by one or more rings (also called "toe rings" herein)) are defined in the ground-facing surface of the outsole component 506. At least one of these toe-supporting regions (e.g., region 490*a* in FIG. 3A) may be located closer to a medial side edge of the sole structure 504 than to a lateral side edge of the sole structure 504 or closer to a lateral side edge of the sole structure 504 than to a medial side edge of the sole structure 504. The illustrated two forward toe-supporting regions 490*a*, 490*b* are arranged in a generally side-by side orientation, e.g., with one forward toe-supporting region (e.g., 490*a*) located closer to a medial side edge of the sole structure 504 than is the other forward toe-supporting region (e.g., 490*b*). As further shown, in FIG. 3A, one or more rings may be formed in the outsole component 506 that extend around a combined area of the first forward toe-supporting region 490*a* and the second forward toe-supporting region 490*b*. Additionally, one or more rings may further extend around a combined area of the forefoot-supporting region 520F, the first forward toe-supporting region 490*a*, and the second forward toe-supporting region 490*b* (and optionally also around the heel-supporting region 520H, any present midfoot-supporting region 470, and/or any one or more lateral side (or lateral forefoot) supporting region (e.g., 480*a*, 480*b*, and/or 480*c*). At least some of the central areas and/or rings associated with the various foot-supporting regions (and optionally all) may have a curved shape (and optionally, at least some may have a circular shape, elliptical shape, oval shape, etc., or other non-linear or non-planar shape).

Figure 4A:
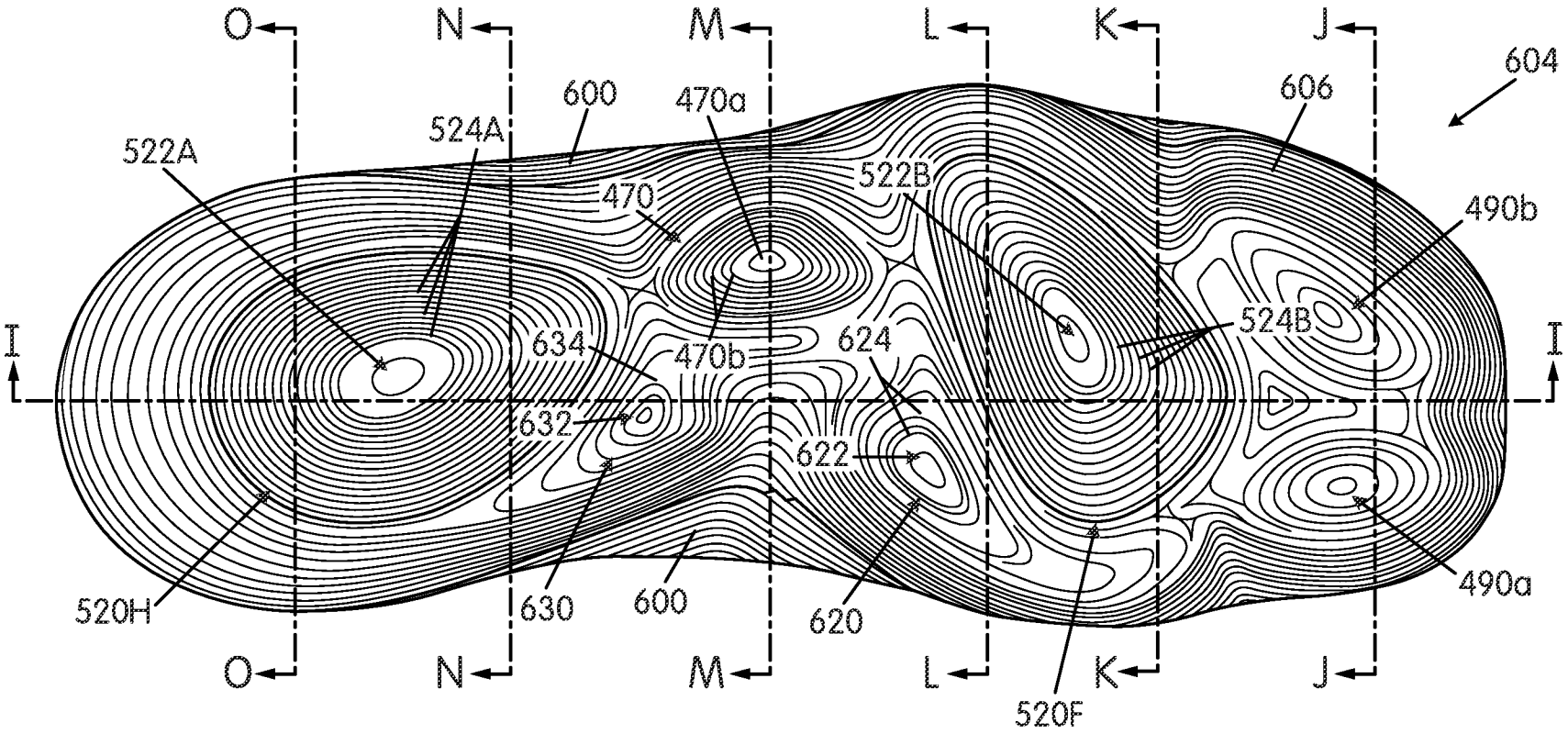
FIGS. 4A-4O provide various views of another sole structure for an article of footwear in accordance with some examples and aspects of this invention.
Figure 4B:
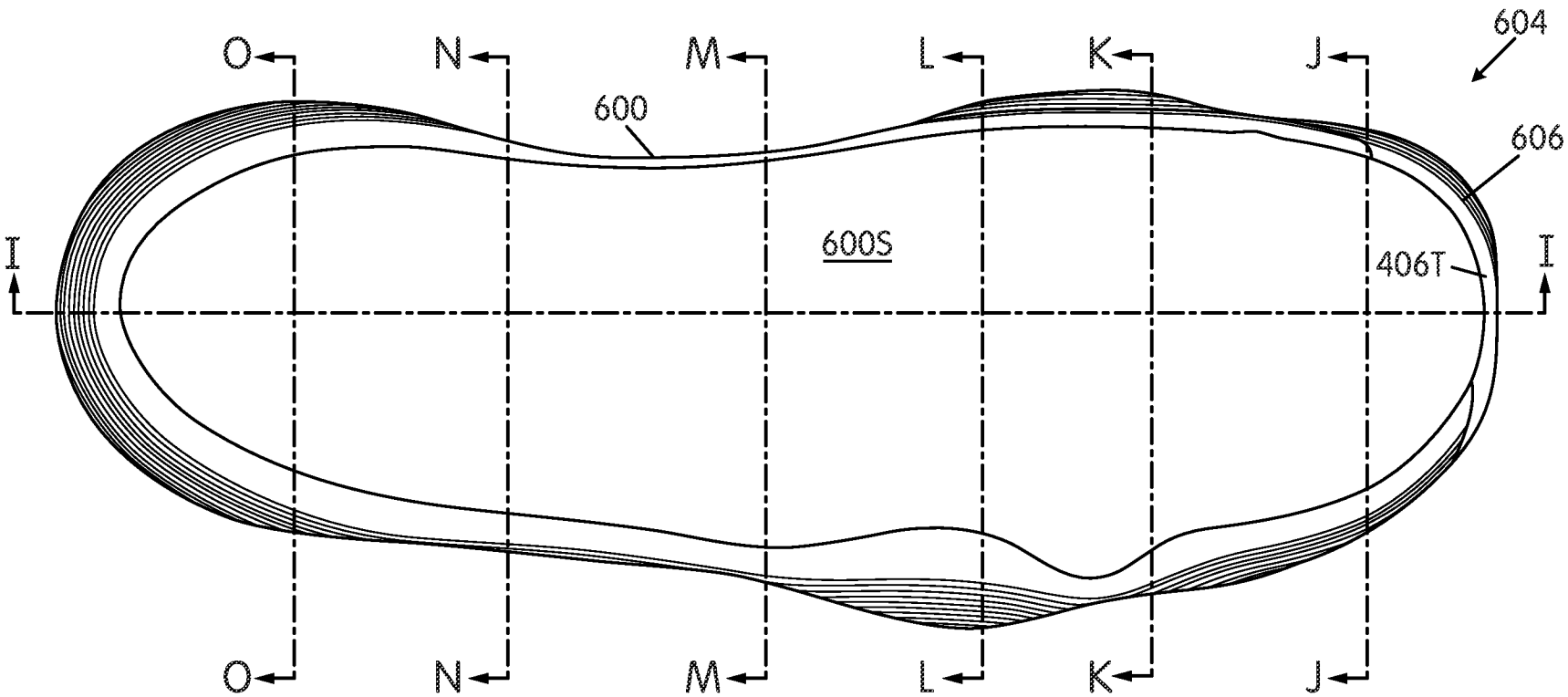
Figure 4C:
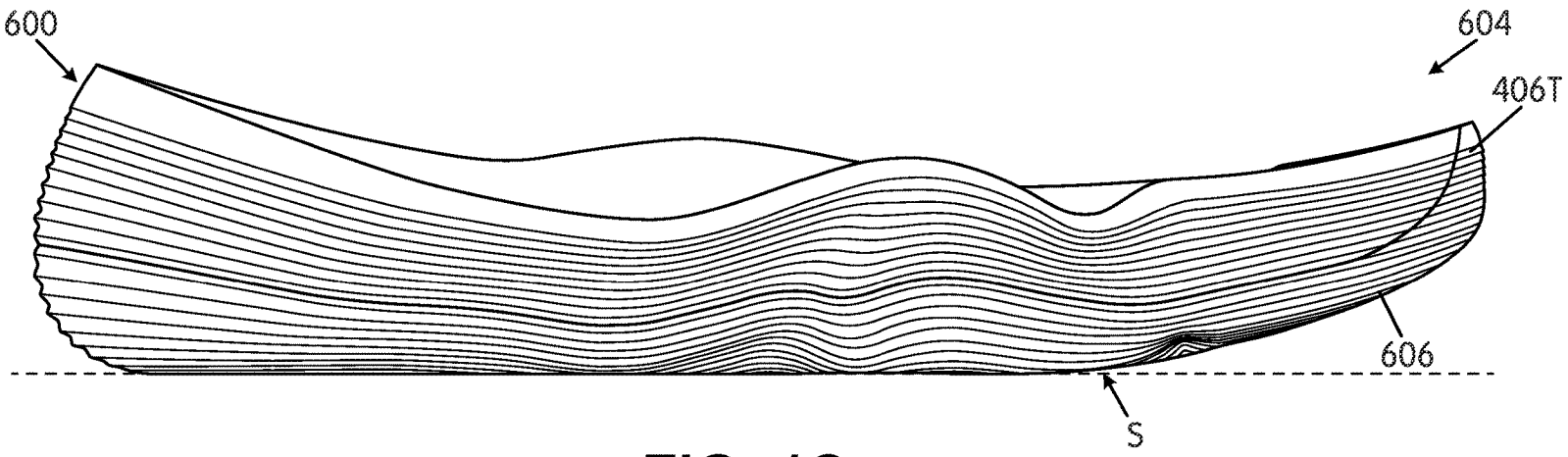
Figure 4D:
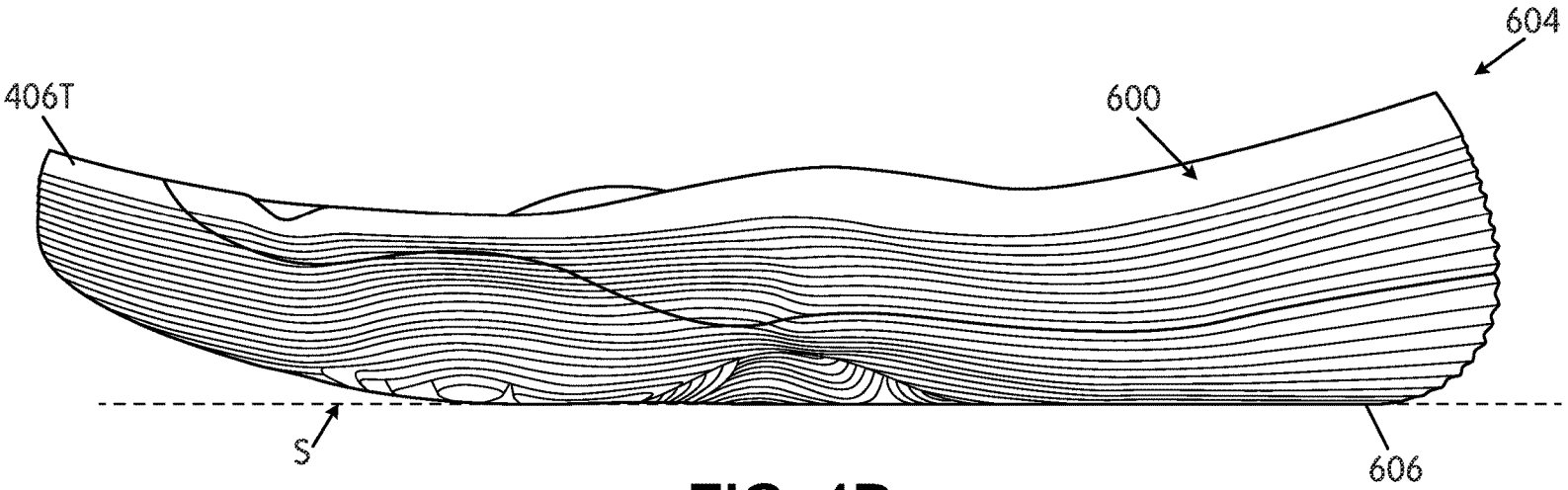
Figure 4F:
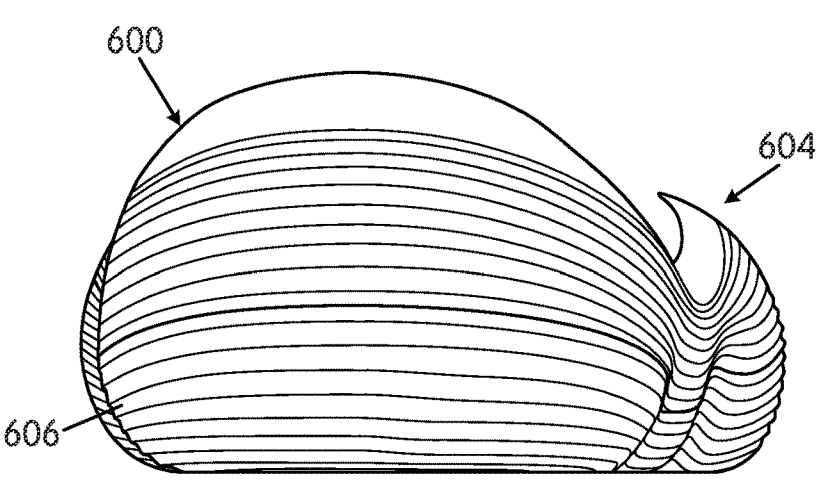
Figure 4E:
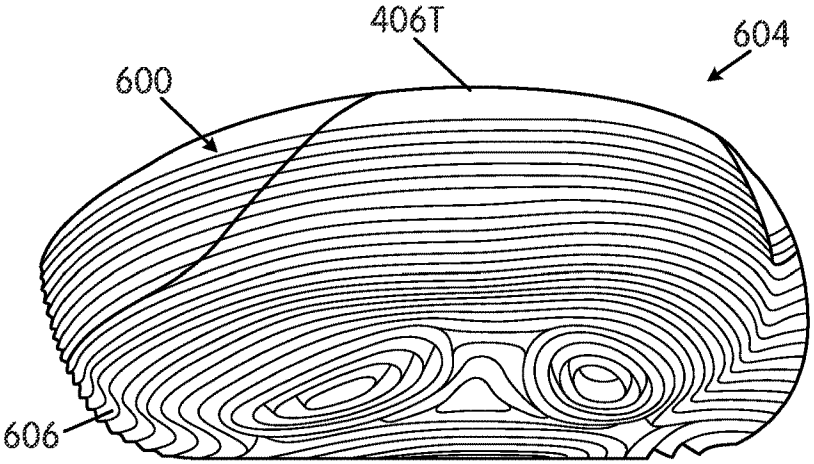
Figure 4G:
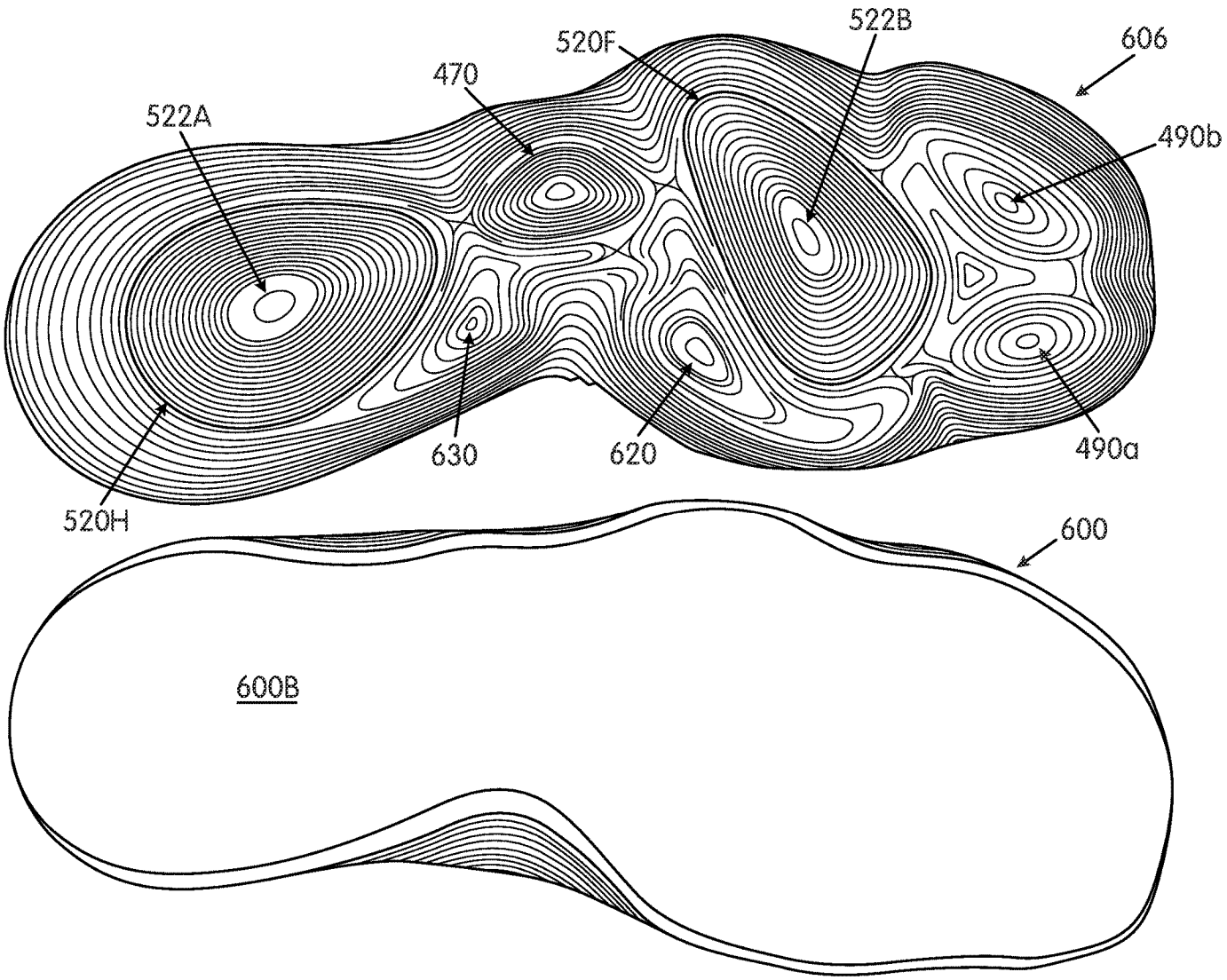
Figure 4H:
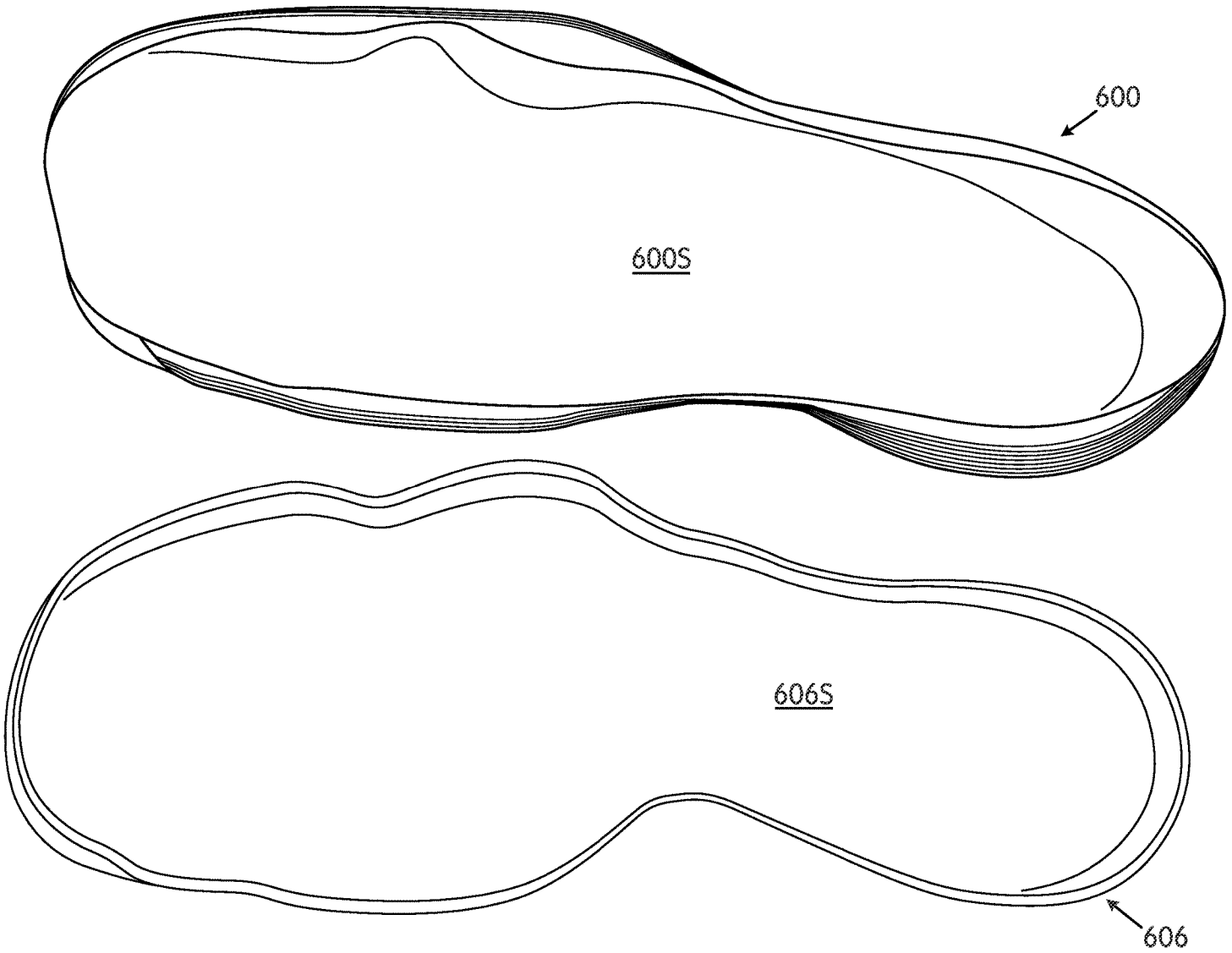
Figure 4I:
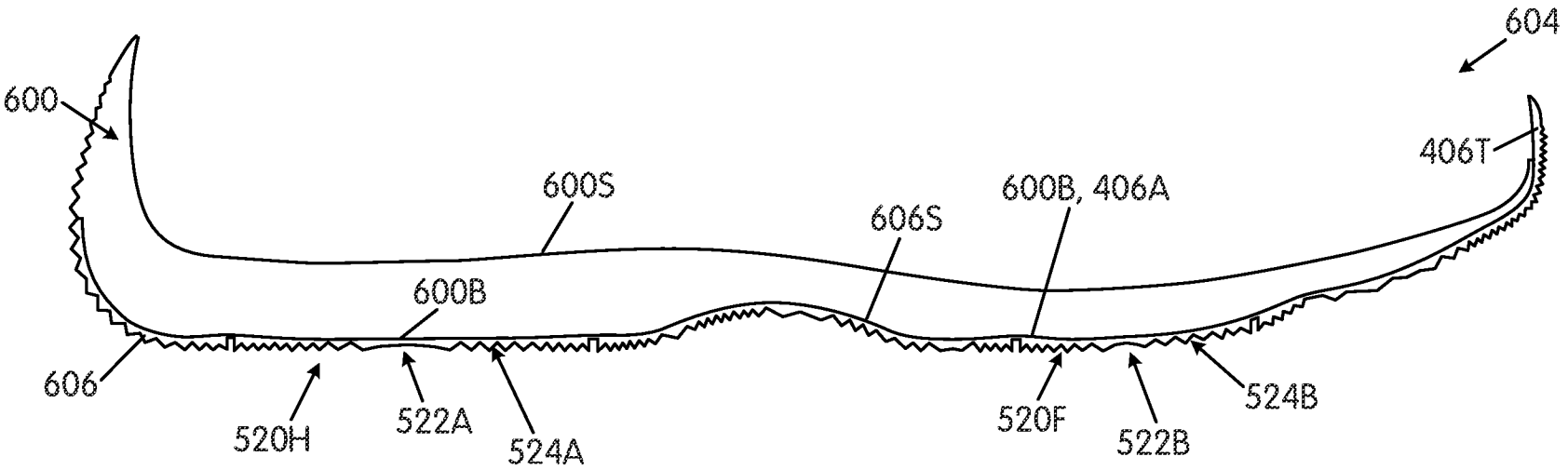
Figure 4K:
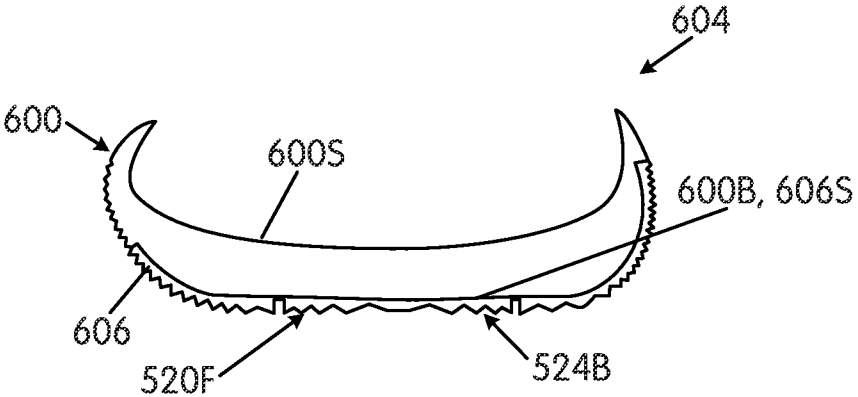
Figure 4J:
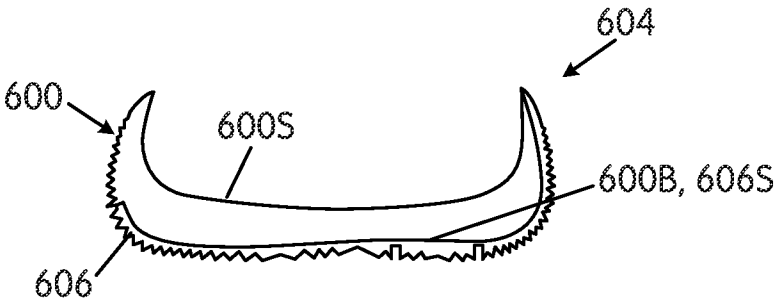
Figure 4M:
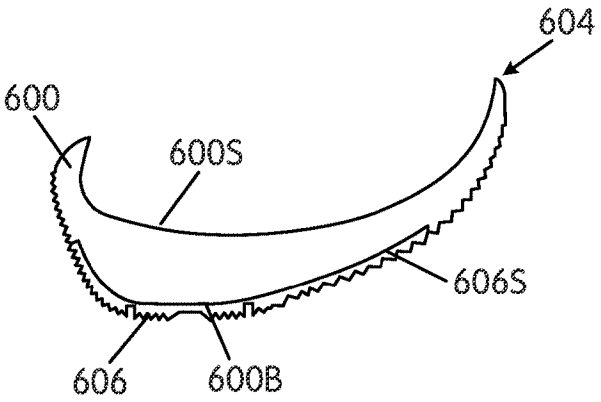
Figure 4L:
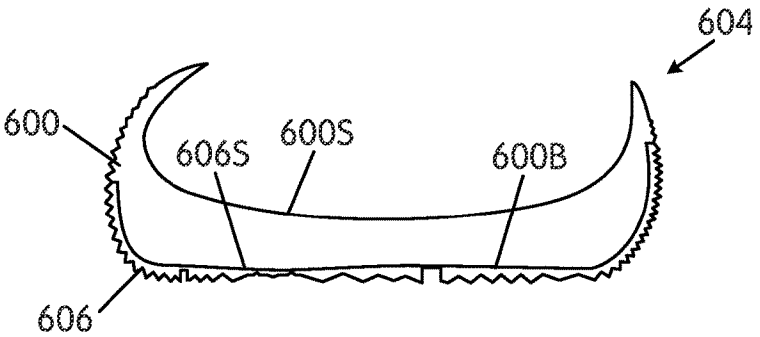
Figure 4O:
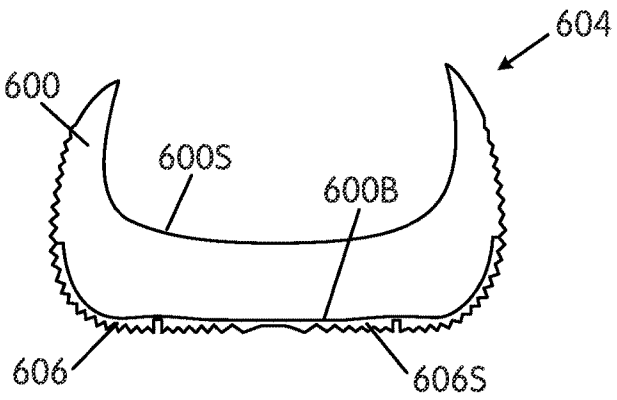
Figure 4N:
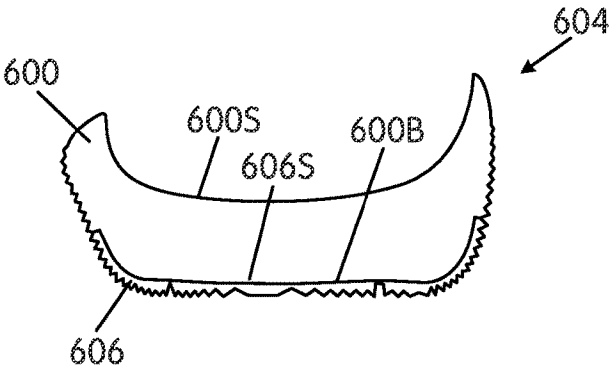

Another example sole structure 604 in accordance with some aspects of this invention is illustrated in FIGS. 4A-4O. Specifically, FIG. 4A provides a bottom view of the sole structure 604; FIG. 4B provides a top view; FIG. 4C provides a lateral side view; FIG. 4D provides a medial side view; FIG. 4E provides a toe view; FIG. 4F provides a heel view; FIG. 4G provides bottom views of the outsole 606 and midsole 600 structures; FIG. 4H provides top views of the outsole 606 and midsole 600 structures; FIG. 4I provides a longitudinal sectional view along line I-I in FIGS. 4A and 4B; FIG. 4J provides a sectional view along line J-J in FIGS. 4A and 4B; FIG. 4K provides a sectional view along line K-K in FIGS. 4A and 4B; FIG. 4L provides a sectional view along line L-L in FIGS. 4A and 4B; FIG. 4M provides a sectional view along line M-M in FIGS. 4A and 4B; FIG. 4N provides a sectional view along line N-N in FIGS. 4A and 4B; and FIG. 4O provides a sectional view along line O-O in FIGS. 4A and 4B. Because much of the midsole component 600 in this example sole structure 604 may be the same or similar to those described above in conjunction with FIGS. 2A-2V and FIGS. 3A-3N, much of the detailed description of midsole component 600 will not be repeated (although some differences will be discussed). Notably, like reference numbers in the various figures refer to the same or similar parts, and the midsole component 600 and/or outsole component 606 may have any of the desired features, characteristics, and/or options to those described above in conjunction with the structures of FIGS. 2A-3N. Also, the sole structure 604 of FIGS. 4A-4O may be engaged with a footwear upper structure, including, if desired, footwear uppers 202 of the various types and/or having any one or more of the features described above in conjunction with FIGS. 1A-1D.

Some differences between the sole structure 604 of FIGS. 4A-4O and the other sole structures described above in conjunction with FIGS. 1A-3N relate to the midsole structure 600. In the sole structure 600 of FIGS. 4A-4O, the midsole structure 600 constitutes a single piece construction (e.g., made from a polymeric foam material, such as polyurethane foam, ethylvinylacetate foam, etc., e.g., made by injection molding, compression molding, and/or other processes as are known and used in the footwear arts). Furthermore, this example midsole structure 600 includes relatively smooth and/or gently contoured upper-facing (and plantar surface supporting) base surface 600S and ground-facing surface 600B. Specifically, and in contrast to the structures 400 described above, midsole structure 600 of this example lacks the impact-force attenuating structures 420F and 420H described with respect to the sole structures 204 and 504 above. Alternatively, if desired, midsole structure 600 could include one or more impact-force attenuating structures, e.g., like one or both of structures 420F and 420H described in detail above.

The outsole component 606 of this example differs somewhat from the example structures 406, 506 described above. For example, while outsole component 606 includes heel-supporting region 520H, forefoot-supporting region 520F, midfoot-supporting region 470, and forward toe-supporting regions 490*a*, 490*b*, these regions are shaped and/or oriented somewhat different from corresponding regions described above in conjunction with FIGS. 2A-3N. While each of these regions still includes a central area (e.g., a recessed central area) (e.g., 522A, 522B, 470*a*, and the corresponding areas in regions 490*a*, 490*b*) and a plurality of rings (e.g., 524A, 524B, 470*b*, and the corresponding rings in regions 490*a*, 490*b*), these regions are shaped somewhat differently. For example, the central area (e.g., recessed central area) 522A and/or rings 524A of the heel-supporting region 520 and the central area (e.g., recessed central area) 470*a* and/or rings 470*b* of the midfoot-supporting region 470 are elongated in a fore-to-aft direction of the sole structure 604 (e.g., somewhat oval, elliptical or egg shaped). Also, the central area (e.g., the recessed central area) 522B and/or rings 524B of the forefoot-supporting region 520F are elongated in a lateral side-to-medial side direction (e.g., again, somewhat oval, elliptical or egg shaped). Similarly, the central areas and/or rings of the forefoot/toe-supporting regions 490*a* and/or 490*b* also are elongated in the fore-to-aft direction (e.g., again, somewhat oval, elliptical or egg shaped).

Some additional example dimensional features of this outsole component 606 will be described in more detail below. In the example structure of FIGS. 4A-4O, each of heel-supporting region 520H, midfoot-supporting region 470, and forefoot-supporting region 520F are defined by a plurality of rings that surround only that specific supporting region. In at least some examples of this invention, the area of heel-supporting region 520H enclosed by rings that surround only the heel-supporting region 520H will be within a range of 2 $in^2$ to 14 $in^2$ (and in some examples, from 2.5 $in^2$ to 12 $in^2$ or even from 3 $in^2$ to 10 $in^2$). Additionally or alternatively, the area of midfoot-supporting region 470 enclosed by rings that surround only the midfoot-supporting region 470 will be within a range of 0.75 $in^2$ to 8 $in^2$ (and in some examples, from 1 $in^2$ to 7 $in^2$ or even from 1.5 $in^2$ to 6 $in^2$). Additionally or alternatively, the area of forefoot-supporting region 520F enclosed by rings that surround only the forefoot-supporting region 520F will be within a range of 2 $in^2$ to 14 $in^2$ (and in some examples, from 2.5 $in^2$ to 12 $in^2$ or even from 3 $in^2$ to 10 $in^2$). These same size ranges may be used in the various heel, forefoot, and/or midfoot-supporting regions in the other sole structures described herein.

The sole structure 604 of FIGS. 4A-4O includes some foot-supporting regions, each with central areas and one or more rings, that are not shown in the other example sole structures 204, 504 described above. For example, a forward midfoot-supporting region 620 including a central area (e.g., a recessed central area) 622 and a plurality of rings 624 (having increasing larger perimeters or circumferences) is provided rearward from the forefoot-supporting region 520F. This forward midfoot-supporting region 620 may provide additional traction, impact-force attenuation, stability, and/or support for the first metatarsal head support area (e.g., for use during the toe-off phase of a step cycle, when landing a step or jump, when launching a step or jump, etc.). Additionally or alternatively, a rearward midfoot-supporting region 630 including a central area (e.g., a recessed central area) 632 and a plurality of rings 634 (having increasing larger perimeters or circumferences) is provided forward and/or along the medial side from the heel-supporting region 520H. This rearward midfoot-supporting region 630 may provide additional stability and/or support for the arch area (e.g., for use when landing a step or jump, etc.).

As shown in FIGS. 4G and 4H, the sole structure 604 of this example is assembled by engaging the inner surface 606S of the outsole component 606 with the bottom surface 600B of the midsole component 600. These parts may be engaged together in any desired manner, including through the use of adhesives or cements, mechanical connectors, friction fits, fusing techniques, or the like, including in manners conventionally known and used in the footwear arts.

Again, as illustrated in FIG. 4A, one or more rings may surround a combined area of any two or more of the forefoot-supporting region 520F, the heel-supporting region, 520H, the midfoot-supporting region 470, the rearward midfoot-supporting region 630, the forward midfoot-supporting region 620, the forward toe-supporting region 490*a*, and/or the forward toe-supporting region 490*b*. These surrounding rings may take on any of the features, options, and/or characteristics for the similar rings described above, e.g., and may extend to the side areas or surfaces, rear heel area or surface, and/or forward toe area or surface of the outsole structure 606 and/or the midsole structure 600.

Alternatively, if desired, the outsole component 606 of the example structure shown in FIGS. 4A-4O could be omitted, and the features of the outsole component 606 may be formed in the midsole structure 600 (e.g., in bottom surface 600B). If desired, at least the exterior-most surfaces of the midsole structure 600 may be made from a relatively durable foam material, to provide better wear resistance and durability properties.

Figure 5:
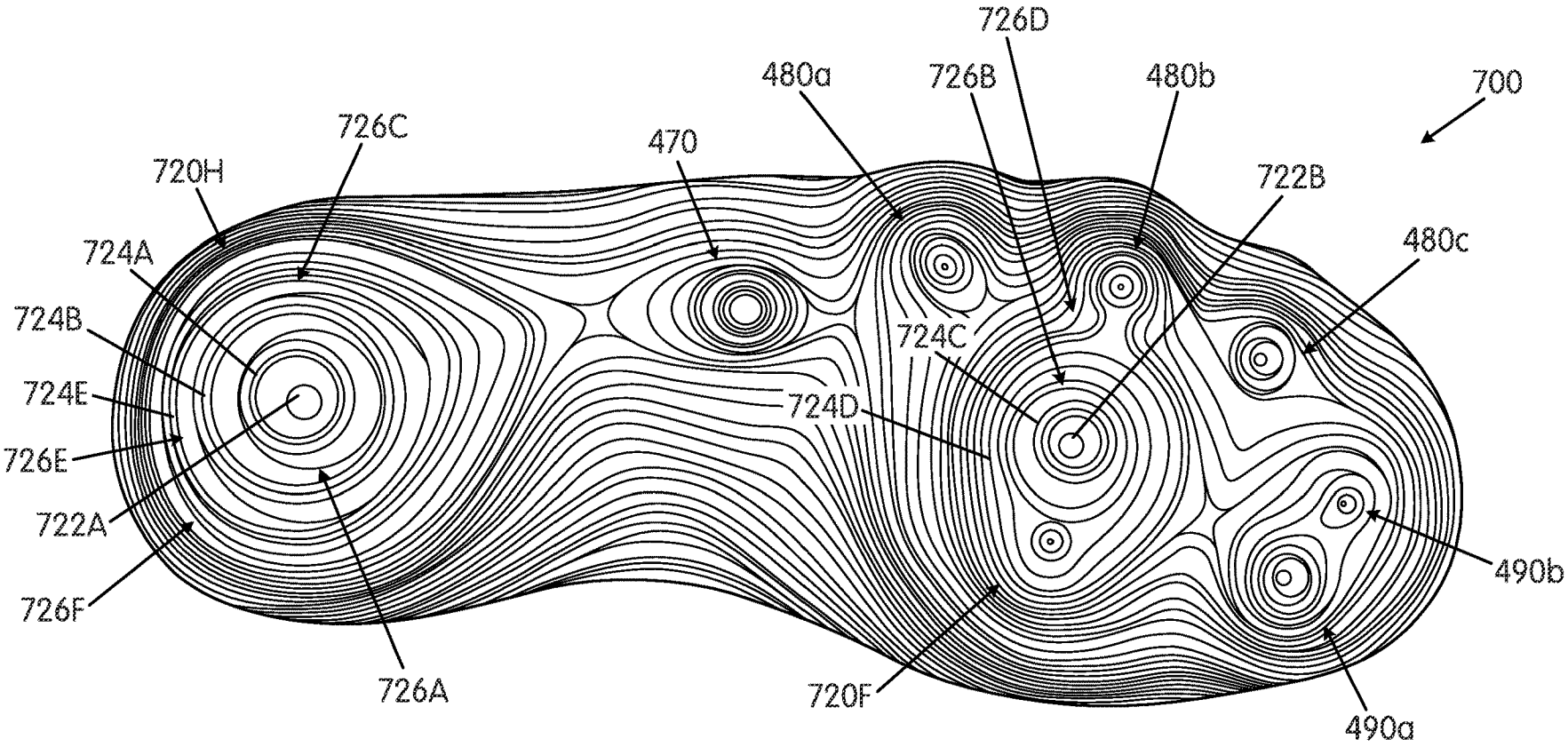
FIG. 5 provides a view of another sole structure for an article of footwear in accordance with some examples and aspects of this invention.

FIG. 5 illustrates a bottom view of another sole structure 700 (e.g., a midsole component, an outsole component, combined midsole and outsole components, etc.) in accordance with additional potential aspects of this invention. Like the example of FIGS. 2A-2V, this example sole structure 700 includes a heel-based impact force attenuating structure 720H and a forefoot-based impact force attenuating structure 720F having central areas (e.g., central recessed areas) (722A and 722B, respectively), surrounding bands (724A-724D), and recessed grooves (726A-726D) of the types described above. These areas 720H, 720F, 722A, 722B, 724A-724D, and/or 726A-726D may have any of the specific features, characteristics, structures, sizes, etc., as the corresponding parts described above with respect to FIGS. 2A-2V.

The structure 700 of FIG. 5, however, shows additional or alternative potential features of impact-force attenuating structures (e.g., 720H, 720F) in accordance with this invention. For example, FIG. 5 shows that the heel-based impact-force attenuating structure 720H includes a third band 724E located outside of band 724B and separated therefrom (and/or at least partially defined) by another recessed groove 726E. An additional recessed groove 726F surrounding groove 726E defines the outer edge of band 724E in this example and morphs into the remainder of the sole structure 700. The bands 724A, 724B, and 724E and recessed grooves 726A, 726C, 726E, and 726F change from a generally circular structure toward the inside (e.g., elements 724A, 724B, 726A) to a more teardrop type structure toward the outside (e.g., elements 726C, 724E, 726E, and 726F).

Furthermore, while the sole structure 700 of FIG. 5 includes foot-supporting regions akin to regions 470, 480*a*, 480*b*, 480*c*, 490*a*, and 490*b* described above, in this sole structure 700, at least some of these foot-supporting regions (e.g., regions 480*b*, 490*a*, and 490*b* in this illustrated example) are located inside the recessed groove 726D defining the outer edge of the forefoot based impact force-attenuating structure 720F. More, fewer, and/or different foot-supporting regions of this type could be provided inside the outermost recessed groove 726D if desired. Additionally or alternatively, if desired, one or more other support regions (having recessed central areas and a plurality of rings) could be provided within one or more of the recessed grooves 726A, 726C, 726E, and/or 726F provided in the heel-based impact-force attenuating structure 720H. Such impact force-attenuating structures of these types could be provided in a single sole component 700 (e.g., an outsole or a midsole component) or on two or more separate sole components (e.g., outsole and/or midsole components). Also, the sole structure 700 of FIG. 5 may be engaged with a footwear upper structure, including, if desired, footwear uppers 202 of the various types and/or having any one or more of the features described above in conjunction with FIGS. 1A-1D. The sole structure 700 of FIG. 5 also may have any of the surrounding ring structures described above, e.g., on an outsole or midsole component, including on the side surfaces or sidewalls of either of these components.

II. CONCLUSION

The present invention is disclosed above and in the accompanying drawings with reference to a variety of embodiments and/or options. The purpose served by the disclosure, however, is to provide examples of various features and concepts related to the invention, not to limit the scope of the invention. One skilled in the relevant art will recognize that numerous variations and modifications may be made to the features of the invention described above without departing from the scope of the present invention, as defined by the appended claims.

What is claimed is:

1. A sole structure for an article of footwear, comprising:

a foam midsole element formed from a polymeric foam material, the foam midsole element including an upper-facing surface and a ground-facing surface opposite the upper-facing surface, the foam midsole element further comprising:

a heel-supporting region formed in polymeric foam material of the foam midsole element, wherein the heel-supporting region includes a recessed central area surrounded by a first plurality of rings defined in the ground-facing surface, wherein the recessed central area of the heel-supporting region and at least some of the first plurality of rings are generally circular; and a forefoot-supporting region formed in polymeric foam material of the foam midsole element, wherein the forefoot-supporting region includes a recessed central area surrounded by a second plurality of rings defined in the ground-facing surface, wherein the recessed central area of the forefoot-supporting region and at least some of the second plurality of rings are generally circular, wherein each of the first plurality of rings and the second plurality of rings includes: a first ring that surrounds the recessed central area and a second ring that surrounds the first ring, and a first recessed groove separating the first ring and the second ring, wherein a first depth of the recessed central area of the heel-supporting region is greater than a second depth of the first recessed groove of the heel-supporting region, and wherein a third depth of the recessed central area of the forefoot-supporting region is greater than a fourth depth of the first recessed groove of the forefoot-supporting region.

2. The sole structure according to claim 1, wherein at least one of the first plurality of rings and the second plurality of rings includes a third ring that surrounds the second ring, and a second recessed groove separating the second ring and the third ring.

3. The sole structure according to claim 2, wherein at least the first plurality of rings includes the third ring and the second recessed groove, wherein the second depth of the first recessed groove of the heel-supporting region is greater than a fifth depth of the second recessed groove of the heel-supporting region.

4. The sole structure according to claim 1, wherein the first depth of the recessed central area of the heel-supporting region is within a range of 25 percent and 65 percent of an overall thickness of the foam midsole element at a location immediately adjacent the recessed central area of the heel-supporting region.

5. The sole structure according to claim 1, wherein the second depth of the first recessed groove of the heel-supporting region is within a range of 15 percent and 50 percent of an overall thickness of the foam midsole element at a location immediately adjacent the recessed central area of the heel-supporting region.

6. The sole structure according to claim 1, wherein the heel-supporting region and the forefoot-supporting region are covered by an outsole element.

7. The sole structure according to claim 1, further comprising:

an outsole component engaged with the foam midsole element, the outsole component including a midfoot-supporting region including a recessed midfoot central area surrounded by a third plurality of rings, wherein the third plurality of rings includes an innermost ring that surrounds and defines the recessed midfoot central area and at least three additional rings of increasingly larger circumference surrounding the innermost ring.

8. The sole structure according to claim 1, wherein the third depth of the recessed central area of the forefoot-supporting region is within a range of 55 percent and 85 percent of an overall thickness of the foam midsole element at a location immediately adjacent the recessed central area of the forefoot-supporting region.

9. The sole structure according to claim 1, wherein the fourth depth of the first recessed groove of the forefoot-supporting region is within a range of 25 percent and 60 percent of an overall thickness of the foam midsole element at a location immediately adjacent the recessed central area of the forefoot-supporting region.

10. A sole structure for an article of footwear, comprising:

a foam midsole including an upper-facing surface and a ground-facing surface opposite the upper-facing surface, the foam midsole further including:

a heel-supporting region formed in polymeric foam material of the foam midsole, the heel-supporting region including: (i) a recessed central area, (ii) a first ring that surrounds the recessed central area, and (iii) a second ring that surrounds the first ring, wherein a first recessed groove separates the first ring and the second ring, wherein the recessed central area of the heel-supporting region, the first ring, and the second ring are generally circular, and wherein a first depth of the recessed central area of the heel-supporting region is greater than a second depth of the first recessed groove of the heel-supporting region; and a forefoot-supporting region formed in polymeric foam material of the foam midsole, the forefoot-supporting region including: (i) a recessed central area, (ii) a third ring that surrounds the recessed central area of the forefoot-supporting region, and (iii) a fourth ring that surrounds the third ring, wherein a second recessed groove separates the third ring and the fourth ring, wherein the recessed central area of the forefoot-supporting region, the third ring, and the fourth ring are generally circular, and wherein a third depth of the recessed central area of the forefoot-supporting region is greater than a fourth depth of the second recessed groove of the forefoot-supporting region.

11. The sole structure according to claim 10, wherein the first depth is within a range of 25% and 65% of an overall thickness of the foam midsole at a location immediately adjacent the recessed central area of the heel-supporting region, and wherein the second depth is within a range of 15% and 50% of the overall thickness of the foam midsole the location immediately adjacent the recessed central area of the heel-supporting region.

12. The sole structure according to claim 11, wherein the third depth is within a range of 55% and 85% of an overall thickness of the foam midsole at a location immediately adjacent the recessed central area of the forefoot-supporting region, and wherein the second depth is within a range of 25% and 60% of the overall thickness of the foam midsole the location immediately adjacent the recessed central area of the forefoot-supporting region.

13. The sole structure according to claim 10, wherein the third depth is within a range of 55% and 85% of an overall thickness of the foam midsole at a location immediately adjacent the recessed central area of the forefoot-supporting region, and wherein the second depth is within a range of 25% and 60% of the overall thickness of the foam midsole the location immediately adjacent the recessed central area of the forefoot-supporting region.

14. The sole structure according to claim 10, wherein the heel-supporting region further includes a third recessed groove located immediately outside the second ring, and wherein a fifth depth of the third recessed groove is less than the second depth of the first recessed groove.

15. The sole structure according to claim 14, wherein the forefoot-supporting region further includes a fourth recessed groove located immediately outside the fourth ring, and wherein a sixth depth of the fourth recessed groove is less than the fourth depth of the second recessed groove.

16. The sole structure according to claim 10, wherein the forefoot-supporting region further includes a third recessed groove located immediately outside the fourth ring, and wherein a fifth depth of the third recessed groove is less than the fourth depth of the second recessed groove.

17. A sole structure for an article of footwear, comprising:

a foam midsole including an upper-facing surface and a ground-facing surface opposite the upper-facing surface, the foam midsole further including:

a heel-supporting region formed in polymeric foam material of the foam midsole, the heel-supporting region including: (i) a recessed central area having a first depth, (ii) a first ring that surrounds the recessed central area, (iii) a second ring that surrounds the first ring, wherein a first recessed groove having a second depth separates the first ring and the second ring, and (iv) a second recessed groove immediately surrounding the second ring and having a third depth, wherein the first depth is greater than the second depth, and wherein the second depth is greater than the third depth; and a forefoot-supporting region formed in polymeric foam material of the foam midsole, the forefoot-supporting region including: (i) a recessed central area having a fourth depth, (ii) a third ring that surrounds the recessed central area of the forefoot-supporting region, (iii) a fourth ring that surrounds the third ring, wherein a third recessed groove having a fifth depth separates the third ring and the fourth ring, and (iv) a fourth recessed groove immediately surrounding the fourth ring and having a sixth depth, wherein the fourth depth is greater than the fifth depth, and wherein the fifth depth is greater than the sixth depth.

18. The sole structure according to claim 17, wherein the first depth is within a range of 25% and 65% of an overall thickness of the foam midsole at a location immediately adjacent the recessed central area of the heel-supporting region, wherein the second depth is within a range of 15% and 50% of the overall thickness of the foam midsole the location immediately adjacent the recessed central area of the heel-supporting region, and wherein the third depth is within a range of 10% and 30% of the overall thickness of the foam midsole the location immediately adjacent the recessed central area of the heel-supporting region.

19. The sole structure according to claim 18, wherein the fourth depth is within a range of 55% and 85% of an overall thickness of the foam midsole at a location immediately adjacent the recessed central area of the forefoot-supporting region, wherein the fifth depth is within a range of 25% and 60% of the overall thickness of the foam midsole the location immediately adjacent the recessed central area of the forefoot-supporting region, and wherein the sixth depth is within a range of 18% and 45% of the overall thickness of the foam midsole the location immediately adjacent the recessed central area of the forefoot-supporting region.

20. The sole structure according to claim 17, wherein the fourth depth is within a range of 55% and 85% of an overall thickness of the foam midsole at a location immediately adjacent the recessed central area of the forefoot-supporting region, wherein the fifth depth is within a range of 25% and 60% of the overall thickness of the foam midsole the location immediately adjacent the recessed central area of the forefoot-supporting region, and wherein the sixth depth is within a range of 18% and 45% of the overall thickness of the foam midsole the location immediately adjacent the recessed central area of the forefoot-supporting region.

* * * * *